US008567422B2

(12) United States Patent
Lee

(10) Patent No.: US 8,567,422 B2
(45) Date of Patent: Oct. 29, 2013

(54) UMBRELLA

(76) Inventor: Boo Il Lee, Busan (KR)

( * ) Notice: Subject to any disclaimer, the term of this patent is extended or adjusted under 35 U.S.C. 154(b) by 195 days.

(21) Appl. No.: 13/057,711

(22) PCT Filed: Jul. 31, 2009

(86) PCT No.: PCT/KR2009/004291

§ 371 (c)(1),
(2), (4) Date: Feb. 4, 2011

(87) PCT Pub. No.: WO2010/016691

PCT Pub. Date: Feb. 11, 2010

(65) Prior Publication Data

US 2011/0132417 A1 Jun. 9, 2011

(30) Foreign Application Priority Data

Aug. 4, 2008 (KR) ..... 10-2008-0076145

(51) Int. Cl.
*A45B 25/16* (2006.01)

(52) U.S. Cl.
USPC ..... 135/24; 135/20.3; 135/22

(58) Field of Classification Search
USPC ..... 135/20.3, 22, 24, 25.1, 25.4, 37
See application file for complete search history.

(56) References Cited

U.S. PATENT DOCUMENTS

| | | | | |
|---|---|---|---|---|
| 3,756,258 | A * | 9/1973 | Yoshihara | 135/22 |
| 4,041,966 | A * | 8/1977 | Sakurai | 135/22 |
| 4,934,394 | A * | 6/1990 | Hermanson | 135/19.5 |
| 4,936,332 | A * | 6/1990 | Wu | 135/20.3 |
| 5,088,512 | A * | 2/1992 | Chou et al. | 135/24 |
| 5,213,122 | A * | 5/1993 | Grady, II | 135/20.3 |
| 5,224,505 | A * | 7/1993 | Wu | 135/24 |
| 5,247,955 | A * | 9/1993 | Wu | 135/22 |
| 5,297,571 | A * | 3/1994 | Chu et al. | 135/24 |
| 6,273,111 | B1 * | 8/2001 | Weiss et al. | 135/25.41 |
| 7,588,041 | B2 * | 9/2009 | Huang | 135/24 |
| 8,011,379 | B2 * | 9/2011 | Oh | 135/25.4 |

FOREIGN PATENT DOCUMENTS

| | | |
|---|---|---|
| KR | 10-2007-0037461 | 4/2007 |
| KR | 20-2008-0001848 | 6/2008 |
| WO | 85-03418 | 8/1985 |

OTHER PUBLICATIONS

International Search Report for PCT/KR2009/004291 Mailed on Mar. 5, 2010.

* cited by examiner

*Primary Examiner* — Winnie Yip
(74) *Attorney, Agent, or Firm* — Christopher Paul Mitchell

(57) ABSTRACT

The present invention relates to an umbrella including: a shank consisting of an outer tube coupled with a handle and inner tube secured within the outer tube; an auxiliary rib fixing member and a main rib fixing member arranged on the top of the outer tube and of the inner tube, respectively; a rib assembly consisting of a plurality of auxiliary ribs and main ribs rotatably assembled to the auxiliary rib fixing member and the main rib fixing member; an operating slit extending in the vertical direction on the handle and opposed to the outer tube; an operating handle moving in a vertical direction along the outer tube and is assembled to the inner tube by a pin inserted through the operating slit; an operating button mounted on the handle is elastically supported by a spring, and has a stopper protrusion inserted into the operating slit; and a stopper hole formed below the operating handle at the position matched to an upper head center and a lower dead center where the inner tube elevates, and which is selectively coupled with the stopper protrusion of the operating button.

20 Claims, 55 Drawing Sheets

UMBRELLA

RELATED APPLICATIONS

This application is a 371 application of International Application No. PCT/KR2009/004291, filed Jul. 31, 2009, which in turn claims priority from Korean Patent Application No. 10-2008-0076145, filed Aug. 4, 2008, each of which is incorporated herein by reference in its entirety.

TECHNICAL FIELD

The present invention relates to an umbrella, and in particular to an umbrella which has a simple structure and easily spreads and is folded.

BACKGROUND ART

When it rains, people use an umbrella for protecting a body from rains. The conventional umbrella has been advanced, while providing a function that ribs are designed to spread when a user presses a button of a handle secured to a lower side of a shank, which gives many conveniences to a user.

The conventional umbrella is designed to fold when not in use in such a manner that a user holds auxiliary rib fixing members positioned at an upper side of the shank and lowers below the shank.

The above operation causes a lot of inconveniences when in use of the umbrella. In particular, the rain drops gathering on an umbrella cloth engaged to an outer side of ribs might fly to a user's body or clothes in the course of the above operation.

DISCLOSURE OF INVENTION

Accordingly, it is an object of the present invention to provide an umbrella which has a simple structure and easily spreads and folds while overcoming the problems encountered in the conventional art.

To achieve the above object, the following means for achieving the objects of the present invention are provided.

First, there is provided an umbrella, which comprises a shank which includes an outer tube, with a handle being secured to a lower side of the outer tube, and an inner tube which is secured to an inner side of the outer tube and has a stopper protrusion at its intermediate upper portion; an auxiliary rib fixing member and a main rib fixing member which are installed at the upper sides of the outer tube and the inner tube, respectively; a rib assembly which includes a plurality of auxiliary ribs and a plurality of main ribs which are rotatably assembled to the auxiliary rib fixing member and the main rib fixing member, respectively; operation holes which are elongated in upward and downward directions at an upper side of the handle and are opposite to each at the outer tube; an operation handle which ascends and descends along an outer portion of the outer tube and is assembled to the inner tube via the operation holes by a pin; an operation button which is installed at the handle and are elastically supported by a spring and includes an engaging protrusion which is inserted into the operation hole formed at a lower side of the outer tube; and engaging holes which are formed at the portions matching with the upper dead point and the lower dead point between which the inner tube ascends or descends, below the operation handle, with the engaging protrusion formed at the operation button being selectively secured to the engaging holes.

Second, there is provide an umbrella, which comprises a shank which includes an outer tube, with a handle being secured to a lower side of the outer tube, and an inner tube which is secured to an inner side of the outer tube; an auxiliary rib fixing member and a main rib fixing member which are installed at the upper sides of the outer tube and the inner tube, respectively; a rib assembly which includes a plurality of auxiliary ribs and a plurality of main ribs which are rotatably assembled to the auxiliary rib fixing member and the main rib fixing member, respectively; an enlarged tube part which is integral with the inner tube at a lower side of the inner tube; a spring pressing tube which appears below the handle and has a support shoulder formed at its lower side, with an engaging shoulder formed at its upper side being caught by an upper side of the enlarged tube part; a coil spring which is disclosed between a stopper protrusion formed at an intermediate upper portion of the inner tube, while being positioned below the auxiliary rib fixing member, and an engaging shoulder of the spring pressing tube; an auxiliary button which performs a pressing operation by an operation button installed at the handle while being elastically supported by the spring and a pressing piece integrally formed at the operation button; a pair of engaging protrusions which are formed at the operation button and the auxiliary button toward the spring, and an ascending and descending prevention protrusion and a support protrusion which are formed opposite to the engaging protrusion of the operation button and are formed at a lower side of the pressing piece; a guide surface which is downwardly inclined and formed at the engaging protrusion of the operation button, and a guide surface which is upwardly inclined and formed at the engaging protrusion of the auxiliary button; an engaging hole which is short formed at an upper side of the enlarged tube part so that the engaging protrusions are selectively secured to the operation button and the auxiliary button, and an operation hole which is elongated in its lower direction, and an operation hole which is long formed at an upper side of the spring pressing tube while overlapping with the same, and an engaging hole which is short formed in its lower direction; an operation hole which is formed at an inner side of the handle of the outer tube through which the engaging protrusions, the ascending and descending prevention protrusion and the support protrusion come in and out; and a stopper hole which is positioned while overlapping with the engaging hole and the operation hole at the upper side of the enlarged tube part while being selectively secured to the ascending and descending prevention protrusion and the support protrusion formed at the operation button and the pressing piece, respectively, and which is sized to be small so that the support protrusion does not enter when pressing the operation button, and stopper holes which are formed in the same sizes at the lower side of the enlarged tube part and the spring pressing tube while overlapping with the engaging hole and the operation hole formed at the spring pressing tube and which is long formed so that the support protrusion can enter when pressing the operation button.

Third, it is characterized that the diameter of the engaging part of main ribs secured to a main rib fixing member is larger than the diameter of the engaging part of the auxiliary rib secured to the auxiliary fixing member.

Fourth, there is further provided an umbrella which comprises a space which is downwardly open toward the inner side of the handle; and a second auxiliary coil spring which is installed between the handle and the support shoulder formed at a to lower side of the spring pressing tube and is inserted in the space.

Fifth, an installation hole is formed below a space formed at an inner side of the handle, and a spring support member is inserted into the installation hole and is inserted into an outer portion of the outer tube. An inner insertion hole with its side being open is formed at the spring support member, and the stopper having opposite protrusions is secured to the inner insertion hole and is inserted into an outer side of the outer tube, and one side of each of the protrusions formed at the stopper is equipped with an inclined surface in upper and lower side directions and are inserted into the engaging hole of the outer tube and the second operation hole formed at the spring pressuring tube. The other side of the same is equipped with a downwardly inclined surface and is inserted into the second engaging hole positioned opposite to the second operation hole and positioned at the top center of the second operation hole via the operation hole of the outer tube.

Sixth, there are further provided an auxiliary coil spring which is installed between the auxiliary rib fixing member and the main rib fixing member; and a spring housing which is integrally formed at the main rib fixing member for thereby accommodating the auxiliary coil spring in a state that the umbrella is folded.

Seventh, there is provided an umbrella which comprises a shank which includes an outer tube to which a handle is secured at its lower side, and an inner tube secured to an inner side of the outer tube; a main rib fixing member which is secured to an upper side of the outer tube; an auxiliary rib fixing member which includes a pin secured to an upper side of the inner tube via an operation hole elongated in an upward and downward direction at the outer tube at a lower side of the main rib fixing member and ascends and descends along the outer tube while being secured to the pin; a rib assembly which is formed of a plurality of auxiliary ribs and a plurality of main ribs which are rotatably secured to the auxiliary rib fixing member and the main rib fixing member; an operation button which is installed at the handle while being elastically supported by the spring, and includes an engaging protrusion which is inserted into the operation hole formed at a lower side of the outer tube; an appearing and disappearing part which is formed at a lower of the inner tube in an enlarged tube shape and is secured to the handle and includes an engaging shoulder formed at its lower side, with the appearing and disappearing part appearing when the umbrella spreads and disappearing when the umbrella is folded; and engaging holes which are formed at the appearing and disappearing part while matching with the upper dead point and the lower dead point between which the inner tube ascends and descends, with the engaging protrusion formed at the operation button being selectively secured to the engaging holes.

Eighth, there is provided an umbrella which comprises a shank which includes an outer tube with a handle being secured to its lower side, and a main rib fixing member being secured to its upper side, and an inner tube which is assembled via a through hole formed at the main rib fixing member and is secured to an inner side of the outer tube and includes a support tube which forms an engaging shoulder at its lower side for thereby being positioned at an inner side of the handle; a spring support tube which is integrally covered at an upper outer portion of the inner tube and includes a shoulder at its lower side; an operation hole which is elongated in an upward and downward direction at an outer tube of a lower side of the main rib fiving member, and an operation hole which is elongated in an upward and downward direction at the spring support tube secured to the inner tube and the inner tube, while communicating with the operation hole; an operation tube of which upper side is inserted between the inner tube and the spring support tube; a pin which is inserted into an upper side of the operation tube via the operation holes, and an auxiliary rib fixing member which is secured to the pin and ascends and descends along the outer tube; a rib assembly which is formed of a plurality of auxiliary ribs and a plurality of main ribs which are rotatably secured to the auxiliary rib fixing member and the main rib fixing member; an appearing and disappearing part which is integrally formed at a lower side of the operation tube so that the engaging shoulder positioned at the outer sides of the shoulder and the handle is formed in an upward and downward direction; a coil spring which is installed between a shoulder of the spring support tube integrally formed at the inner tube and a shoulder formed at a boundary between the operation tube and the appearing and disappearing part; an operation button which is installed at the handle and is elastically supported by the spring, and an auxiliary button which presses by means of the pressing piece integrally formed at the operation button; engaging protrusions which are formed at the operation button and the auxiliary button in the direction of the spring, and an ascending and descending prevention protrusion and a support protrusion which are formed opposite to the engaging protrusion of the operation button and at the upper side of the pressing piece; a guide surface which is upwardly inclined at the engaging protrusion of the operation button and a guide surface which is downwardly inclined at the engaging protrusion of the operation button; an engaging hole which is short formed at an upper side of the inner tube so that the engaging protrusions formed at the operation button and the auxiliary button are selectively secured, an operation hole which is downwardly long formed at its lower side, an operation hole which is long formed at an upper side of the appearing and disappearing part while overlapping with the same, and an engaging hole which is short formed at its lower side; an operation hole which is formed at an inner side of the handle of the outer tube, with the engaging protrusions, the ascending and descending prevention protrusions and the support protrusion entering the operation hole; and a stopper hole of an upper side of the appearing and disappearing part elongated so that the support protrusion can be inserted when the operation button is pressed, with the stopper hole being overlapped with the engaging hole and the operation hole of the appearing and disappearing part so that the ascending and descending prevention protrusion and the support protrusion formed at the operation button and the pressing piece can be selectively engaged, with the stopper hole being overlapped with the engaging hole and the operation hole formed at the stopper hole formed at a lower side of the appearing and disappearing part, which is sized small so that the support protrusion is not inserted when the operation button is pressed, and the inner tube.

Ninth, there are further provided a cover which seals a lower side of the space which is downwardly open toward an inner side of the handle; and a second auxiliary coil spring which is built in the space and is positioned between the cover and the support tube formed at a lower side of the inner tube.

Tenth, there are further provided a space which is formed at an inner side of the handle; a second auxiliary coil spring which is inserted into the space; and an installation hole which is formed above a space at an inner side of the handle, wherein a spring support member is inserted into an outer side of the outer tube, while supporting the second auxiliary coil spring in the installation hole, and an inner insertion hole, of which one side is open, is formed at the spring support member, and a stopper having opposite protrusions is inserted into an outer side of the outer tube in the inner insertion hole, and a hole is formed at a lower side of the inner insertion hole, with the inclined guide surface formed at a lower side of one side of the installation hole being inserted into the hole, and one side of each of the protrusions formed at the stopper forms an inclined surface in an upward and downward direction, with the inclined surface being inserted into an engaging hole formed at the outer tube and a second operation hole formed at the support tube of the inner tube, and the other side of the same forms an upwardly inclined surface, with the upwardly inclined surface being inserted into an operation hole formed at the outer tube and the second engaging hole formed at the support tube of the inner tube.

Eleventh, there are further provided an auxiliary coil spring which is installed between the auxiliary rib fixing member and the main rib fixing member; and a spring housing which is integral with the main rib fixing member so that the auxiliary coil spring is built-in in a state that the umbrella is folded.

Twelfth, the diameter of the engaging part of the main rib secured to the main rib fixing member is larger than the diameter of the engaging part of the auxiliary rib secured to the auxiliary rib fixing member.

ADVANTAGEOUS EFFECTS

The umbrella according to the present invention has a simple structure and can be manufactured at a low cost, and the umbrella easily spreads and folds and has an excellent durability with fewer breakdowns.

The umbrella according to the present invention is characterized in that the diameter of the engaging part to which main ribs are secured is larger than the diameter of the engaging part to which auxiliary ribs are secured, by which it is possible to easily spread and fold the umbrella with small force.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The preferred embodiments of the present invention will be described with reference to the accompanying drawings.

Figure 1:
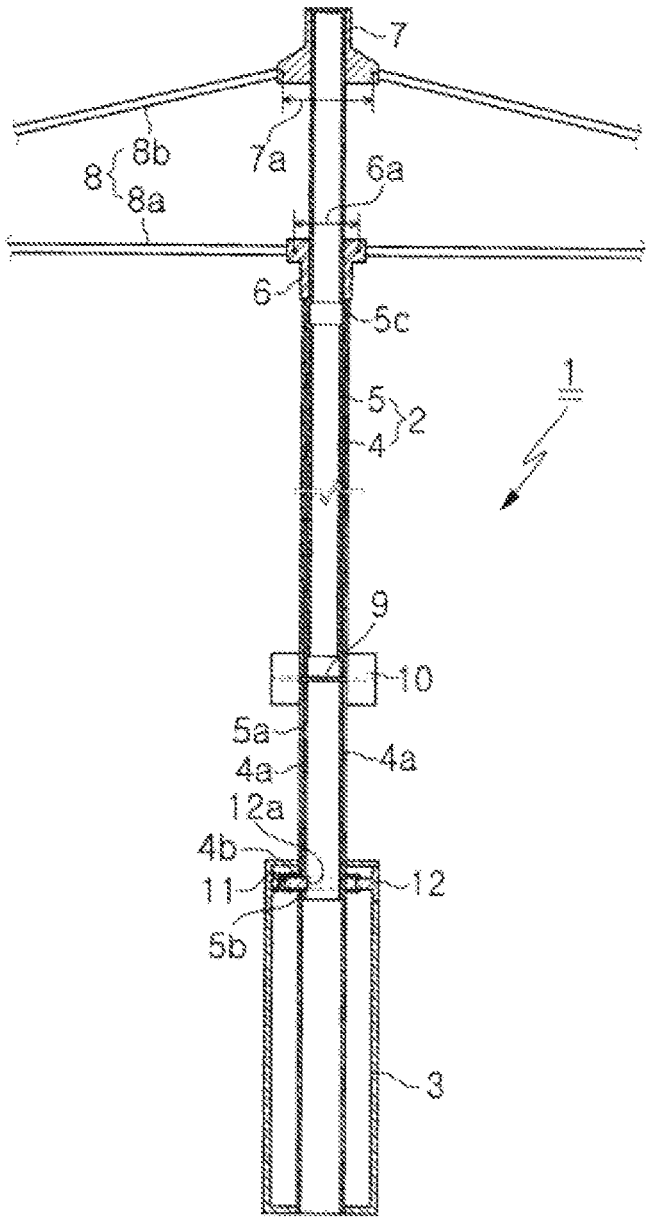
FIG. 1 is a cross sectional view illustrating a state that an umbrella spreads according to a first embodiment of the present invention.
Figure 2:
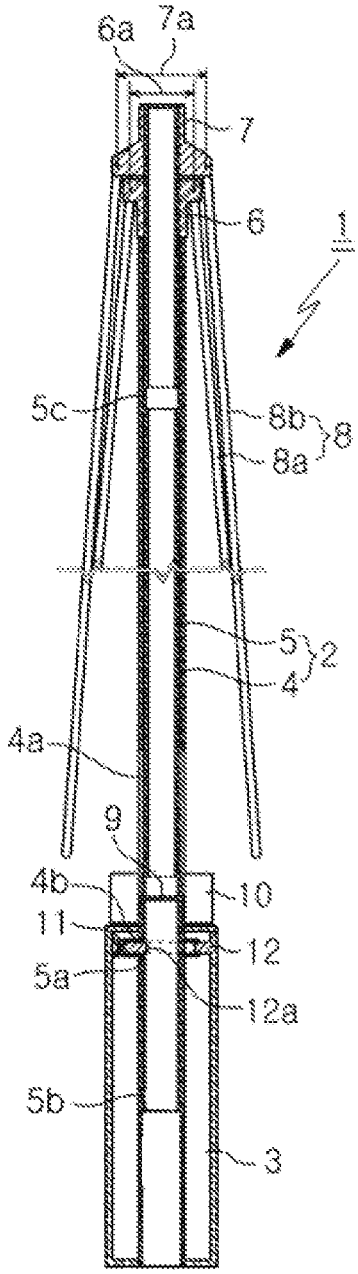
FIG. 2 is a cross sectional view illustrating a state that an umbrella is folded according to a first embodiment of the present invention.
Figure 3:
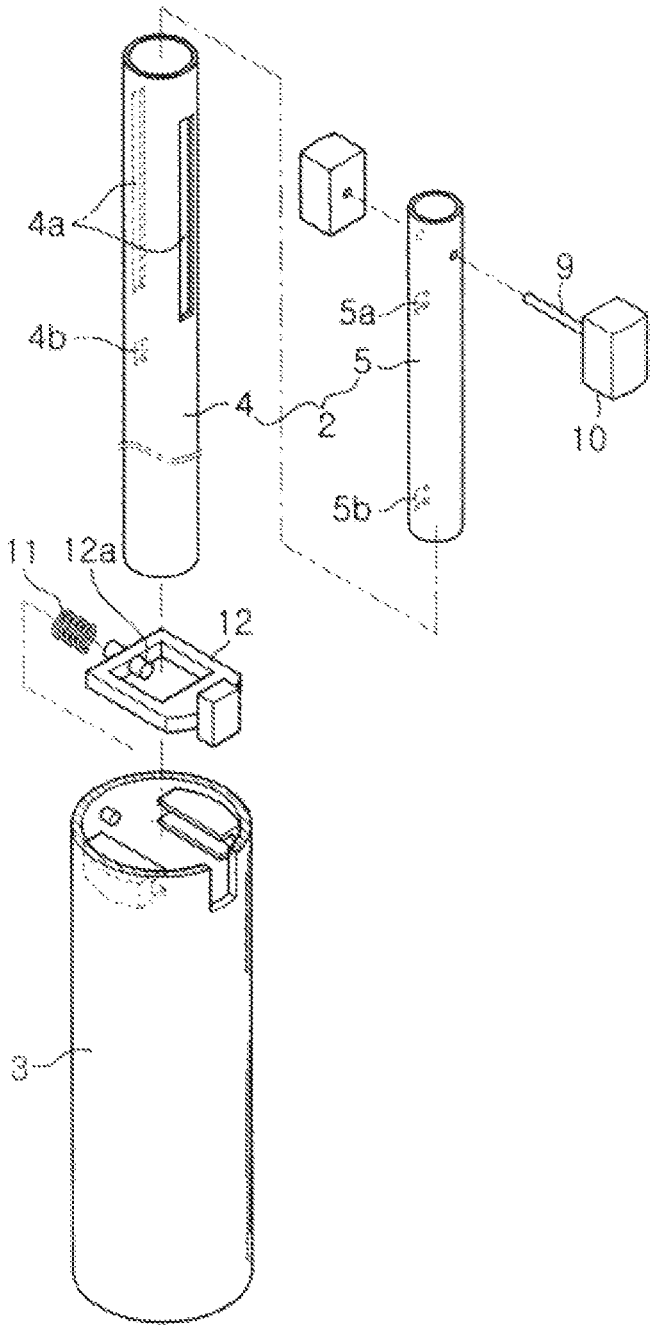
FIG. 3 is a disassembled perspective view of the major elements according to a first embodiment of the present invention.

FIG. 1 is a cross sectional view illustrating a state that an umbrella spreads according to a first embodiment of the present invention, and FIG. 2 is a cross sectional view illustrating a state that an umbrella is folded according to a first embodiment of the present invention, and FIG. 3 is a disassembled perspective view of the major elements according to a first embodiment of the present invention.

The umbrella 1 according to a first embodiment of the present invention has the basic concepts of the second through eighth embodiments which will be described later.

As shown therein, the shank 2 is formed of an outer tube 4 having a handle 3 at its lower end portion, and an inner tube 5 secured to an inner side of the outer tube 4.

The auxiliary rib fixing member 6 and main rib fixing member 7 are installed at the upper end portions of the outer tube 4 and the inner tube 5, respectively. The auxiliary ribs 8*a* and the main ribs 8*b* of the rib assembly 8 are rotatably secured thereto. At this time, the diameter of the engaging part 7*a* which is formed at the main rib fixing member 7 and to which the main ribs 8*b* are secured is larger than the diameter of the engaging part 6*a* which is formed at the auxiliary rib fixing member 6 and to which the auxiliary ribs 8*a* are secured.

The above construction is directed to spreading or folding the umbrella 1 with small force.

When the diameter of the engaging part 7*a* to which the main ribs 8*b* are secured is smaller than or same as the diameter of the engaging part 6*a* to which the auxiliary ribs 8*a* are secured, it is impossible to spread or fold the umbrella 1. As the diameter of the engaging part 7*a* to which the main ribs 8*b* are secured is getting larger and larger, it becomes easier to spread or fold the umbrella, which is the key concepts of the present invention and is company applied to the embodiments which will be described later.

In the outer tube 4, opposite operation holes 4*a* are formed in upward and downward directions at the upper side of the handle 3, and the pin 9 passing through the inner tube 5 is inserted into the operation hole 4*a* and is integrally assembled with the operation handle 10 which ascends and descends along an outer side of the outer tube 4.

The operation hole 4*b* is formed at the lower side of the outer tube 4 positioned at the inner side of the handle 3, and the engaging protrusion 12*a* formed at the operation button 12 installed at the handle 3 is inserted into the operation hole 4*b* while being elastically supported by the spring 11.

The engaging holes 5*a* and 5*b* are formed at the positions matching with the upper dead point and the lower dead point within which the inner tube 5 ascends and descends in the downward direction of the operation handle 10 in the inner tube 5, so the engaging protrusion 12*a* formed at the operation button 12 is selectively secured.

A stopper protrusion 5*c* is formed at an intermediate upper portion of the inner tube 5 for preventing the inner tube 5 from over ascending.

In the method for spreading the umbrella 1 according to a first embodiment of the present invention, the operation button 12 installed at the handle 3 is pressed toward the spring 11 with the umbrella 1 being folded as shown in FIG. 2.

When the operation button 12 is pressed, the engaging protrusion 12*a* formed at the operation button 12 escapes from the upper engaging hole 5*a* of the inner tube 5. At this time, when the operation handle 10 is slightly moved toward holding the same with hands, the inner tube 5 ascends for thereby spreading the umbrella 1. The operation button 12 from which the pressing force is removed returns to its original position with the aid of an elastic force of the spring 11, and the engaging protrusion 12*a* is inserted into the engaging hole 5*b* formed at the lower end portion of the inner tube 5, so the umbrella 1 is fixed in a spread form.

When folding the umbrella 1 after use, the operation button 12 installed at the handle 3 is pressed toward the spring 11.

When the operation button 12 is pressed, the engaging protrusion 12*a* escapes from the engaging hole 5*b* of the inner tube 5. At this time, the inner tube 5 of the shank 2 moves downward by means of the tensional force of the umbrella cloth and the rib assembly 8, so the umbrella becomes almost a folded state. When the operation handle 10 is pulled a little downwards with hands, the engaging protrusion 12*a* formed at the operation button 12 is inserted into the engaging hole 5*a* formed at the upper side of the inner tube 5, so the umbrella 1 is fixed being folded.

When the umbrella 1 is formed in the above manner, the operation for spreading and folding the umbrella 1 is performed within the short stroke of the operation handle 10 which ascends and descends along the outer tube 4 near the operation handle 3 which allows the umbrella 1 to spread or be folded. When the diameter of the engaging part 7*a* which is formed at the main rib fixing member 7 and to which the main ribs 8*b* are engaged is made larger than the diameter of the engaging part 6*a* to which the auxiliary ribs 8*a* are engaged, it is possible to spread the umbrella with small force, which leads to a convenient spreading and folding of the umbrella 1.

Figure 4:
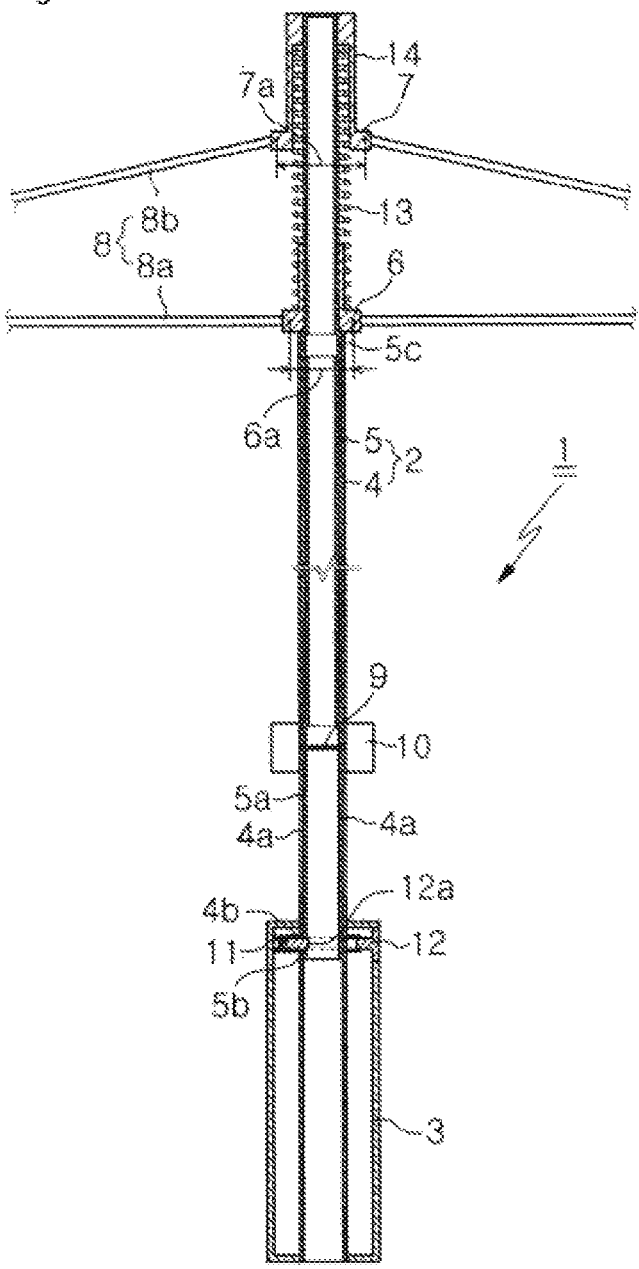
FIG. 4 is a cross sectional view illustrating a state that an umbrella spreads according to a second embodiment of the present invention.
Figure 5:
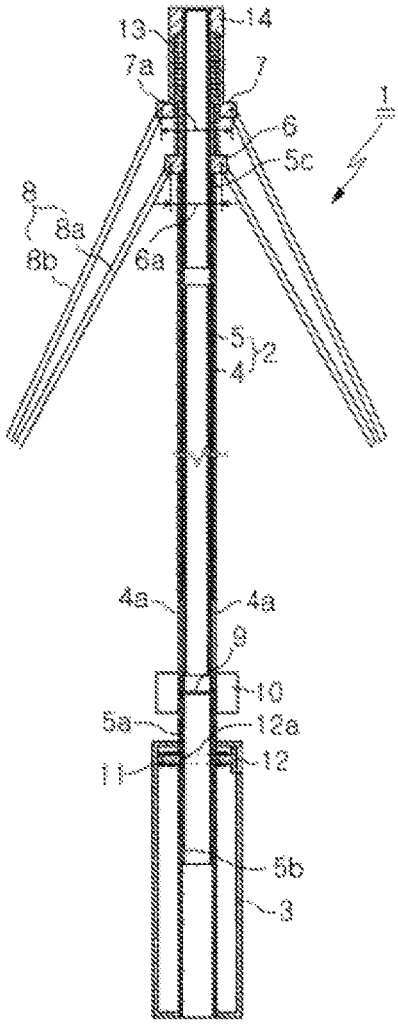
FIG. 5 is a cross sectional view illustrating a state before an umbrella is folded according to a second embodiment of the present invention.
Figure 6:
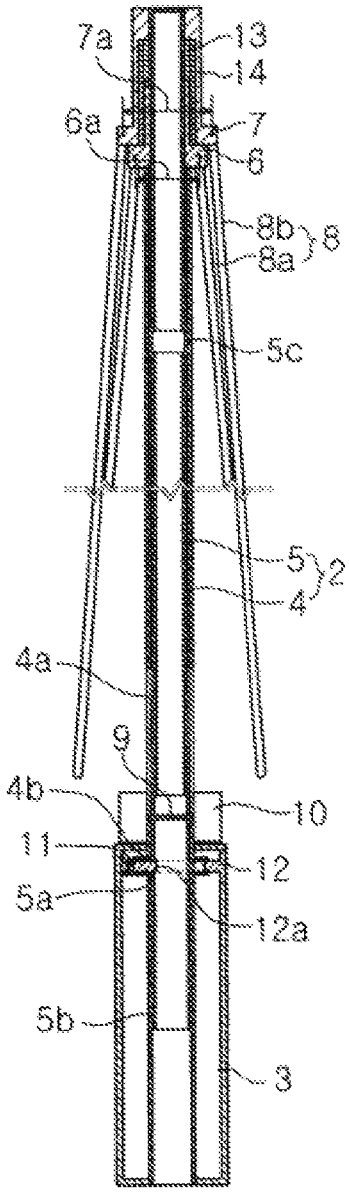
FIG. 6 is a cross sectional view illustrating a state that an umbrella is fully folded according to a second embodiment of the present invention.

FIG. 4 is a cross sectional view illustrating a state that an umbrella spreads according to a second embodiment of the present invention, FIG. 5 is a cross sectional view illustrating a state before an umbrella is folded according to a second embodiment of the present invention, and FIG. 6 is a cross sectional view illustrating a state that an umbrella is fully folded according to a second embodiment of the present invention.

In the second embodiment of the present invention, when the auxiliary rib fixing members 6 and the main rib fixing members 7 are installed at the upper sides of the outer tube 4 and the inner tube 5, and the auxiliary ribs 8*a* and the main ribs 8*b* of the rib assembly 8 are rotatably assembled thereto when configuring the umbrella 1 like the first embodiment, The auxiliary coil spring 13 is disposed between the auxiliary rib fixing member 6 and the main fixing member 7, and the auxiliary coil spring 13 is built in the spring housing 14 integral with the main rib fixing member 7 in a state that the umbrella 1 is folded.

It is preferred that the elastic force of the auxiliary coil spring 13 is to determined to be enough to spread the umbrella 1 by ⅓ to ½. The umbrella 1 can be configured to fully spread the umbrella 1 by increasing the tensional force of the auxiliary coil spring 13. In this case, it is hard to fold the umbrella 1, and the tensional force of the auxiliary coil spring 13 is enhanced so as to fully spread the umbrella 1, but in this case it becomes hard to fold the umbrella, and when the tensional force of the auxiliary coil spring 13 is decreased, the insertion of the auxiliary coil spring 13 becomes useless.

When the present invention is implemented like the second embodiment, when the operation button 12 is pressed so as to spread the umbrella 1 like the first embodiment, the auxiliary coil spring 13 disposed between the auxiliary rib fixing member 6 and the main rib fixing member 7 engaged to the upper sides of the outer tubes 4 and inner tubes 5 is extended, so the tensional force of the umbrella cloth and the self-weight of the rib assembly 8 are balanced, by which the umbrella 1 spreads by ⅓ to ½. When the operation handle 10 is a little moved upwards holding the same with hands, the inner tube 5 moves upwards for thereby pushing upwards the main rib fixing member 7, so the umbrella 1 can spread. At this time, the residual elastic forces of the auxiliary coil spring 13 are applied, so the umbrella 1 can spread by small force.

When the umbrella 1 is supposed to be folded, since the tensional force of the umbrella cloth and the self-weight of the rib assembly 8 and the elastic force of the auxiliary coil spring 13 are balanced, so the umbrella 1 is folded by ⅓ to ½, so when the operation handle 10 is a little pulled downwards by hands, the inner tube 5 moves downwards, and the main rib fixing member 7 is pulled for thereby folding the umbrella 1. At this time, since the self-weight of the rib assembly 8 is applied, it is possible to fold the umbrella with small force 1.

Figure 7:
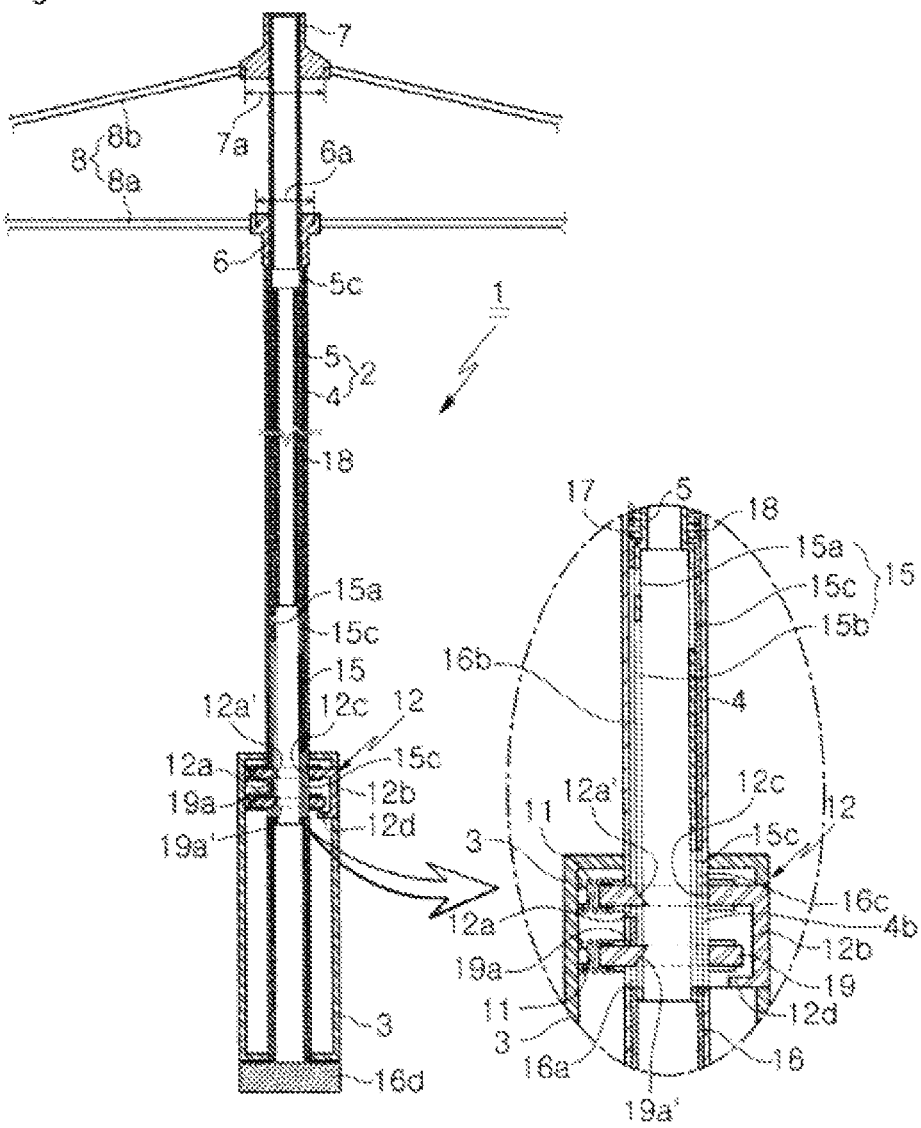
FIG. 7 is a cross sectional view illustrating a state that an umbrella spreads according to a third embodiment of the present invention.
Figure 8:
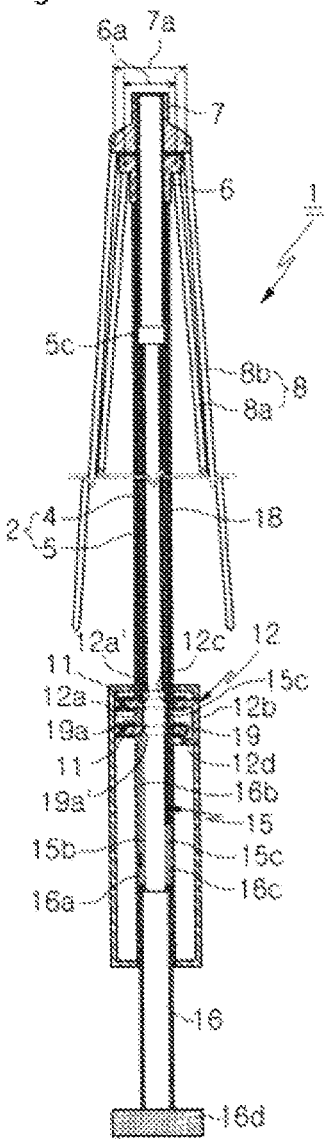
FIG. 8 is a cross sectional view illustrating a state that an umbrella is folded according to a third embodiment of the present invention.
Figure 9:
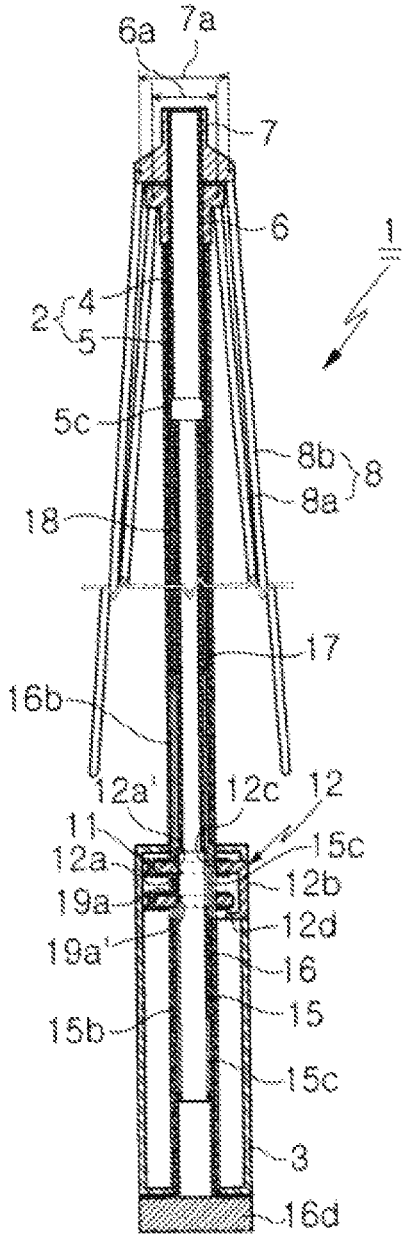
FIG. 9 is a cross sectional view illustrating a state that a coil spring is compressed in a state that an umbrella is fully folded according to a third embodiment of the present invention.
Figure 10:
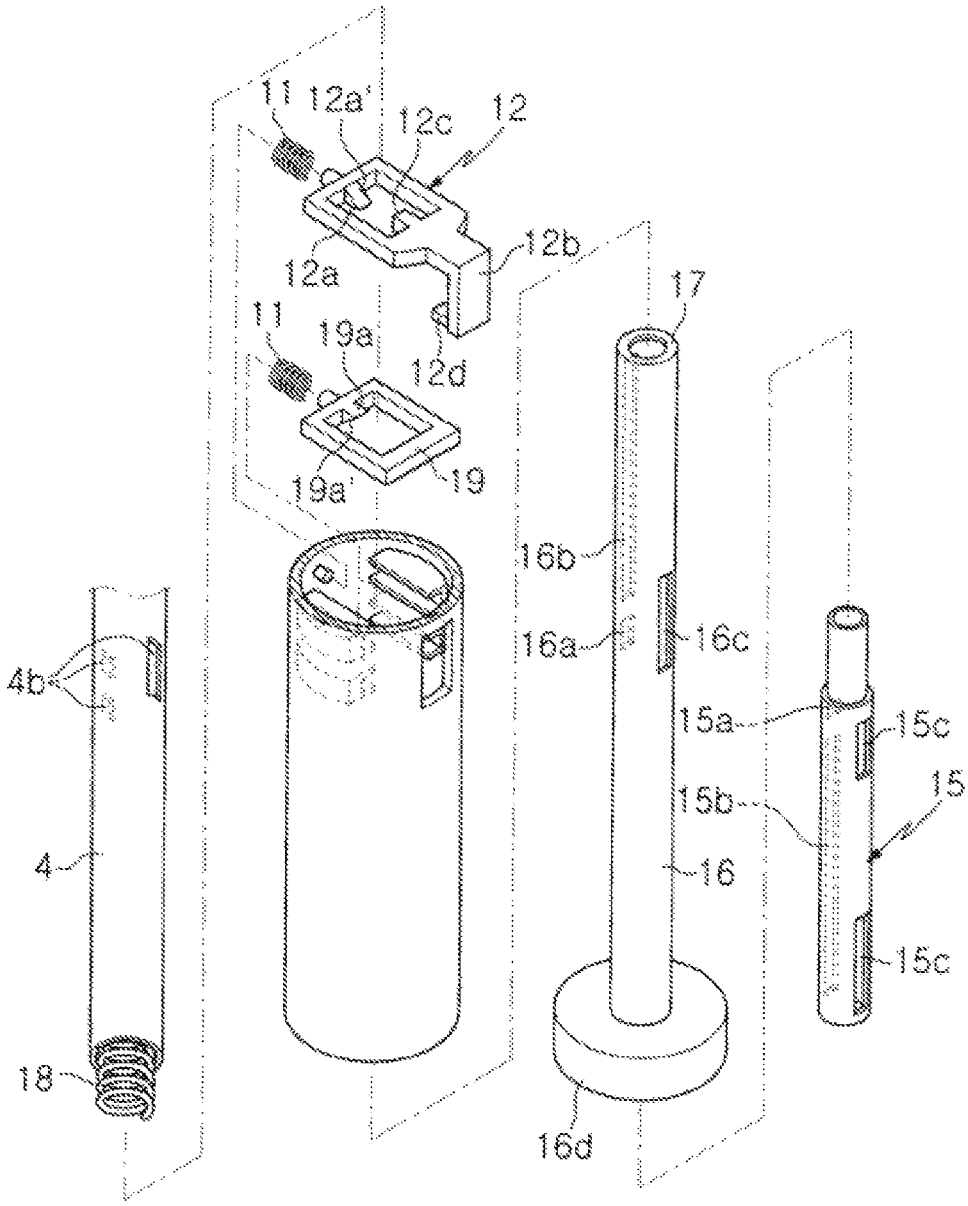
FIG. 10 is a disassembled perspective view of the major elements of a third embodiment of the present invention.

FIG. 7 is a cross sectional view illustrating a state that an umbrella spreads according to a third embodiment of the present invention, FIG. 8 is a cross sectional view illustrating a state that an umbrella is folded according to a third embodiment of the present invention, FIG. 9 is a cross sectional view illustrating a state that a coil spring is compressed in a state that an umbrella is fully folded according to a third embodiment of the present invention, and FIG. 10 is a disassembled perspective view of the major elements of a third embodiment of the present invention.

In the umbrella 1 according to the third embodiment of the present invention, the shank 2 comprises a handle 3 having an outer tube 4 secured to the lower side of the same, and an inner tube 5 secured to an inner side of the outer tube 4.

The auxiliary rib fixing member 6 and the main rib fixing member 7 are installed at the upper sides of the outer tubes 4 and inner tubes 5, and the auxiliary ribs 8*a* and the main ribs 8*b* of the rib assembly 8 are rotatably assembled thereto. At this time, the diameter of the engaging part 7*a* which is formed at the main rib fixing member 7 and to which the main ribs 8*b* are secured is made larger than the diameter of the engaging part 6*a* which is formed at the auxiliary rib fixing member 6 and to which the auxiliary ribs 8*a* secured.

The enlarged tube part 15 is integrally secured to the lower side of the inner tube 5, and the engaging shoulder 17 formed at the upper side is secured by the upper side of the enlarged tube part 15 and secures the spring pressing tube 16 having an integral support shoulder 16*d* at its lower side and appears from or disappears into the lower side of the handle 3, and the coil spring 18 is positioned at an inner side of the outer tube 4 and between the stopper protrusion 5*c* formed at the middle upper portion of the inner tube 5 to be positioned below the auxiliary rib fixing member 6 and the engaging shoulder 17 formed at the upper side of the spring pressing member 16 for thereby being positioned at an inner side of the outer tube 4.

The coil spring 18 is designed to provide an elastic force slightly stronger than the force of spreading the umbrella 1 when extending from the compressed state.

The operation button 12 elastically supported by the spring 11 and the auxiliary button 19 pressed by means of the pressing piece 12*b* supported by the spring 11 and being integral with the operation button 12 are installed at the handle 3, and the engaging protrusions 12*a* and 19*a* are formed at the operation button 12 and the auxiliary button 19, respectively, toward the spring 11. The ascending and descending prevention protrusion 12*c* is formed at the operation button 12 while being opposite to the engaging protrusion 12*a*, and the support protrusion 12*d* are formed at the lower side of the pressing piece 12*b*.

The ascending and descending prevention protrusion 12*c* formed at the opposite sides of the engaging protrusions 12*a* and 19*a* are inserted into the upper and lower stopper holes 15*c*, which will be described layer, before the operation button 12 presses the auxiliary button 19 in a state that the operation button 12 is pressed. When the support protrusion 12*d* formed at the lower side of the pressing piece 12*b* presses the operation button 12 in a state that the umbrella 1 is folded, and when the support protrusion 12*d* formed at a lower side of the pressing piece 12*b* presses the operation button 12 in a state that the umbrella 1 is folded, the support protrusion 12*d* is not inserted into the upper stopper hole 15*c* of the enlarged tube part 15, and when the auxiliary button 19 is pressed in a state that the umbrella 1 spreads, the support protrusion 12*d* is inserted into the lower side stopper hole 15*c* of the enlarged tube part 15.

The engaging protrusion 12*a* formed at the operation button forms a guide surface 12*a*' which is downwardly inclined, and the engaging protrusion 19*a* formed at the auxiliary button 19 forms a guide surface 19*a*' which is upwardly inclined. When the inclined surfaces 12'*a* and 19*a*' contact with the operation holes 15*b* and 16*b* formed at the enlarged tube part 15 and the spring pressing tube 16, which will be described layer, the operation button 12 and the auxiliary button 19 can naturally move back.

The small engaging hole 15*a* is formed at an upper side of the enlarged tube 15, and the operation button 16*b* is elongated toward its lower side, and the operation hole 16*b* is elongated at the upper side of the spring processing tube 16 unlike the enlarged tube part 15, and the short engaging hole 16*a* is formed at its lower side. The engaging holes 15*a* and 16*a* and the operation holes 15*b* and 16*b* are overlapped with each other, and the engaging protrusions 12*a* and 19*a* formed at the operation button 12 and the auxiliary button 19 are selectively inserted into the engaging holes 15*a* and 16*a* and the operation holes 15*b* and 16*b*.

The stopper holes 15*c* into which the ascending and descending prevention protrusion 12*c* and the support protrusion 12*d* formed at the operation button are formed at the upper and lower sides opposite to the operation hole 15*a* and the engaging hole 15*b* of the enlarged tube part 15, and the stopper hole 16*c* is formed at a lower side of the spring pressing tube 16.

The stopper holes 15*c* formed at the upper side of the enlarged tube part 15 are formed short overlapping with the engaging hole 15*a* and the operation hole 16*b* of the enlarged tube part 15, and the stopper holes 15*c* and 16*c* formed at the lower side of the enlarged tube part 15 and the spring pressing tube 16 have the same diameters sized enough to be overlapped with the operation hole 15*b* formed at the enlarged tube part 15 and the engaging hole 16*a* and the operation hole 16*b* formed at the spring pressing tube 16 and are formed longer than the stopper hole 15*c* formed at the upper side of the enlarged tube part 15.

When spreading the umbrella 1 according to a third embodiment of the present invention, as shown in FIG. 9, the operation button 12 formed at the handle 3 is pressed in a state that the umbrella 1 is folded.

When the operation button 12 is pressed, the ascending and descending prevention protrusion 12*c* formed at the operation button 12 is inserted into the stopper hole 15*c* formed at the upper side of the enlarged tube part 15 via the stopper hole 16*c* formed at the spring pressing tube 16, and the engaging protrusion 12*a* inserted in the engaging hole 15*a* of the enlarged tube part 15 is moved to the operation hole 16*b* formed a the spring pressing tube 16, so the coil spring 18 pushes the inner tube 5.

At this time, the support protrusion 12*d* formed at the operation button 12 remains contacted with the outer surface of the enlarged tube part 15, so it does not come into contact with the auxiliary button 19 which is inserted in the engaging hole 16*a* formed at the lower side of the spring pressing tube 16 and keeps fixing the spring pressing tube 15. As long as the operation button 12 is kept pressed, the umbrella 1 does not spread.

When the operation button 12 remains pressed, the ascending and descending prevention protrusion 12*c* formed at the operation button 12 holds an ascending of the inner tube 5 while being caught by the lower side of the stopper hole 15*c* formed at the upper side of the enlarged part 15, and the engaging protrusion 12*a* moved to the operation hole 16*b* formed at the spring pressing tube 16 is positioned at an outer side of the operation hole 15*b* formed at the enlarged tube part 15.

When the operation button 12 is pressed, and then the pressing force is removed, the operation button 12 moves backwards by means of an elastic force of the spring 11, and the ascending and descending prevention protrusion 12*c* escapes from the stopper hole 15*c* formed at the upper side of the enlarged tube part 15 and is inserted into the inner side of the operation hole 15*b* formed at the enlarged tube part 15. At this time, the coil spring 18, which remains compressed, upwardly pushes the inner tube 15 for thereby spreading the umbrella 2.

When the umbrella 2 is spread, since the inner tube 5 remains upwardly moved, the stopper hole 15*c* formed at the lower side of the enlarged tube part 15 and the stopper hole 16 formed at the spring pressing tube 16 are matched with each other, and the support protrusion 12*d* formed at the lower side of the pressing piece 12*b* of the operation button remains ready to be inserted into the stopper holes 15*c* and 16*c*, respectively.

When the umbrella 1 is supposed to be folded after using the umbrella 1, the operation button 12 is just pressed.

When the operation button 12 is pressed, the ascending and descending prevention protrusion 12*c* formed at the operation button 12 is inserted into the stopper hole 15*c* formed at the lower side of the enlarged tube part 15 and the stopper hole 16*c* of the stopper pressing tube 16, respectively, and the support protrusion 12*d* formed at the pressing piece 12*b* is together inserted into the stopper holes 15*c* and 16*c*. At this time, since the pressing piece 12*b* presses the auxiliary button 19, the engaging protrusion 19*a* inserted into the engaging hole 16*a* of the spring pressing tube 16 escapes.

At this time, the spring pressing tube 16 a little moves to the lower side along with the inner tube 5, and the upper sides of the stopper holes 15*c* and 16*c* are caught by the ascending and descending prevention protrusion 12*c* and stop, and the engaging protrusions 12*a* and 19*a* formed at the operation button 12 and the auxiliary button 19 are positioned at the outer side of the operation hole 16*b* formed at the upper side of the spring pressing tube 16. In this state, when a pressing force is removed from the operation button 12, the operation button 12 and the auxiliary button 19 recover their original positions with the aid of the tensional force of the spring 11, and the engaging protrusions 12*a* and 19*a* are inserted into the operation hole 15*b* formed at the enlarged tube part 15 via the operation hole 16*b* formed at the spring pressing tube 16, and the coil spring 18, which remains extended between the engaging shoulder 17 formed at the upper side of the spring pressing tube 16 and the stopper protrusion 5*c* formed at the intermediate upper end portion of the inner tube 5, the spring pressing tube 16 and the inner tube 5 descend altogether by means of the tensional force of the umbrella cloth and the self-weight of the rib assembly 8 without being interfered with the engaging protrusions 12*a* and 19*a*.

When the umbrella 1 is folded, the coil spring 18 does not work. The spring pressing tube 16 descends, but the umbrella 1 does not remain fully folded, in the above state, the spring pressing tube 16 is a little pulled downwards so that the engaging protrusion 12*a* formed at the operation button 12 is inserted into the engaging hole 15*a* formed at the upper side of the enlarged tube part 15 for thereby keeping the umbrella 1 folded.

In the above state, the spring pressing tube 16 is pushed toward the handle 3 in order to spread the umbrella 1 for thereby compressing the coil spring 18.

At this time, the engaging protrusion 19*a* of the auxiliary button 19 is fixedly inserted into the engaging hole 16*a* formed at the lower side of the spring pressing tube 16.

Figure 11:
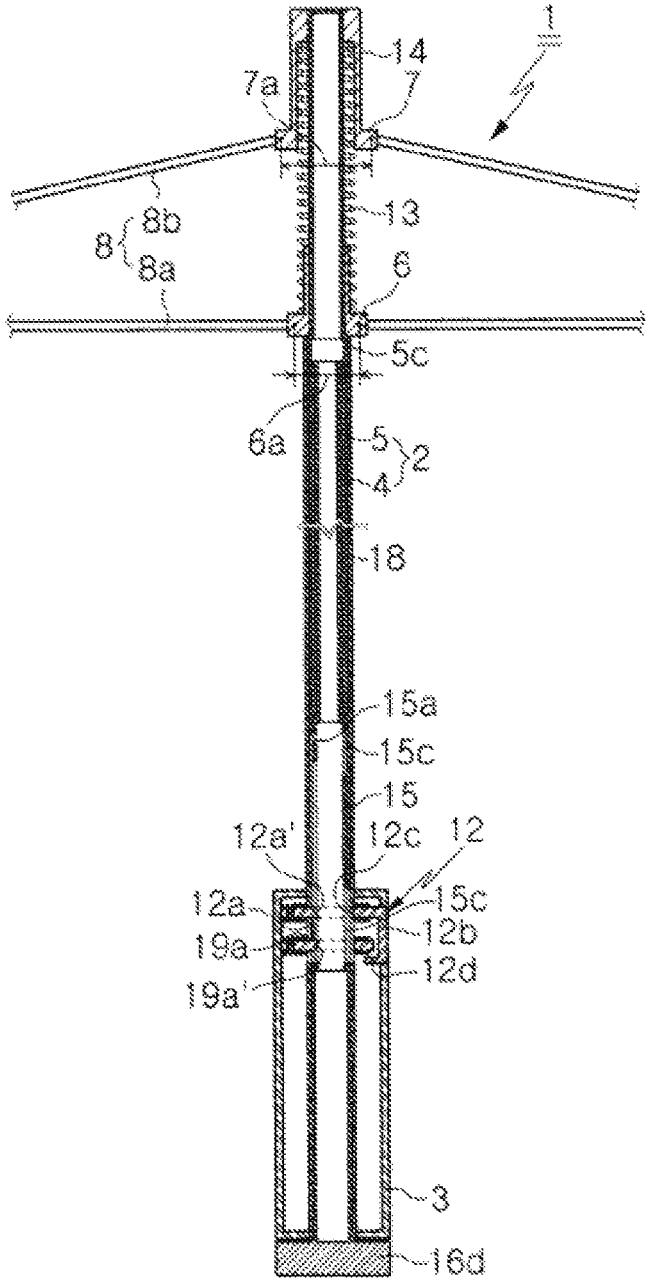
FIG. 11 is a cross sectional view illustrating a state that an umbrella spreads according to a fourth embodiment of the present invention.
Figure 12:
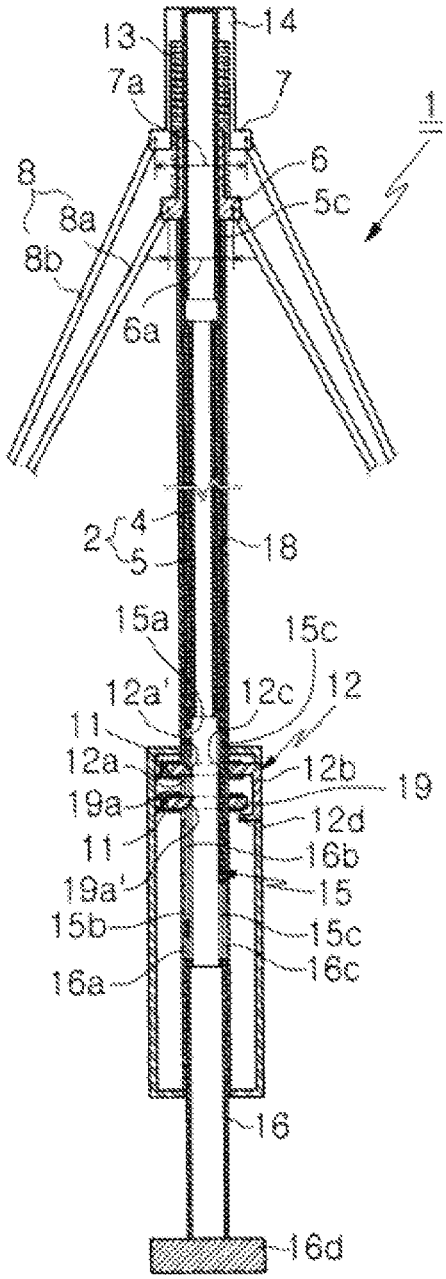
FIG. 12 is a cross sectional view illustrating a state that an umbrella is folded by ⅓ to ½ according to a fourth embodiment of the present invention.
Figure 13:
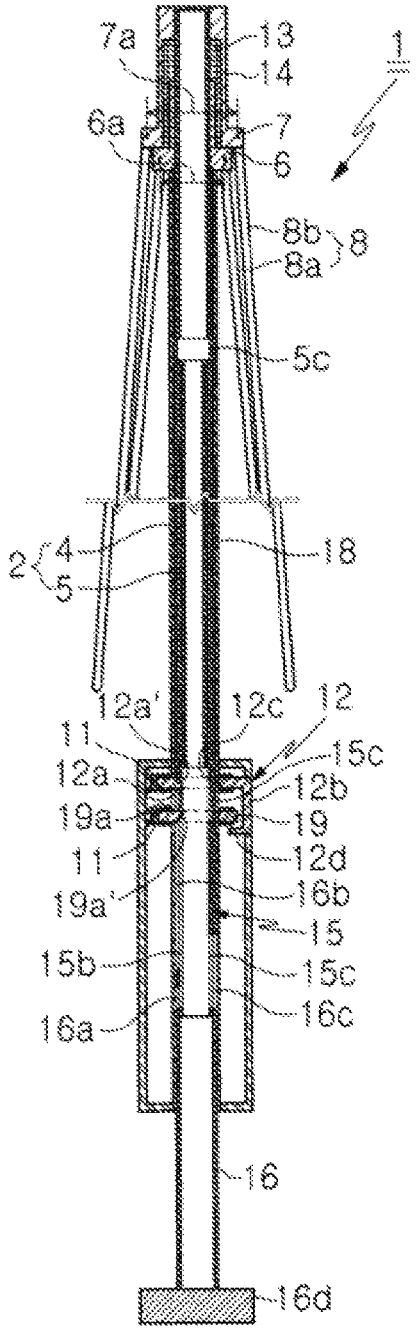
FIG. 13 is a cross sectional view illustrating a state that an umbrella is fully folded according to a fourth embodiment of the present invention.
Figure 14:
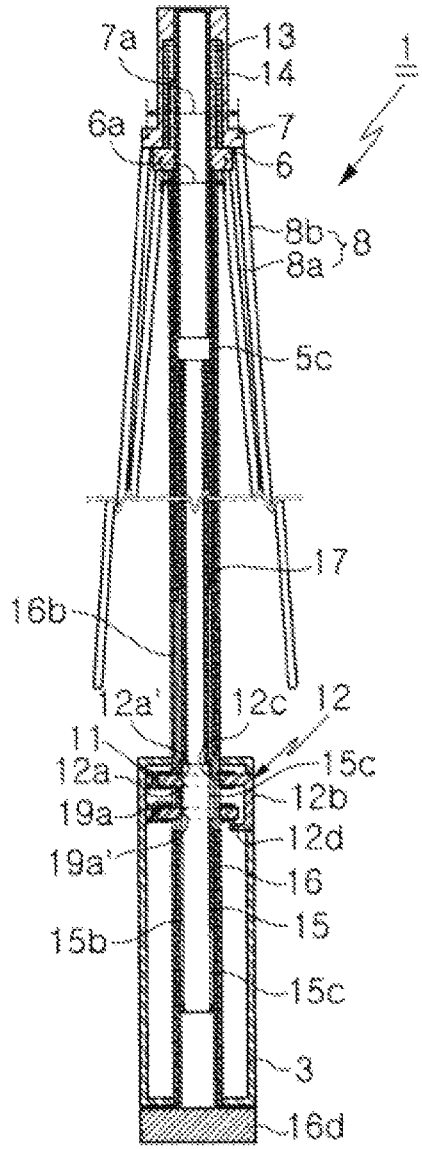
FIG. 14 is a cross sectional view illustrating a state that a coil spring is compressed in a state that an umbrella is fully folded according to a fourth embodiment of the present invention.

FIG. 11 is a cross sectional view illustrating a state that an umbrella spreads according to a fourth embodiment of the present invention, and FIG. 12 is a cross sectional view illustrating a state that an umbrella is folded by ⅓ to ½ according to a fourth embodiment of the present invention, and FIG. 13 is a cross sectional view illustrating a state that an umbrella is fully folded according to a fourth embodiment of the present invention, and FIG. 14 is a cross sectional view illustrating a state that a coil spring is compressed in a state that an umbrella is fully folded according to a fourth embodiment of the present invention.

In the fourth embodiment of the present invention, the umbrella 1 is configured to easily spread in the assembled construction of the umbrella 1 like the third embodiment of the present invention. An auxiliary coil spring 13 is installed between the auxiliary rib fixing member 6 and the main rib fixing member 7, and the coil spring 13 is built in the spring housing 14 integral with the main rib fixing member 7 in a state that the umbrella 1 is folded.

The auxiliary coil spring 13 helps support the elastic force of the coil spring 18 disposed between the stopper protrusion 5*c* formed at the intermediate upper side of the inner tube 5 and the engaging shoulder 17 formed at the upper side of the spring pressing member 16.

When constructing the umbrella 1 like the fourth embodiment of the present invention, the auxiliary coil spring 13 is extended along with the coil spring 18 when spreading the umbrella 1 like the third embodiment of the present invention, so the umbrella 1 can easily spread.

Figure 15:
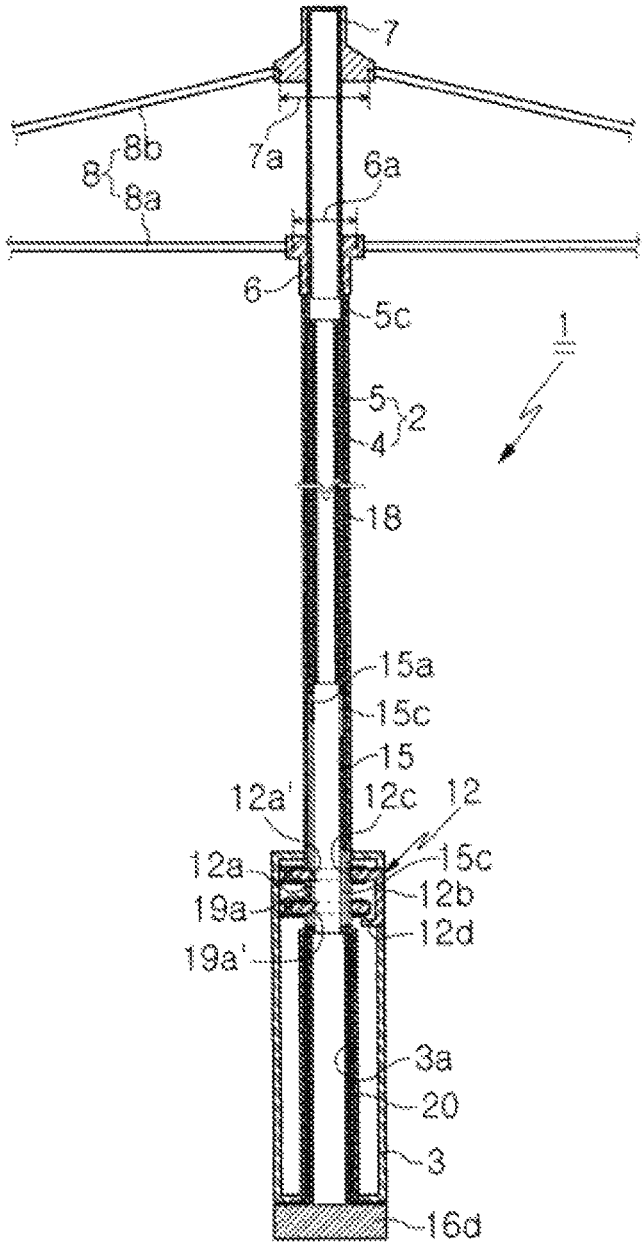
FIG. 15 is a cross sectional view illustrating a state that an umbrella spreads according to a fifth embodiment of the present invention.
Figure 16:
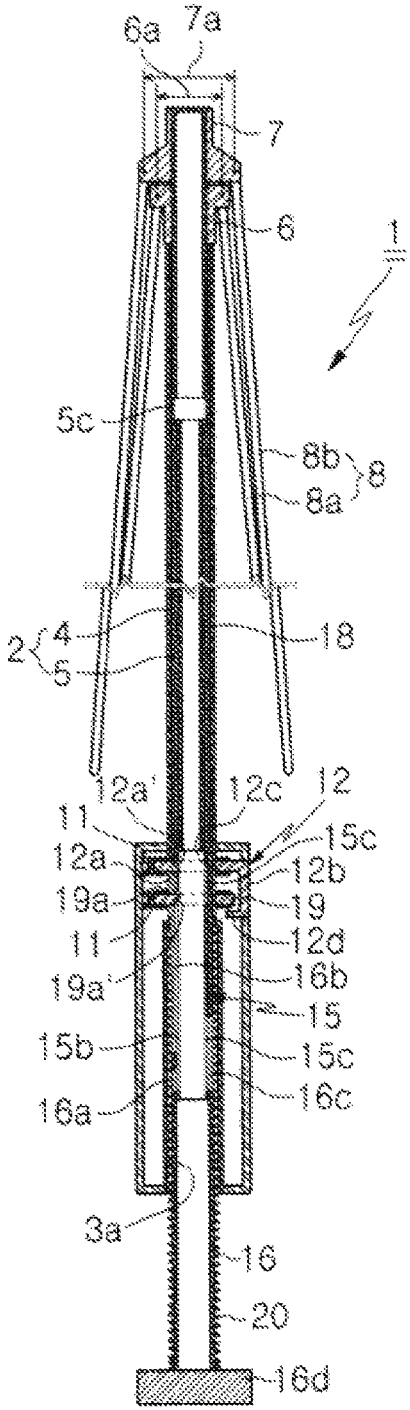
FIG. 16 is a cross sectional view illustrating a state that an umbrella is folded according to a fifth embodiment of the present invention.
Figure 17:
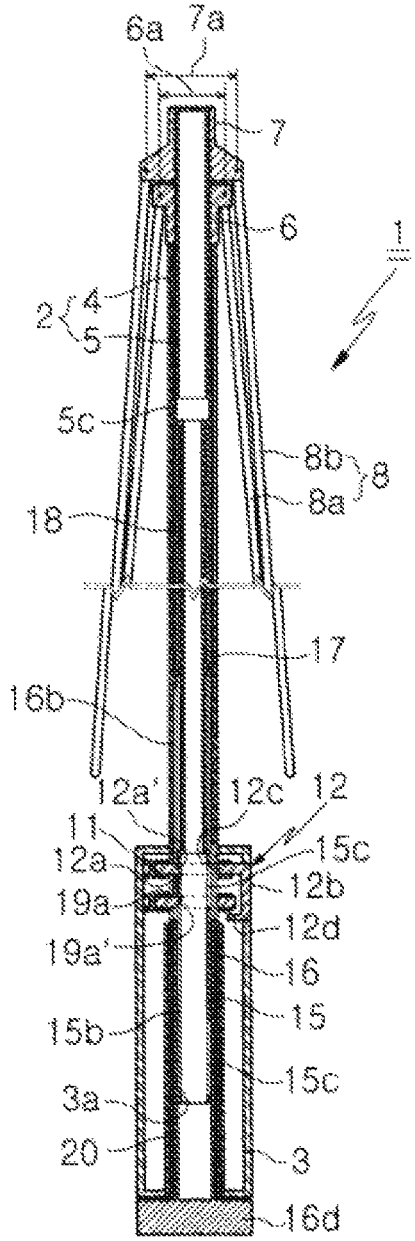
FIG. 17 is a cross sectional view illustrating a state that a coil spring and a second auxiliary coil spring are compressed in a state that an umbrella is fully folded according to a fifth embodiment of the present invention.

FIG. 15 is a cross sectional view illustrating a state that an umbrella spreads according to a fifth embodiment of the present invention, and FIG. 16 is a cross sectional view illustrating a state that an umbrella is folded according to a fifth embodiment of the present invention, and FIG. 17 is a cross sectional view illustrating a state that a coil spring and a second auxiliary coil spring are compressed in a state that an umbrella is fully folded according to a fifth embodiment of the present invention.

The fifth embodiment of the present invention lies in that the umbrella 1 is easily folded when assembling the umbrella 1 like the third embodiment of the present invention. A space 3*a*, which is open in a downward direction, is formed at an inner side of the handle 3, and a second auxiliary coil spring 20 is stalled between the handle 3 and the support shoulder 16*d* formed at a lower side of the spring pressing tube 16 in the space 3*a*.

The second auxiliary coil spring 20 helps easily fold the umbrella 1.

In a state that the umbrella 1 is configured like the third embodiment of the present invention, when the operation button 12 is pressed so as to fold the spread umbrella 1, the ascending and descending prevention protrusion 12*c* formed at the operation button 12 is inserted into the stopper hole 16*c* formed a the stopper hole 15*c* formed at the lower side of the enlarged tube part 15 and the spring pressing tube 16. The support protrusion 12*d* formed at the pressing piece 12*b* is inserted into the stopper holes 15*c* and 16*c*, respectively. At this time, since the pressing piece 12*b* pressed the auxiliary button 19, the engaging protrusion 19*a* inserted in the engaging hole 16*a* of the spring pressing tube 16 escapes.

At this time, the spring pressing tube 16 a little moves downwards along with the inner tube 5, and the upper sides of the stopper holes 15*c* and 16*c* are caught by means of the ascending and descending prevention protrusion 12*c* formed at the operation button 12 and stop, and the engaging protrusions 12*a* and 19*a* formed at the operation button 12 and the auxiliary button 19 is positioned at an outer side of the operation hole 16*b* formed at the upper side of the spring pressing tube 16. In this state, when the pressing force is removed from the operation button 12, the operation button 12 and the auxiliary button 19 return to their original positions by means of the tensional force of the spring 11, and the engaging protrusions 12*a* and 19*a* are inserted respectively into the operation hole 15*b* formed at the enlarged tube part 15 via the operation hole 16*b* formed at the spring pressing tube 16. The coil spring 18 remaining extended between the engaging shoulder 17 formed at the upper side of the spring pressing tube 16 and the stopper protrusion 5*c* formed at the intermediate upper portion of the inner tube 5, the spring pressing tube 16 and the inner tube 5 integrally descend with the aid of the tensional force of the umbrella cloth and the self-weight of the rib assembly 8 without having any interference with the engaging protrusions 12*a* and 19*a*, and the second auxiliary coil spring 20 disposed between the handle 3 and the support shoulder 16*d* formed at the lower end of the spring pressing tube 16 is extended, by which the umbrella 1 is folded, for thereby overcoming the inconvenience occurring when the umbrella 1 is folded according to the third embodiment of the present invention. At this time, the engaging protrusion 12*a* of the operation button 12 is inserted into the engaging hole 15*a* formed at the upper side of the enlarged tube 15 of the inner tube after it downwardly moves along with the inner tube 5, so the umbrella 1 remains folded.

It is needed to compress the coil spring and the second auxiliary coil spring in order to spread or fold the umbrella 1 in a state that the umbrella 1 is folded. The compression of the same can be performed by pressing the spring pressing tube 16.

Namely, when the spring pressing tube 16 is pressed with the other hand in a state that the handle 3 is held by one hand, since the engaging shoulder 17 formed at the upper side of the spring pressing tube 16 is supporting the coil spring 18, and the support shoulder 16*d* formed at the lower side of the spring pressing tube 16 is supporting the second auxiliary coil spring 20, the spring pressing tube 16 ascends while concurrently pressing two springs, and the engaging protrusion 19*a* of the auxiliary button 19 is inserted into and secured to the engaging hole 16*a* of the lower side of the spring pressing tube 16 for thereby fixing the spring pressing tube 16.

Figure 18:
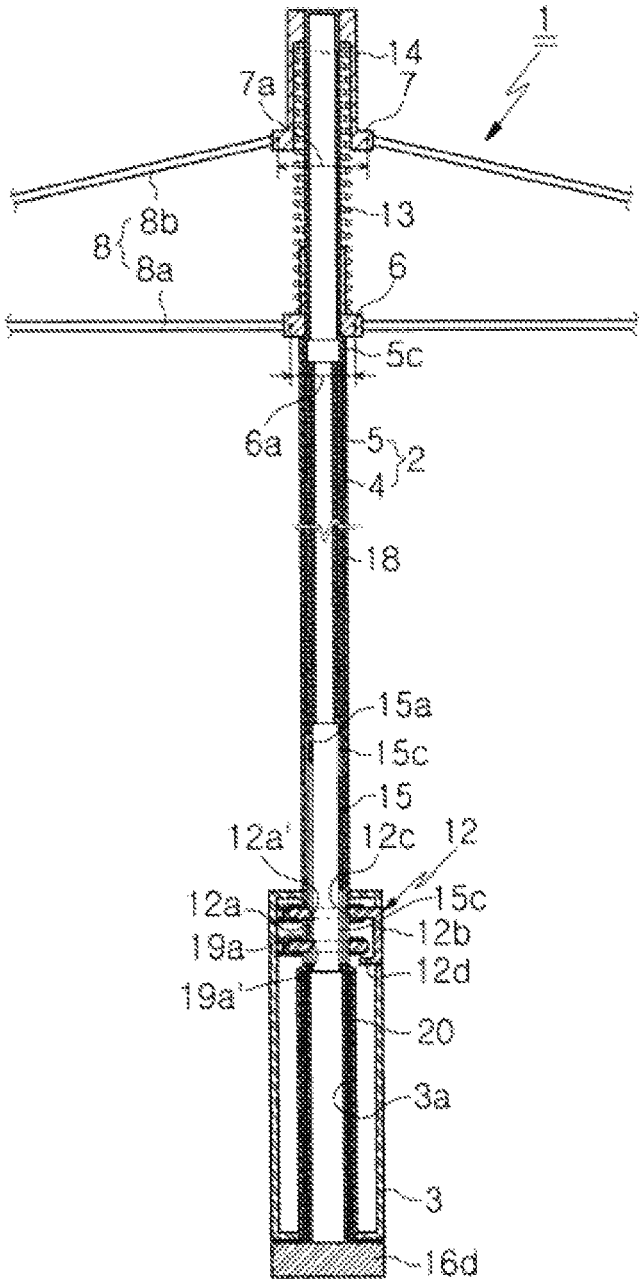
FIG. 18 is a cross sectional view illustrating a state that an umbrella spreads according to a sixth embodiment of the present invention.
Figure 19:
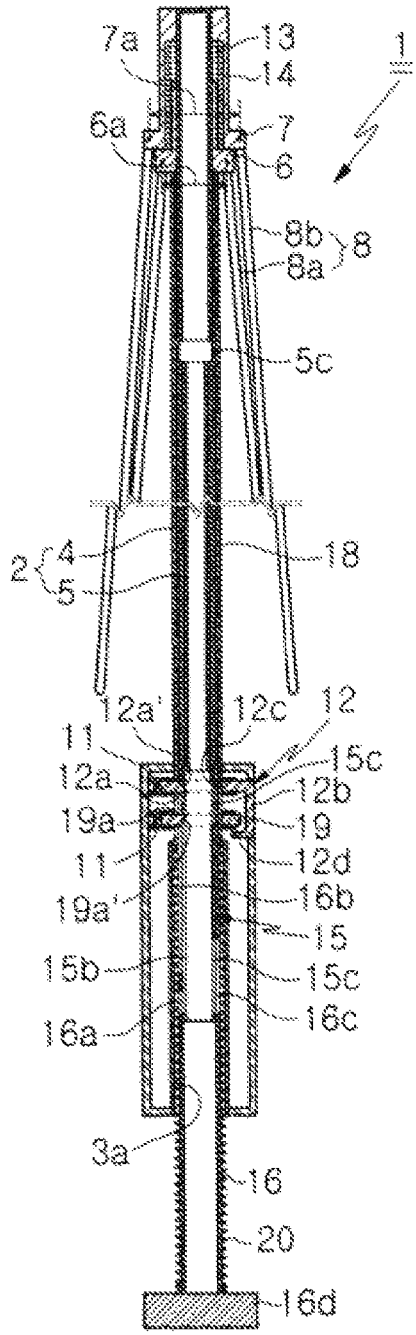
FIG. 19 is a cross sectional view illustrating a state that an umbrella is folded according to a sixth embodiment of the present invention.
Figure 20:
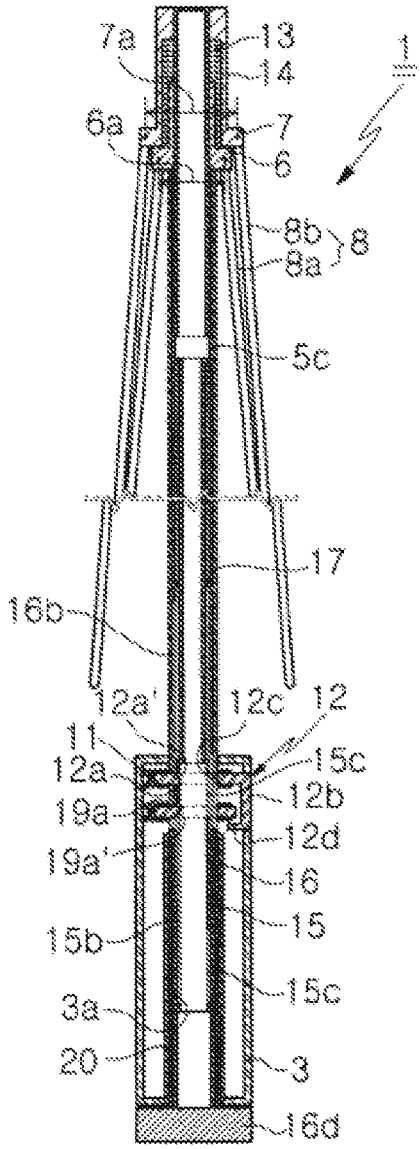
FIG. 20 is a cross sectional view illustrating a state that a coil spring and a second auxiliary coil spring are compressed in a state that an umbrella is fully folded according to a sixth embodiment of the present invention.

FIG. 18 is a cross sectional view illustrating a state that an umbrella spreads according to a sixth embodiment of the present invention, and FIG. 19 is a cross sectional view illustrating a state that an umbrella is folded according to a sixth embodiment of the present invention, and FIG. 20 is a cross sectional view illustrating a state that a coil spring and a second auxiliary coil spring are compressed in a state that an umbrella is fully folded according to a sixth embodiment of the present invention.

The sixth embodiment of the present invention is implemented in combination with the auxiliary coil spring 14 of the third and fourth embodiments and the second auxiliary coil spring 20 of the fifth embodiment of the present invention, by which it is possible to more easily spread and fold the umbrella 1.

As shown therein, when constituting the umbrella 1 like the third embodiment of the present invention, an auxiliary coil spring 13 is installed between the auxiliary rib fixing member 6 and the main rib fixing member 7, and the auxiliary coil spring 13 is built-in in the spring housing 14 integrally formed at the main rib fixing member 7 in a state that the umbrella 1 is folded. A space 3*a*, which is open downwards, is formed at an inner side of the handle 3, and the second auxiliary coil spring 20 is installed between the handle 3 and the support shoulder 16*d* formed at the lower side of the spring pressing tube 16 in the space 3*a*.

When constructing the umbrella 1 like the sixth embodiment of the present invention, the umbrella 1 is designed to fast spread, and when folding the umbrella 1, the umbrella 1 is not fast folded with the aid of a delay operation of the auxiliary coil spring 20, so it is possible to obtain many conveniences during the use like the fourth and fifth embodiments of the present invention.

Figure 21:
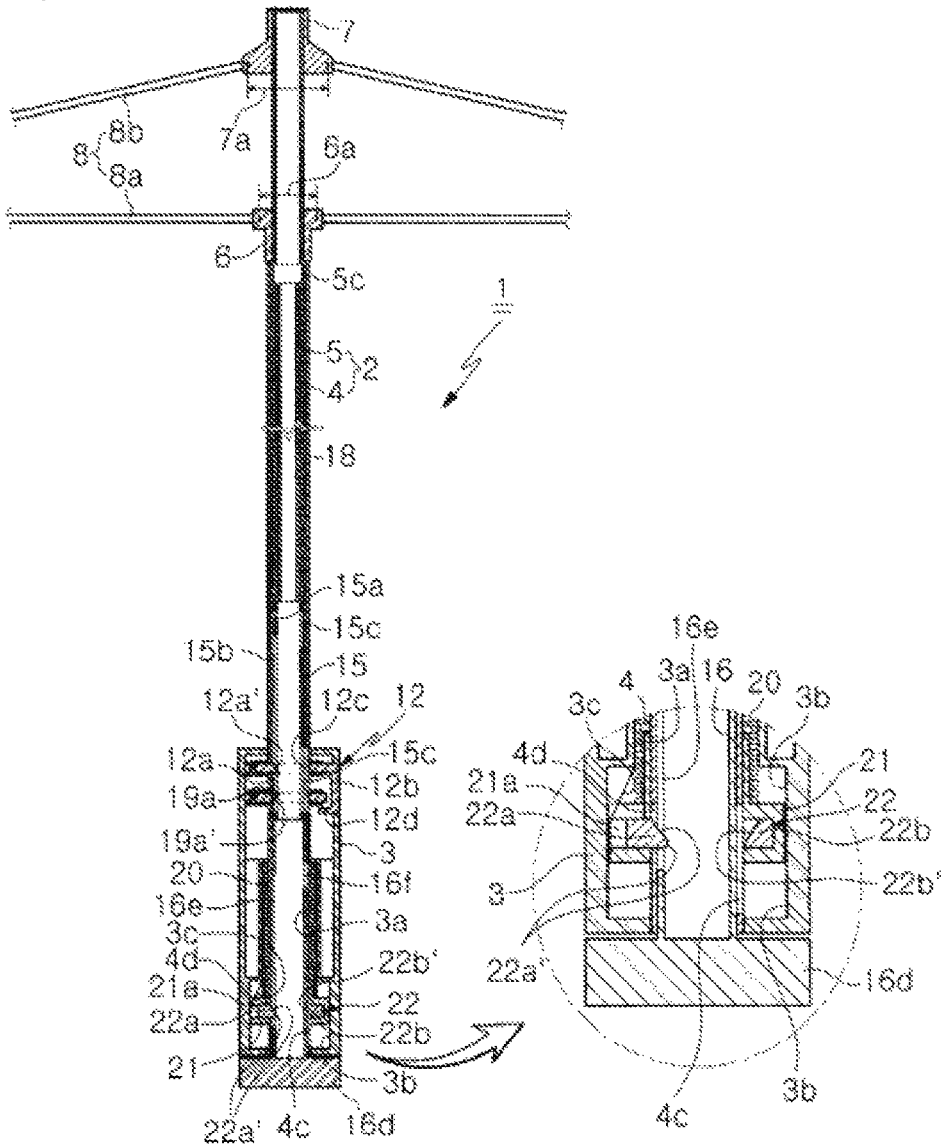
FIG. 21 is a cross sectional view illustrating a state that an umbrella spreads according to a seventh embodiment of the present invention.
Figure 22:
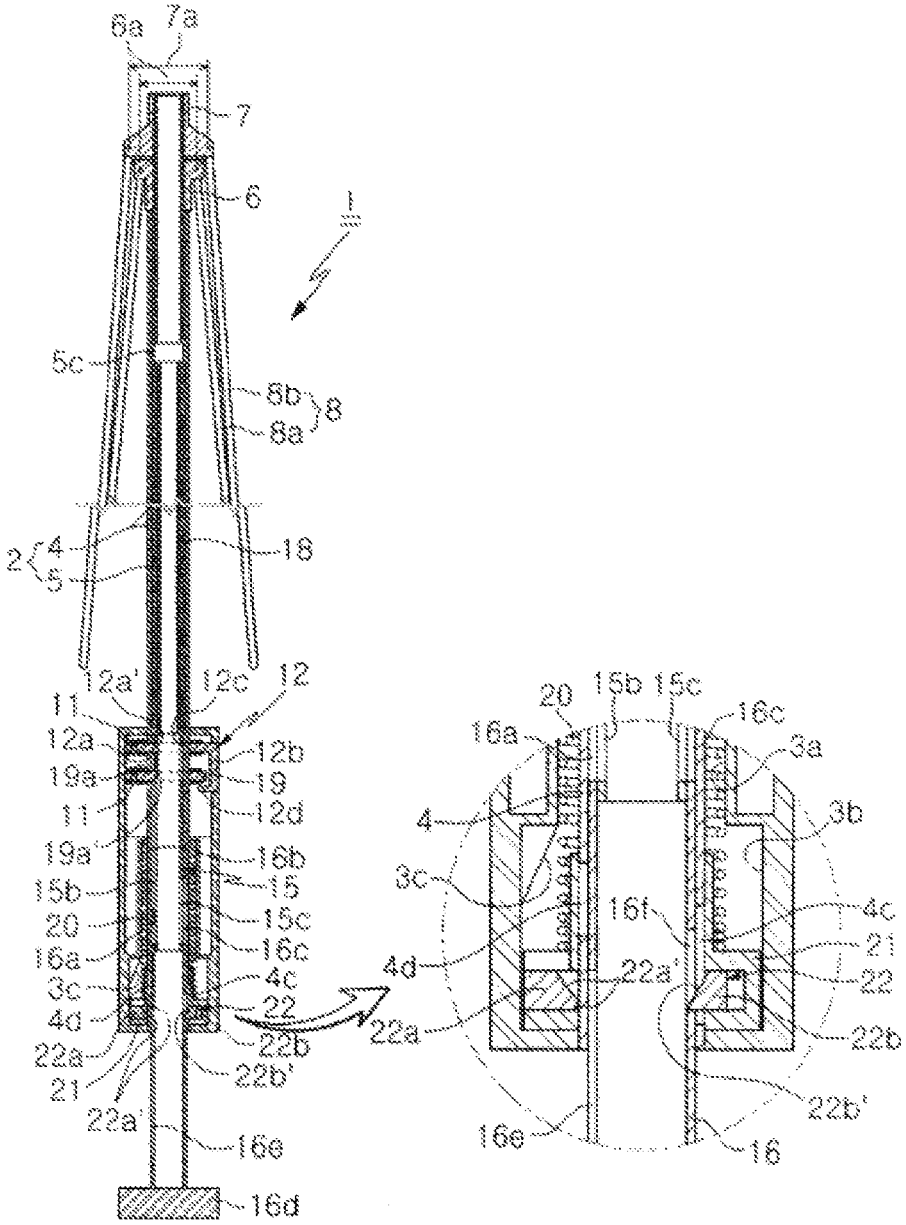
FIG. 22 is a cross sectional view illustrating a state that an umbrella is folded according to a seventh embodiment of the present invention.
Figure 23:
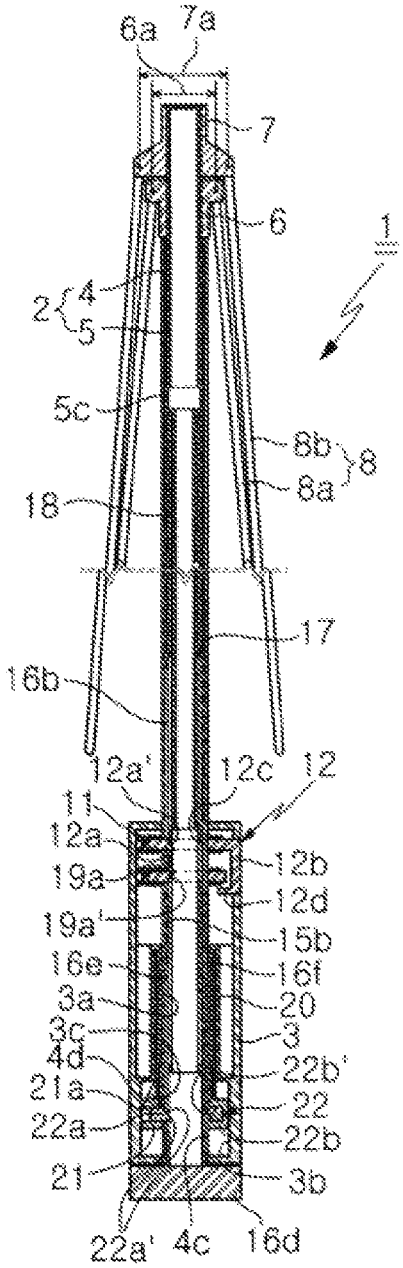
FIG. 23 is a cross sectional view illustrating a state that a coil spring and a second auxiliary coil spring are compressed in a state that an umbrella is folded according to a seventh embodiment of the present invention.
Figure 24:
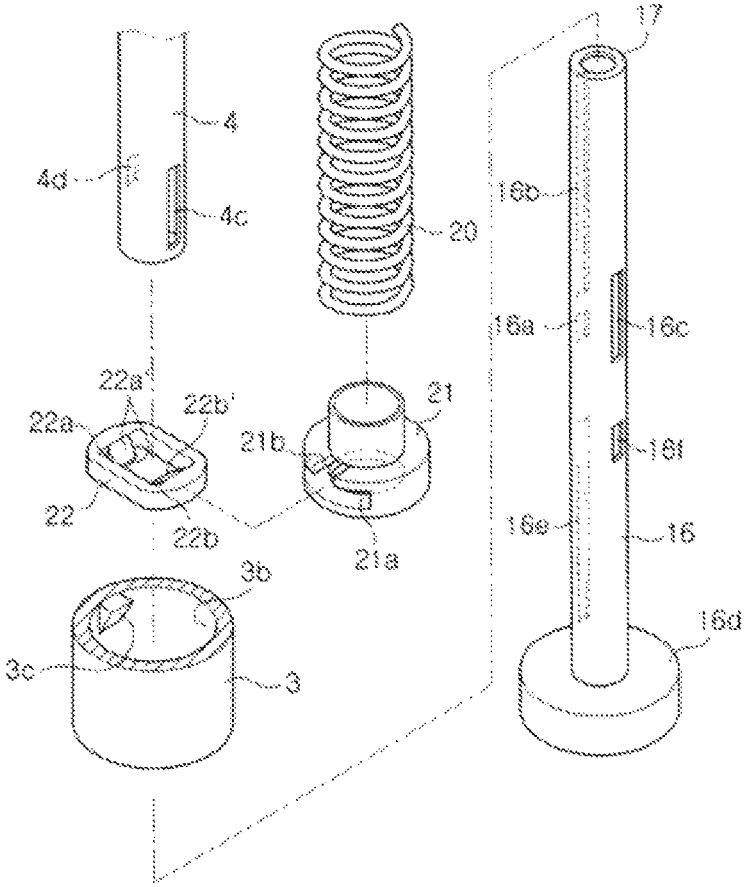
FIG. 24 is an enlarged view of the major elements according to a seventh embodiment of the present invention.

FIG. 21 is a cross sectional view illustrating a state that an umbrella spreads according to a seventh embodiment of the present invention, and FIG. 22 is a cross sectional view illustrating a state that an umbrella is folded according to a seventh embodiment of the present invention, and FIG. 23 is a cross sectional view illustrating a state that a coil spring and a second auxiliary coil spring are compressed in a state that an umbrella is folded according to a seventh embodiment of the present invention, and FIG. 24 is an enlarged view of the major elements according to a seventh embodiment of the present invention.

In the seventh embodiment of the present invention, when constructing the umbrella 1 like the fifth embodiment, the umbrella 1 is designed to be automatically folded. As shown therein, the space 3*a* is formed at an inner side of the handle 3, and the second auxiliary coil spring 20 is adapted. The pressing operation of the second auxiliary coil spring 20 can be effectively performed with the aid of the spring pressing tube 16.

As a means for implementing the above operation, an installation hole 3*b* is formed below the space 3*a* of the inner side of the handle 3 to which the second auxiliary coil spring 20 is secured, and the spring support member 21 is inserted into the outer side of the outer tube 4 in the installation hole 3*b*, and an inner insertion hole 21*a*, of which one side is open, is formed at the spring support member 21, and the stopper 22 having opposite protrusions 22*a* and 22*b* is secured to the inner insertion hole 21*a* while being inserted into an outer side of the outer tube 4, so it is possible to prevent the spring support member 21 from escaping.

One side of each protrusion 22*a*, 22*b* formed at the stopper 22 has a triangle inclined surface 22*a*' in upward and downward directions and the other side of the same has a downwardly inclined surfaced 22*b*'.

A hole 21*b* into which the inclined guide surface 3*c* formed at the upper side of one side of the installation hole 3*b* is formed at the upper side of the inner insertion hole 21*a*. When the spring support member 21 ascends, the inclined guide surface 3*c* pushes the stopper 22 via the hole 21*b* for thereby allowing the stopper 22 to be inserted into the second operation hole 16*e* formed at the spring pressing tube 16 via the engaging hole 4*d* formed at the outer tube 4 while allowing the protrusion 22*b* formed at the stopper 22 to escape from the second engaging hole 16*f* formed at the spring pressing tube 16 for thereby being positioned at an outer side of the operation hole 4*c* formed at the outer tube 4. When the spring pressing tube 16 descends, the upper side of the second operation hole 16*e* formed at the spring pressing tube 16 pushes the inclined surface 22*a*' of the protrusion 22*a* formed at the stopper 22 for thereby moving the stopper 22 while allowing the protrusion 22*a* to escape from the engaging hole 4*d* formed at the outer tube 4 and the protrusion 22*b* formed at the stopper 22 to be inserted into the second engaging hole 16*f* formed at the spring pressing tube 16 via the operation hole 4*c* formed at the outer tube 4.

When the umbrella is supposed to spread in a state that the umbrella 1 made according to the seventh embodiment of the present invention is folded as shown in FIG. 23, the operation button 12 formed at the handle 3 is first pressed, and the umbrella spreads in the way described in the third embodiment of the present invention. The detailed operations thereof are the same as that of the third embodiment.

When it is needed to fold the umbrella 1 after using the umbrella 1, the operation button 12 is pressed.

Namely, when the operation button 12 is pressed, the ascending and descending prevention protrusion 12*c* formed at the operation button 12 and the support protrusion 12*d* formed at the pressing piece 12*b* are inserted into the stopper holes 15*c* and 16*c* formed at the enlarged tube 15 and the spring pressing tube 16. At this time, since the pressing piece 12*b* formed at the operation button 12 presses the auxiliary button 19, the engaging protrusion 19*a* formed at the auxiliary button 19 escapes from the engaging hole 16*a* formed at the spring pressing tube 16.

At this time, the spring pressing tube 16 a little moves downwards, and the upper sides of the stopper holes 15*c* and 16*c* are caught by the ascending and descending prevention protrusion 12*c* formed at the operation button 12 and stop, and the engaging protrusions 12*a* and 19*a* formed at the operation button 12 and the auxiliary button 19 are positioned at an outer side of the operation hole 16*b* formed at the upper side of the spring pressing tube 16. In this state, when the pressing force is removed from the operation button 12, the operation button 12 and the auxiliary button 19 return to their original positions, and the engaging protrusions 12*a* and 19*a* are inserted into the operation hole 15*b* formed at the enlarged tube 15 via the operation hole 16*b* formed at the spring pressing tube 16. The coil spring 18, which is extended and caught between the upper engaging shoulder 17 formed at the spring pressing tube 16 and the stopper protrusion 5*c* formed at the intermediate upper portion of the inner tube 5, the spring pressing tube 16 and the inner tube descend together with the aid of the tensional force of the umbrella cloth and the self-weight of the rib assembly 8 without having any interference with the engaging protrusions 12*a* and 19*a* formed at the operation button 12 and the auxiliary button 19 for thereby folding the umbrella 1.

At this time, when the spring pressing tube 16 is caught by the engaging hole 4*d* formed at the outer tube 4 while ascending, the inclined surface 22*a*' of the protrusion 22*a* formed at the stopper 22 inserted in the second operation hole 16*e* formed at the spring pressing tube 16 comes into contact with the upper side of the operation hole 16*e* formed at the spring pressing tube 16 and is pushed, and the protrusion 22*a* formed at the stopper 22 escapes from the engaging hole 4*d* formed at the outer tube 4 and at the same time, the protrusion 22*b* formed at the stopper 22 is inserted into the second engaging hole 16*f* formed at the spring pressing tube 16 via the operation hole 4*c* formed at the outer tube 4.

The protrusion 22*a* formed at the stopper 22 escapes from the engaging hole 4*d* formed at the outer tube 4, and when the protrusion 22*b* formed at the stopper 22 is inserted into the second engaging hole 16*f* formed at the spring pressing tube 16, the spring pressing tube 16 descends along with the spring support member 21 by means of the elastic force of the second coil spring 20 while pulling the inner tube 5 for thereby fully folding the umbrella which has been almost folded. At this time, the engaging protrusion 12*a* formed at the operation button 12 is fixedly inserted into the engaging hole 15*a* formed at the enlarged tube part 15 formed at the lower side of the inner tube 5. In this state, in order to fold or spread the umbrella 1, it is needed to keep the coil spring 18 and the second auxiliary spring 20 compressed, and the compressions of the same are performed by pressing the spring pressing tube 16. In case of the fifth embodiment of the present invention, since the second auxiliary spring 20 is concurrently compressed by the same stroke as that of the coil spring 18, a lot of force is disadvantageously needed for compression.

In the seventh embodiment of the present invention, as shown in FIG. 22, when the spring pressing tube 16 is compressed, since the protrusion 22*b* formed at the stopper 22 is caught by the lower side of the second engaging hole 16*f* formed at the spring pressing tube 16 via the operation hole 4*c* formed at the outer tube 4, the spring pressing tube 16 ascends together with the spring support member 21, and the coil spring 18 and the second auxiliary spring 20 are compressed. At this time, the inclined guide surface 3*c* formed at the installation hole 3*b* installed at the inner side of the handle 3 is inserted via the hole 21*b* formed at the upper side of the inner insertion hole 21*a* of the spring support member 21, and the stopper 22 is pressed toward the protrusion 22*b* and moves, so the protrusion 22*a* formed at the stopper 22 is inserted into the second operation hole 16*e* formed at the spring pressing tube 16 via the engaging hole 4*d* of the outer tube 4, and the protrusion 22*b* formed at the stopper 22 escapes from the second engaging hole 16*f* and is placed at an outer side of the operation hole 4*c*.

At this time, since there is not contact between the spring pressing tube 16 and the stopper 22, the spring pressing tube 16 is used only for compressing the coil spring 18. At this time, the compressed second auxiliary coil spring 20 is fixedly caught by the lower side of the engaging hole 4*d* of the outer tube 4 by means of the protrusion 22*a* in a compressed state.

In this state, the spring pressing tube 16 ascends while compressing only the coil spring 18. The engaging protrusion 19*a* of the auxiliary button 19 is inserted into the engaging hole 16*a* of the spring pressing tube 16 and is caught, and the spring pressing tube 16 is fixed for thereby finishing the compression of the spring.

The spring pressing tube 16 compresses the second auxiliary coil spring 20 by pressing the same by a short distance, namely, up to the inclined guide surface 3*c* formed at the installation hole 3*b* of the inner side of the handle 3 at the initial stage of operation and fixes to the engaging hole 4*d* of the outer tube 4, and then compresses the coil spring 18, so small force is needed for compressing the spring pressing tube 16 as compared to the fifth embodiment of the present invention.

Figure 25:
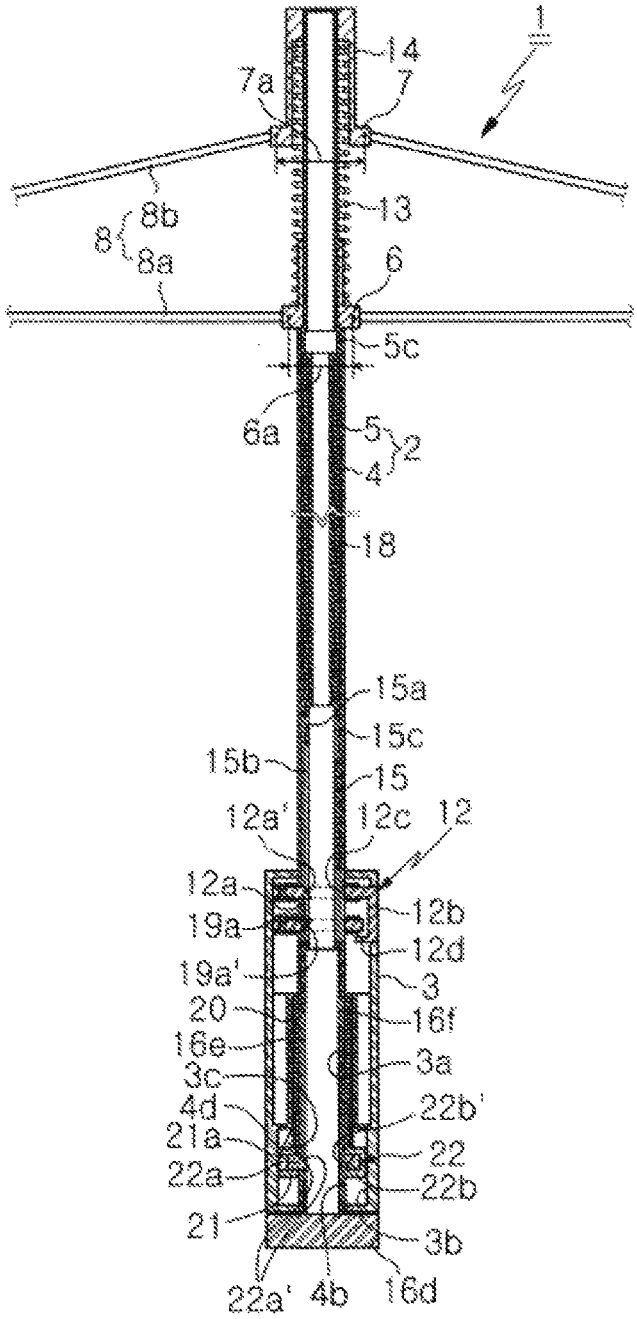
FIG. 25 is a cross sectional view illustrating a state that an umbrella spreads according to an eighth embodiment of the present invention.
Figure 26:
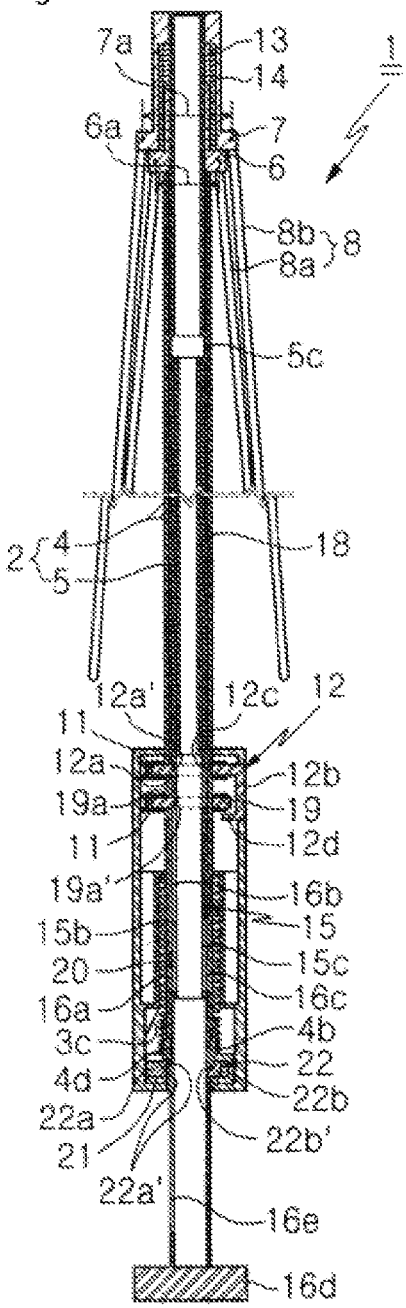
FIG. 26 is a cross sectional view illustrating a state that an umbrella is folded according to an eighth embodiment of the present invention.
Figure 27:
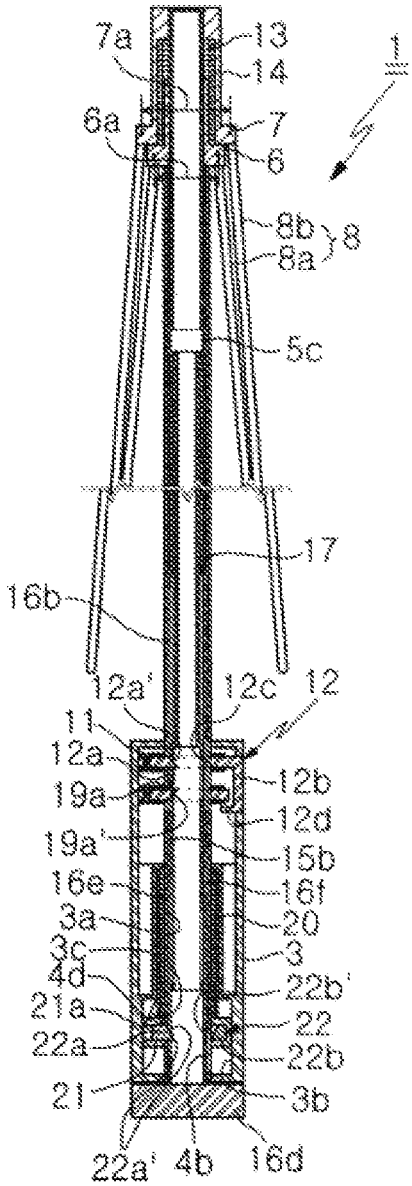
FIG. 27 is a cross sectional view illustrating a state that a coil spring and a second auxiliary spring are compressed in a state that an umbrella is fully folded according to an eighth embodiment of the present invention.

FIG. 25 is a cross sectional view illustrating a state that an umbrella spreads according to an eighth embodiment of the present invention, and FIG. 26 is a cross sectional view illustrating a state that an umbrella is folded according to an eighth embodiment of the present invention, and FIG. 27 is a cross sectional view illustrating a state that a coil spring and a second auxiliary spring are compressed in a state that an umbrella is fully folded according to an eighth embodiment of the present invention.

The eighth embodiment of the present invention is basically directed to easily spreading the umbrella 1 when constructing the umbrella like the seventh embodiment of the present invention. An auxiliary coil spring 13 is installed between the auxiliary rib fixing member 6 and the main rib fixing member 7, and the auxiliary coil spring 13 is built in the spring housing 14 integrally formed at the main rib fixing member 7 in a state that the umbrella 4 is folded.

The auxiliary coil spring 13 is directed to reinforce the elastic force of the coil spring 18 disposed between the stopper protrusion 5*c* formed at the intermediate upper side of the inner tube 5 and the engaging shoulder 17 formed at the upper side of the spring pressing member 16 for thereby helping easily spread the umbrella 1 and has weaker elastic force than that of the second auxiliary coil spring 20.

When constructing the umbrella like the eighth embodiment of the present invention, it is possible to make the umbrella 1 fast spread when the umbrella is supposed to spread, and when folding the same with the aid of the second auxiliary coil spring 20, the umbrella 1 does not too fast spread with the aid of the delay function of the auxiliary coil spring 13, namely, the umbrella is slowly folded.

Figure 28:
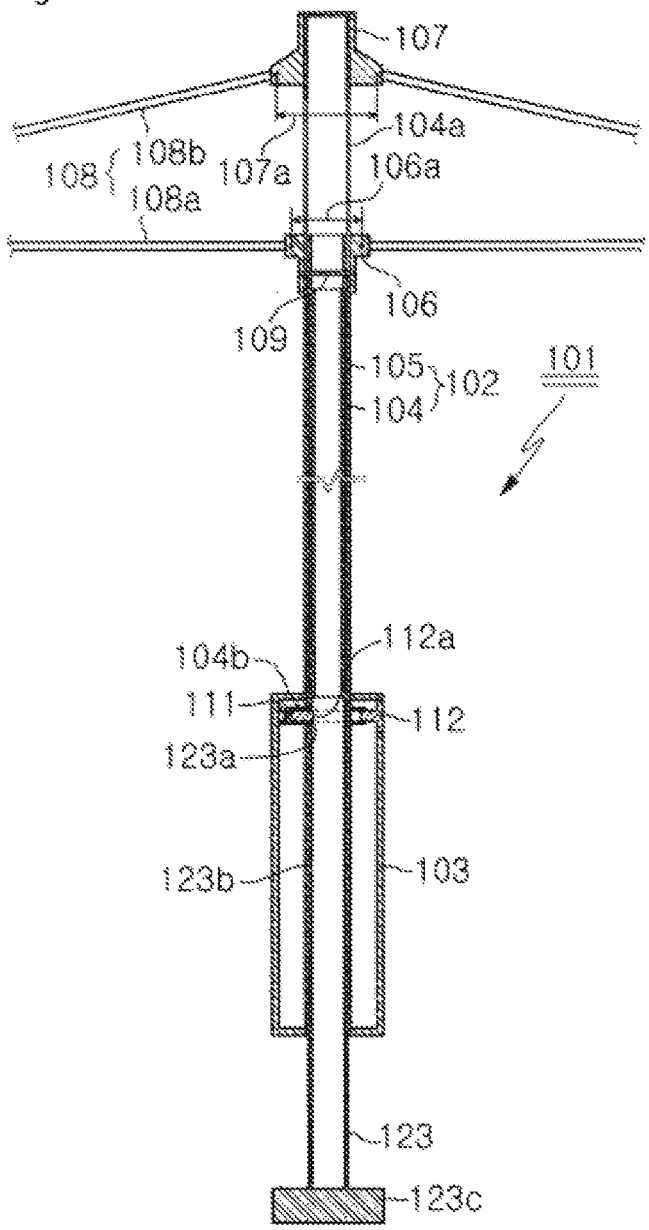
FIG. 28 is a cross sectional view illustrating a state that an umbrella spreads according to a ninth embodiment of the present invention.
Figure 29:
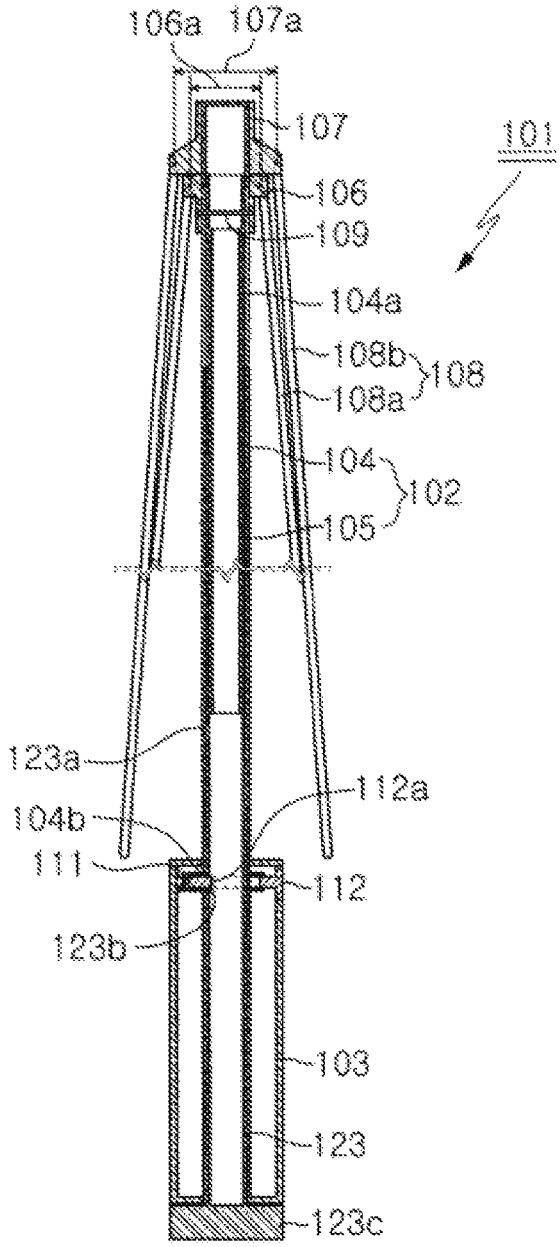
FIG. 29 is a cross sectional view illustrating a state that an umbrella is folded according to a ninth embodiment of the present invention.
Figure 30:
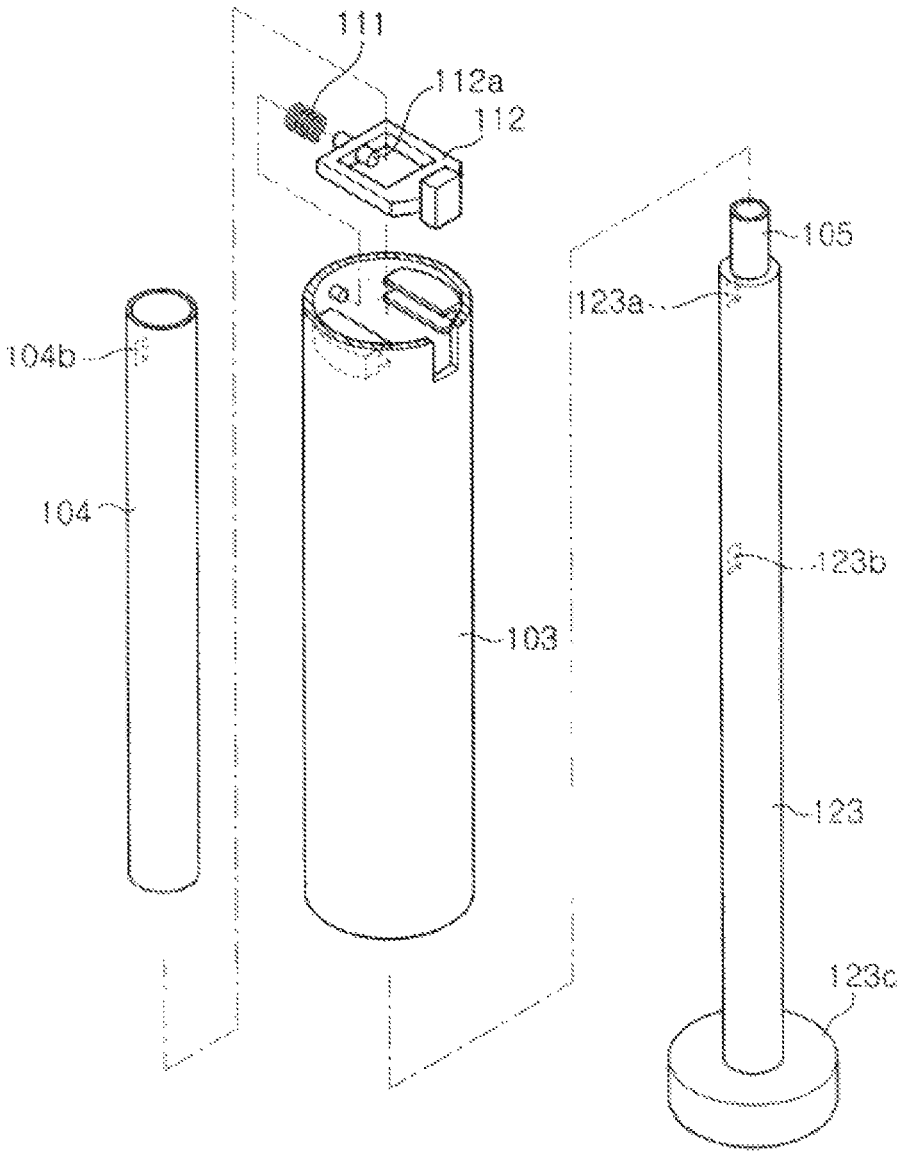
FIG. 30 is a disassembled perspective view illustrating the major elements according to a ninth embodiment of the present invention.

FIG. 28 is a cross sectional view illustrating a state that an umbrella spreads according to a ninth embodiment of the present invention, and FIG. 29 is a cross sectional view illustrating a state that an umbrella is folded according to a ninth embodiment of the present invention, and FIG. 30 is a disassembled perspective view illustrating the major elements according to a ninth embodiment of the present invention.

The umbrella 101 according to the ninth embodiment of the present invention has the basic constructions of the tenth to sixteenth embodiments of the present invention which will be described later.

As shown therein, the shank 102 comprises an outer tube 104 to which a handle 103 is secured to its lower side, and an inner tube 105 secured to an inner side of the outer tube 104.

The main rib engaging member 107 is secured to an upper side of the outer tube 104, and opposite operation holes 104 are elongated in upward and downward directions at the lower side of the main rib fixing member 107.

The pin 109 fixedly inserted into the upper side of the inner tube 105 is secured to the operation hole 104*a*, and an auxiliary rib fixing member 106 is secured to the pin 109 for ascending and descending along the outer tube 104.

The main ribs 108*b* and the auxiliary ribs 108*a* of the rib assembly 108 are rotatably assembled to the main rib fixing member 107 and the auxiliary rib fixing member 106 installed at the upper sides of the outer tube 104 and the inner tube 105. At this time, the diameter of the engaging part 107*a* which is formed at the main rib fixing member 107 installed at the upper side of the outer tube 104 and to which the main ribs 108*b* are secured is larger than the diameter of the engaging part 106*a* which is formed at the auxiliary rib fixing member 106 and to which the auxiliary ribs 108*a* are secured.

The operation hole 104*b* is formed at the lower side of the outer tube 104 positioned at the lower side of the handle 103, and the engaging protrusion 112*a* formed at the operation button 112 installed at the handle 103 is inserted into the operation hole 104*b* while being elastically supported by the spring 111.

The inner tube 105 is configured like an appearing and disappearing part 123 is enlarged in such a manner that the inner tube 105 appears from the inner side of the handle 103 in a state that the umbrella 101 remains spread, and disappears into the inner side of the handle 103 when folding the umbrella, and the engaging holes 123*a* and 123*b* are formed at the appearing and disappearing part 123 for thereby positioning at the upper dead point when the umbrella 101 spreads and the lower dead point when the umbrella 101 is folded, while being caught by the engaging protrusion 112*a* of the operation button 112, and the engaging shoulder 123*c* is formed at the lower side of the appearing and disappearing part 123.

When the umbrella 101 of the ninth embodiment of the present invention is supposed to spread from a state that the umbrella 101 is folded as shown in FIG. 29, the operation button 112 installed at the handle 103 is pressed toward the spring 111 for allowing the engaging protrusion 112*a* of the operation button 112 from separating from the engaging hole 123*b* formed at the lower dead point of the appearing and disappearing part 123.

The engaging shoulder 123*c* of the lower side of the appearing and disappearing part 123 positioned at the lower side of the handle 103 is held with hands in a state that the engaging protrusion 112*a* is separated from the engaging hole 123*b*, and is downwardly pulled, so the auxiliary rib fixing member 106 secured to the upper side of the inner tube 105 by the pin 109 moves downwardly along the operation hole 104*a* formed at the outer tube 104. At this time, the main ribs 108*b* and the auxiliary ribs 108*a* of the rib assembly 108 become spread.

The operation button 112 returns to its original state with the aid of the elastic force of the spring 111 in a state that the umbrella 101 remains spread, and then the engaging protrusion 112*a* is inserted into the engaging hole 123*a* formed at the upper dead point of the appearing and disappearing part 123 for thereby keeping the umbrella 101 spread.

On the contrary, when it is needed to fold the umbrella 101 after it is used in a state that the umbrella 101 keeps spread, the operation button 112 is pressed like the umbrella 101 spreads, the engaging protrusion 112*a* inserted in the engaging hole 123*a* formed at the upper dead point of the appearing and disappearing part 123 escapes from the same.

At this time, the auxiliary rib fixing member 106 secured to the upper side of the inner tube 105 by the pin 109 moves upwards along the operation hole 104*a* formed at the outer tube 104 with the aid of the tensional force of the umbrella cloth and the self-weight of the rib assembly 108, and the main ribs 108*b* and the auxiliary ribs 108*a* of the rib assembly 108 are folded, and in a state that the umbrella 101 is almost folded, the engaging shoulder 123*c* of the appearing and disappearing part 123 being closer to the lower side of the handle 103 is a little pushed upward, and then the operation button 112 returns to its original state with the aid of the elastic force of the spring 111, and the engaging protrusion 112*a* is inserted into the engaging hole 123*b* formed at the lower dead point of the appearing and disappearing part 123, so the umbrella 101 is fixed in a folded state.

When constructing the umbrella 101 in the above way, the operation of spreading and folding the umbrella 101 is performed within a short stroke distance of the appearing and disappearing part 123 which appears and disappears below the handle 103, and the diameter of the engaging part 107*a* which is formed at the main rib fixing member 107 installed at the upper side of the outer tube 104 and to which the main ribs 108*b* are secured is larger than the engaging part 106*a* which is formed at the auxiliary rib fixing member 106 secured to the upper side of the inner tube 105 by the pin 109 and to which the auxiliary ribs 108*a* are secured. With this construction, it is possible to spread the umbrella 101 with small force and it is easy to fold and spread the umbrella 101.

Figure 31:
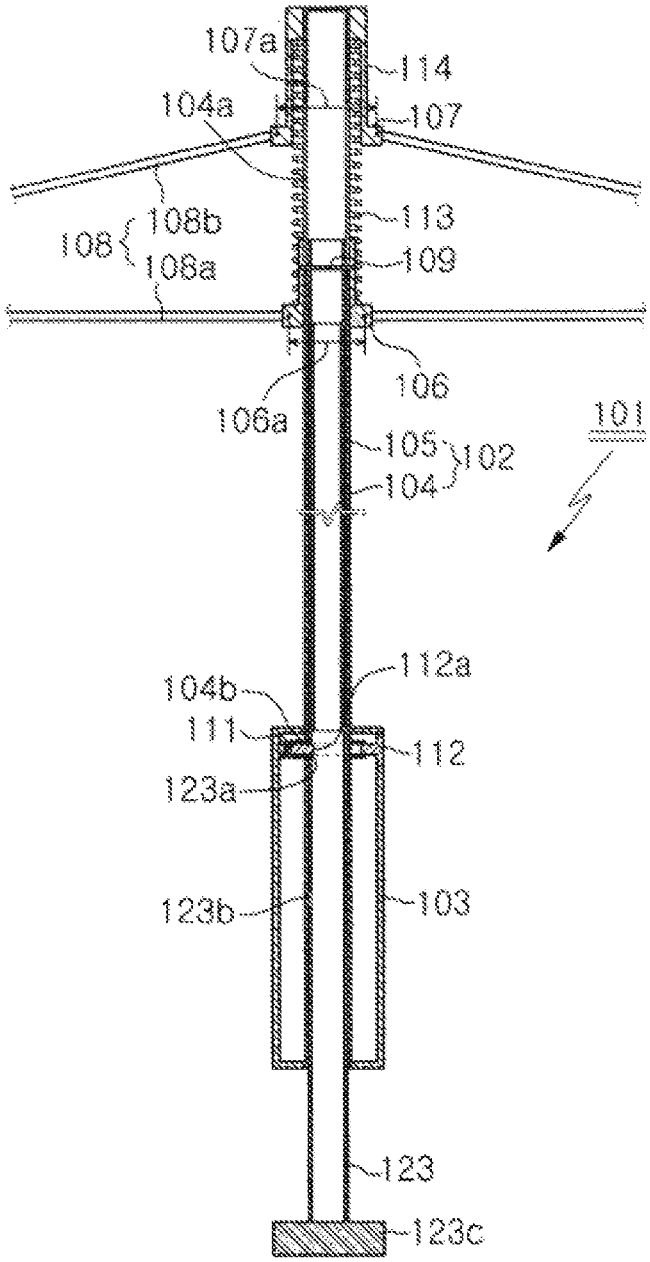
FIG. 31 is a cross sectional view illustrating a state that an umbrella spreads according to a tenth embodiment of the present invention.
Figure 32:
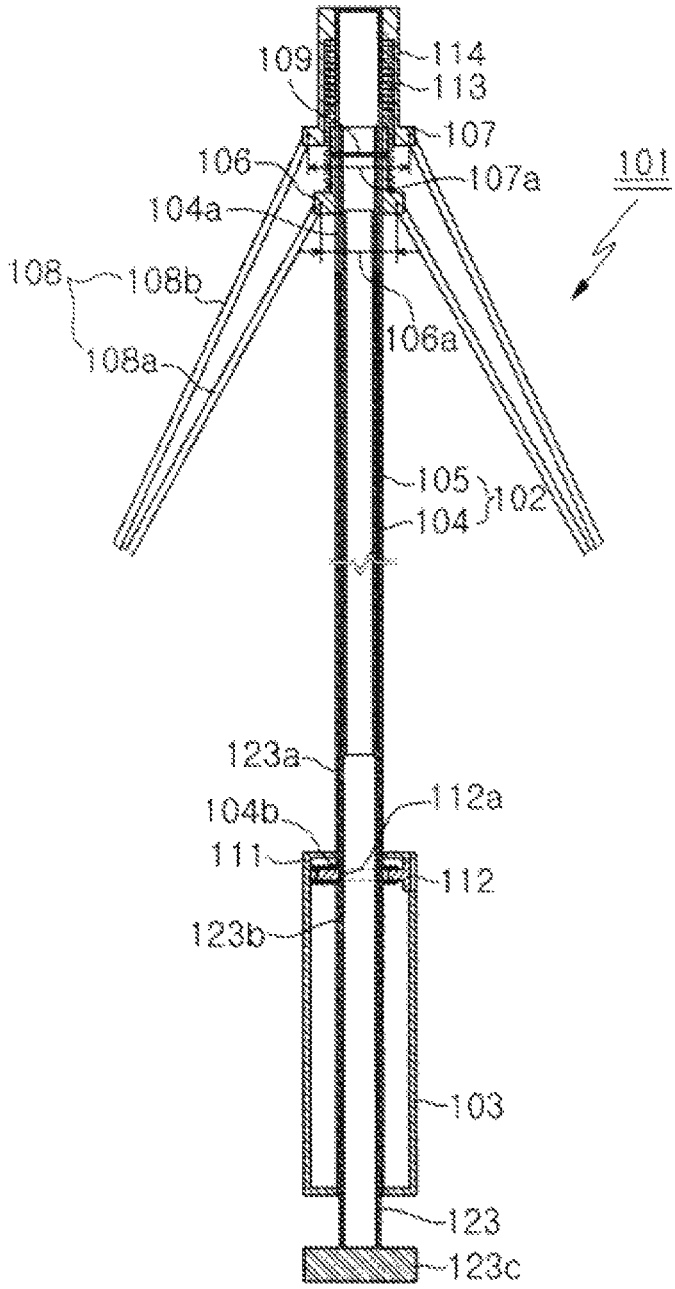
FIG. 32 is a cross sectional view illustrating a state before an umbrella spreads according to a tenth embodiment of the present invention.
Figure 33:
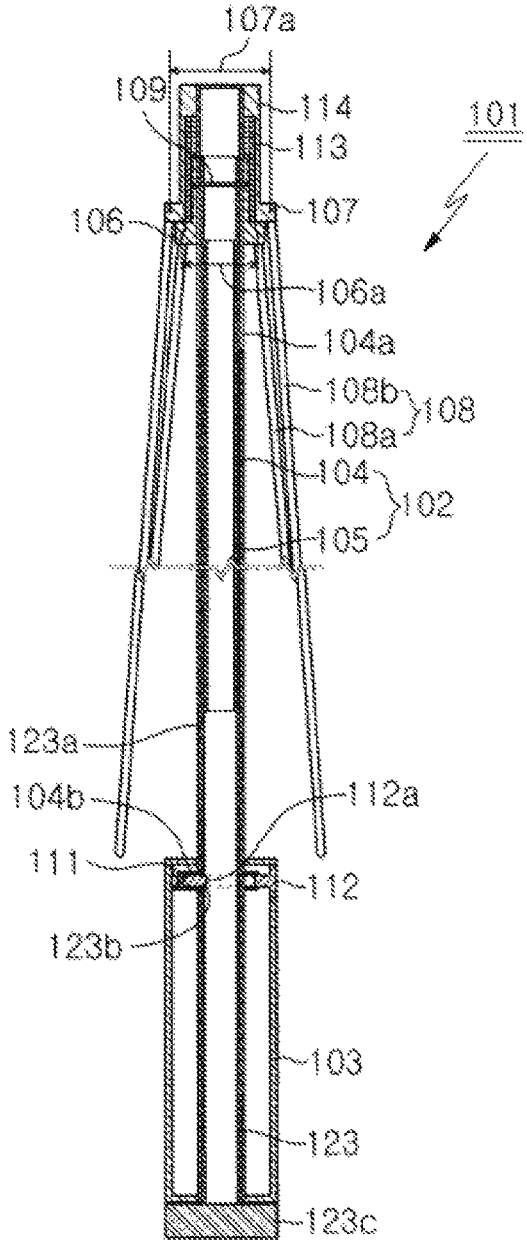
FIG. 33 is a cross sectional view illustrating a state that an umbrella is fully folded according to a tenth embodiment of the present invention.

FIG. 31 is a cross sectional view illustrating a state that an umbrella spreads according to a tenth embodiment of the present invention, and FIG. 32 is a cross sectional view illustrating a state before an umbrella spreads according to a tenth embodiment of the present invention, and FIG. 33 is a cross sectional view illustrating a state that an umbrella is fully folded according to a tenth embodiment of the present invention.

In the tenth embodiment of the present invention, when constructing the umbrella 101 like the ninth embodiment of the present invention, the main rib fixing member 107 and the auxiliary rib fixing member 106 are installed at the upper sides of the outer and inner tubes 104 and 105, respectively, and the main ribs 108*b* and the auxiliary ribs 108*a* of the rib assembly 108 are rotatably assembled thereto.

The auxiliary coil spring 113 is disposed between the main rib fixing member 107 and the auxiliary rib fixing member 106, and the coil spring 113 is built in the spring housing 114 integrally formed at the main rib fixing member 107 in a state that the umbrella 101 is folded in the present invention.

The elastic force of the auxiliary coil spring 113 preferably helps spread the umbrella 101 by ⅓ to ½. It is possible to fully spread the umbrella by increasing the tensional force of the auxiliary coil spring 113, but in this case, it is hard to fold the umbrella 101. When decreasing the tensional force of the auxiliary coil spring 113, the insertion of the auxiliary coil spring 113 becomes useless.

When constructing the umbrella 101 like the tenth embodiment of the present invention, when the operation button 112 is pressed so as to spread the umbrella 101 like the ninth embodiment, the auxiliary coil spring 113 is extended and pushes the auxiliary rib fixing member 106 downwards. At this time, since the umbrella 101 spreads by ⅓ to ½, when the engaging shoulder 123*c* of the lower side of the appearing and disappearing part 123 is pulled downwards with hands in the above state, the umbrella 101 fully spreads for thereby implementing an easier spreading operation of the umbrella 101.

When constructing the umbrella 101 like the tenth embodiment of the present invention, when the operation button 112 is pressed so as to spread the umbrella 101 like the ninth embodiment, the auxiliary coil spring 113 disposed between the main rib fixing member 108*b* and the auxiliary rib fixing member 108*a* secured to the upper sides of the outer and inner tubes 104 and 105 is extended, and the tensional force of the umbrella cloth and the self-weight of the rib assembly 108 are balanced for thereby spreading the umbrella ⅓ to ½. In this state, when the engaging shoulder 123*c* of the lower side of the appearing and disappearing part 123 is a little pulled, the auxiliary rib fixing member 106 secured to the upper side of the inner tube 105 by the pin 109 moves downwards along the operation hole 104*a* formed at the outer tube 104 for thereby spreading the umbrella 101. At this time, since the residual elastic force of the auxiliary coil spring 113 is applied, it is possible to spread the umbrella 101 with small force.

In addition, when folding the umbrella 101, the tensional force of the umbrella cloth and the self-weight of the rib assembly 108 and the elastic force of the auxiliary coil spring 113 are balanced, so the umbrella 101 is folded by ⅓ to ½. In this state, when the engaging shoulder 123*c* of the lower side of the appearing and disappearing part 123 is a little pushed, it is possible to fold the umbrella 101 with small force. At this time, since the self-weight of the rib assembly 108 is applied, the umbrella 101 can be folded by small force.

Figure 34:
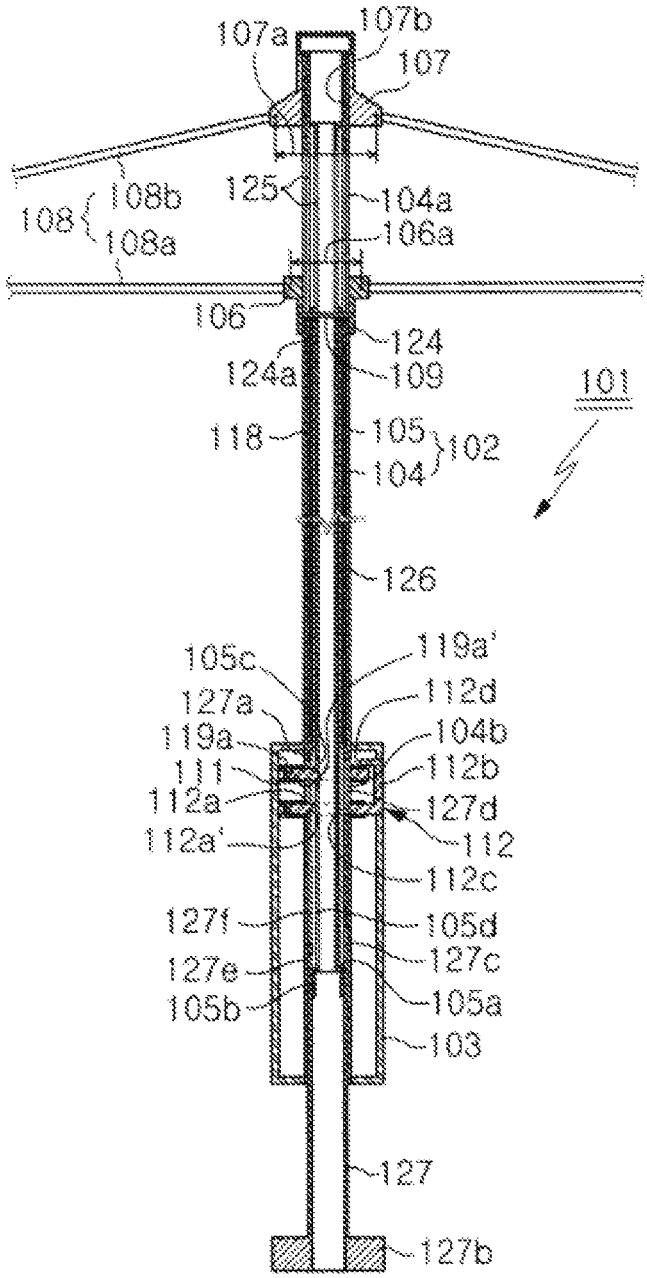
FIG. 34 is a cross sectional view illustrating a state that an umbrella spreads according to a eleventh embodiment of the present invention.
Figure 35:
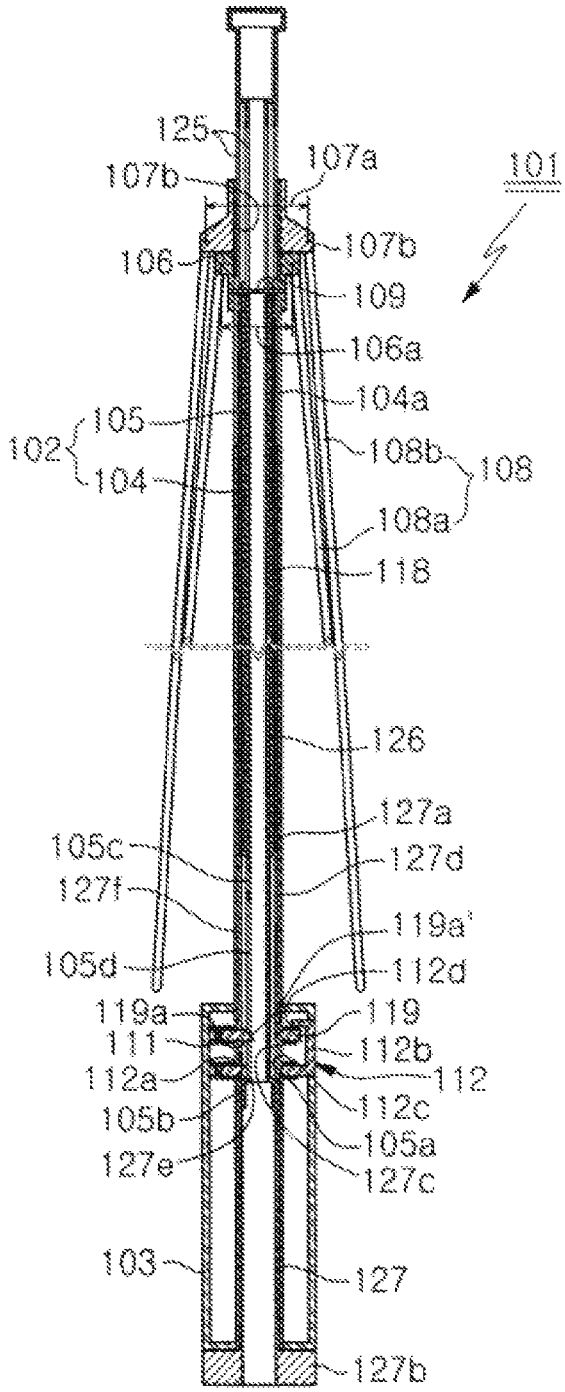
FIG. 35 is a cross sectional view illustrating a state that an umbrella is folded according to an eleventh embodiment of the present invention.
Figure 36:
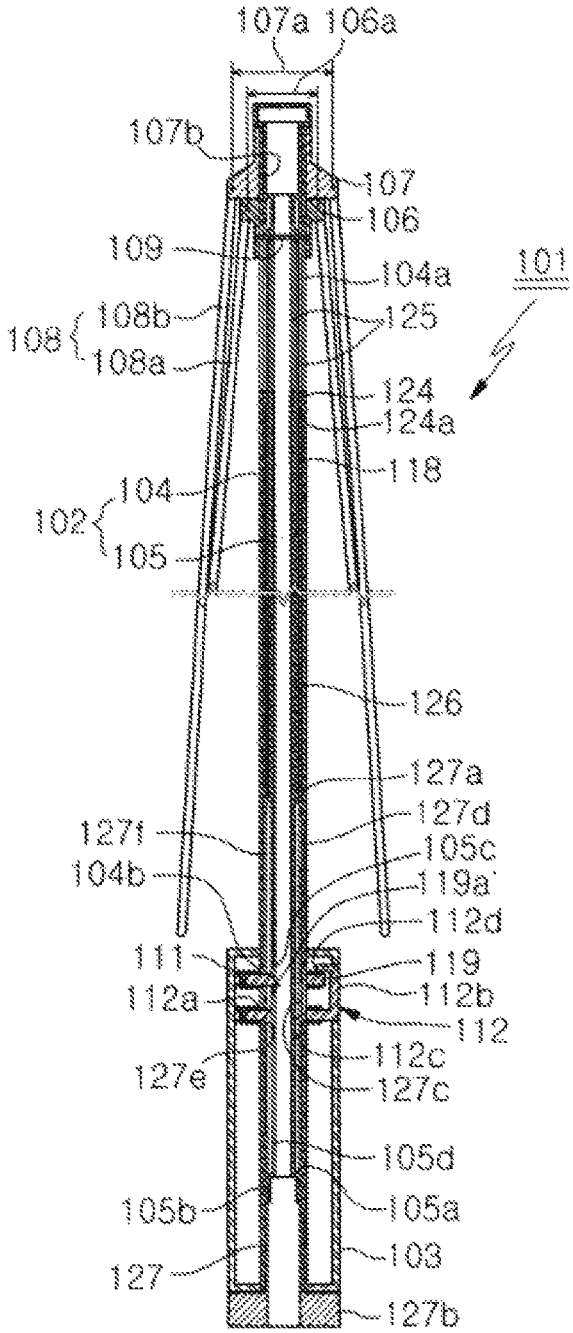
FIG. 36 is a cross sectional view illustrating a state that a coil spring is compressed in a state that an umbrella is folded according to an eleventh embodiment of the present invention.

FIG. 34 is a cross sectional view illustrating a state that an umbrella spreads according to an eleventh embodiment of the present invention, and FIG. 35 is a cross sectional view illustrating a state that an umbrella is folded according to an eleventh embodiment of the present invention, and FIG. 36 is a cross sectional view illustrating a state that a coil spring is compressed in a state that an umbrella is folded according to an eleventh embodiment of the present invention.

Figure 37:
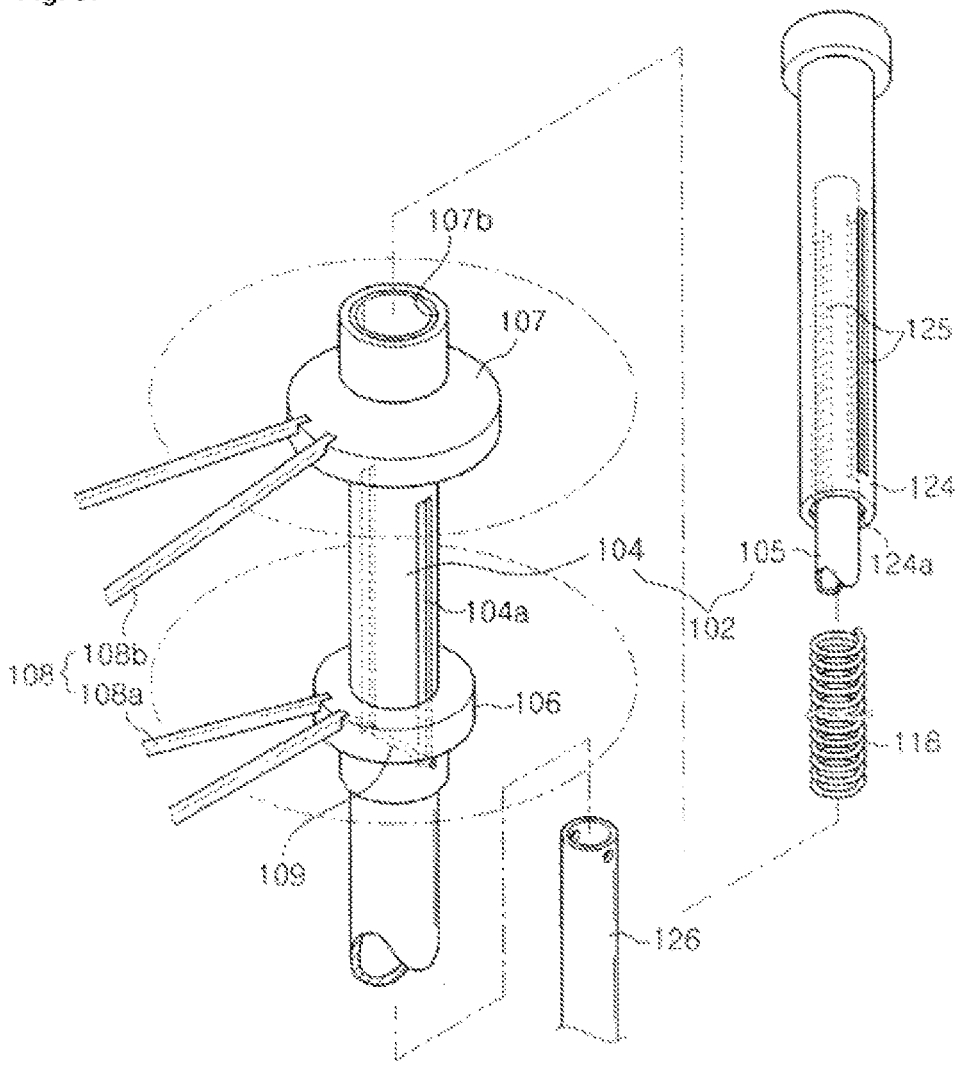
FIGS. 37 and 38 are cross sectional views of major elements according to an eleventh embodiment of the present invention.
Figure 38:
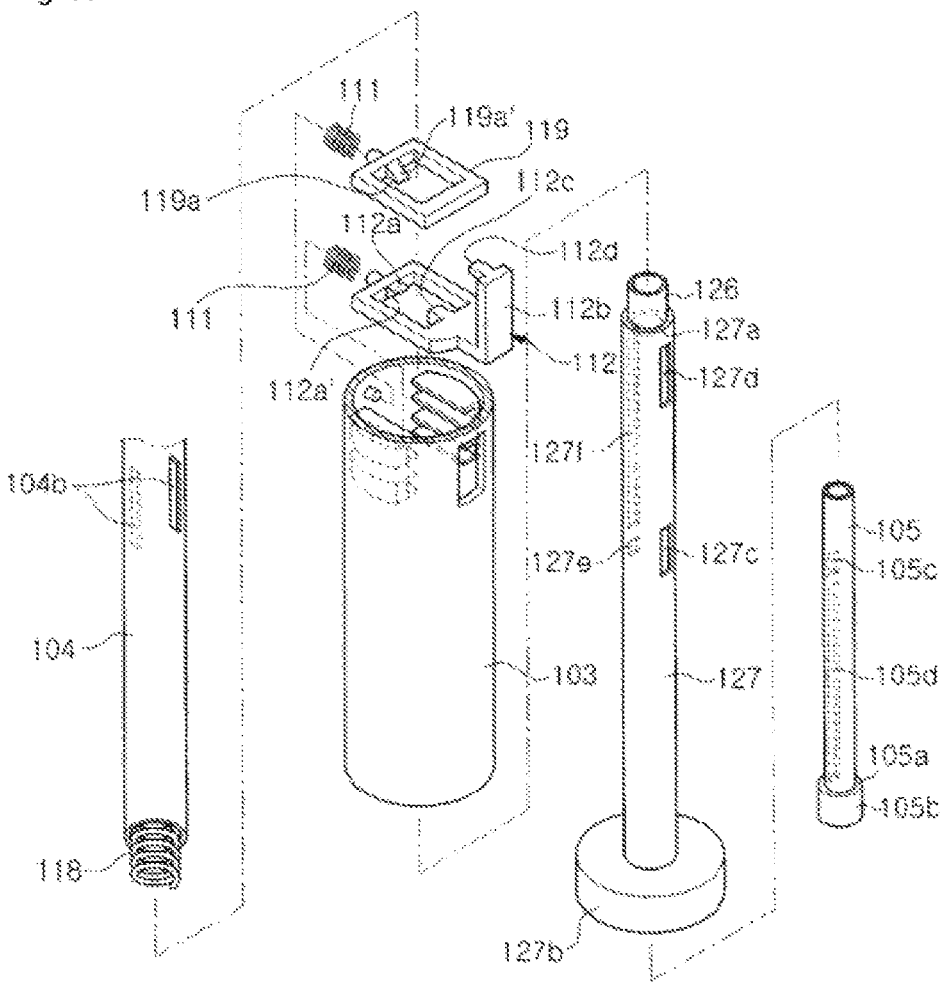

FIGS. 37 and 38 are cross sectional views of major elements of the eleventh embodiment of the present invention.

The umbrella 101 according to the eleventh embodiment of the present invention comprises a shank 102 formed of an outer tube 104 to which a handle 103 is secured to its lower side, and an inner tube 105 secured to an inner side of the outer tube 104.

The main rib fixing member 107 is secured to an upper side of the outer tube 104, and the inner tube 105 is assembled to the through hole 107*b* formed at the main rib fixing member 107 and slides upwards and downward. The support tube 105*b* is formed, with the engaging shoulder 105*a* being formed at the lower side of the inner side of the handle 103.

The spring support tube 124 with the shoulder 124*a* at its lower side is integrally secured to the upper outer portion of the inner tube 105. Opposite operation holes 104*a* are formed at the outer tube 104 of the lower side of the main rib fixing member 107, and the operation hole 125 is elongated at the spring support tube 124, which is secured to the inner tube 105 and the outer tube 104, in upward and downward directions while communicating with the operation hole 104*a*.

The upper side of the operation tube 126 is inserted into between the inner tube 105 and the spring support tube 124, and the pin 109 fixedly inserted into the upper side of the operation tube 126 is secured to the operation holes 104*a* and 125, respectively, and the auxiliary rib fixing member 106 is secured to the pin 109 and ascends and descends along the outer tube 104.

The main ribs 108*b* and the auxiliary ribs 108*a* of the rib assembly 108 are rotatably assembled to the main rib fixing member 107 and the auxiliary rib fixing member 106 installed at the outer tube 104 and the operation tube 126, respectively. At this time, the diameter of the engaging part 107*a* which is formed at the main rib fixing member 107 and to which the main ribs 108*b* are secured is larger than the diameter of the engaging part 106*a* which is formed at the auxiliary rib fixing member 106 and to which the auxiliary ribs 108*a* are secured.

The shoulder 127*a* is formed at the upper side of the appearing and disappearing part 127 integrally formed at the lower side of the operation tube 126, and the engaging shoulder 127*b* is formed at the lower side of the appearing and disappearing part 127 and is caught by means of the handle 103.

A coil spring 118 is disposed between the shoulder 124*a* of the spring support tube 124 integrally formed at the inner tube 105 and the shoulder 127*a* formed at a boundary between the operation tube 126 and the appearing and disappearing part 127, with the coil spring 118 being positioned at an inner side of the outer tube 104.

The coil spring 118 is designed to provide an elastic force, which is a little stronger than the force needed for spreading the umbrella 101 in a compressed state.

The handle 103 is equipped with an operation button 112 elastically supported by the spring 111, and an auxiliary button 119 which is elastically supported by the spring 111 and is pressed by means of the pressing piece 112*b* integrally formed at the operation button 112, with the engaging protrusions 112*a* and 119*a* being formed at the operation button 112 and the auxiliary button 119 toward the spring 111. The ascending and descending prevention protrusion 112*c* is formed at the operation button 119 at the opposite side of the engaging protrusion 112*a*, and a support protrusion 112*d* is formed at the upper side of the pressing piece 112*b*.

The ascending and descending prevention protrusion 112*c* formed at the opposite sides of the engaging protrusions 112*a* and 119*a* are designed to be inserted into the lower stopper hole 127*c* and the upper stopper hole 127*d* formed at the lower appearing and disappearing part 127 of the operation tube 126, which will be described later, in a state that the operation button 112 is pressed, and the support protrusion 112*d* formed at the pressing piece 112*b* is not inserted into the lower stopper hole 127*c* of the appearing and disappearing part 127, but is inserted into the upper stopper hole 127*d* of the appearing and disappearing part 127.

The engaging protrusion 112*a* formed at the operation button 112 forms an upwardly inclined guide surface 112*a*', and the engaging protrusion 119*a* formed at the auxiliary button 119 forms a downwardly inclined guide surface 119*a*'. When the inclined surfaces 112*a*' and 119*a*' come into contact with the operation holes 105*d* and 127*f* formed at the lower side of the inner tube 105, which will be described later, and the appearing and disappearing part 127 of the lower side of the operation tube 126, the operation button 112 and the auxiliary button 119 can naturally move backwards.

The upper engaging hole 105*c* is formed at the inner tube 105 in a small size, and the operation hole 105*d* is elongated below the same, and the operation hole 127*f* is elongated at the upper side of the appearing and disappearing part 127 formed at the lower side of the operation tube 126 while being contrary to the inner tube 105, and the engaging hole 127*e* is formed below the same in a short size. The engaging holes 105*c* and 127*e* and the operation holes 105*d* and 127*f* are overlapped, and the engaging protrusions 112*a* and 119*a* formed at the operation button 112 and the auxiliary button 119 are selectively engaged with the engaging holes 105*c* and 127*e* and the operation holes 105*d* and 127*f*.

The stopper holes 127*d* are formed at the opposite upper sides of the operation hole 127*f* and the engaging hole 127*e* formed at the appearing and disappearing part 127, with the ascending and descending prevention protrusion 112*c* and the support protrusion 112*d* formed at the operation button 112 being inserted into to the stopper holes 127*d*. The stopper hole 127*c* is formed at a lower side and overlaps with the engaging hole 127*e* and the operation hole 127*f* of the appearing and disappearing part 127 and are shorter than the stopper hole 127*d* of the upper side, with only the ascending and descending prevention protrusion 112*c* formed at the operation button 112 being inserted into the stopper hole 127*b*, with the support protrusion 112*d* being not able to be inserted into the stopper hole 127*c*.

When using the umbrella 101 of the eleventh embodiment of the present invention, the operation button 112 installed at the handle 103 is pressed in a state that the umbrella is folded as shown in FIG. 36.

When the operation button 112 is pressed, and the ascending and descending prevention part 112*c* formed at the operation button 112 is inserted into the stopper hole 127*c* formed at a lower side of the appearing and disappearing part 127 formed at the operation tube 126, the engaging protrusion

112*a* inserted in the engaging hole 127*e* of the appearing and disappearing part 127 escapes, and the coil spring 118 pushes the operation tube 126 downwards.

At this time, the support protrusion 112*d* formed at the operation button 112 keeps contacting with the outer surface of the appearing and disappearing part 127, not coming into contact with the auxiliary button 119 which is inserted into the engaging hole 105*c* formed at the upper side of the inner tube 105 and keeps the inner tube 105 fixed. When the operation button 112 keeps pressed, the umbrella 101 does not spread.

When the operation button 112 is in a pressed state, since the ascending and descending prevention protrusion 112*c* formed at the operation button 112 holds the descending of the operation tube 126 while being caught by the upper side of the stopper hole 127*c* formed at the lower side of the appearing and disappearing part 127, the engaging protrusion 112*a* escaped from the engaging hole 127*e* formed at the appearing and disappearing part 127 is positioned at an outer side of the operation hole 127*f* formed at the appearing and disappearing part 127.

When the operation button 112 is pressed, and the pressing force is removed, the operation button 112 moves backwards by an elastic force of the spring 111, and the ascending and descending prevention protrusion 112*c* escapes from the stopper hole 127*c* formed at the lower side of the appearing and disappearing part 127, and the engaging protrusion 112*a* is inserted into the inner side of the operation hole 127*f* formed at the appearing and disappearing part 127. The coil spring 118, which remains compressed, fully pushes the operation tube 126. At this time, the auxiliary rib fixing member 106 to which the auxiliary ribs 108 are fixed moves downwards, with being engaged to the operation tube 126 by the pin 119, so the umbrella 101 spreads.

When the umbrella 101 remains spread, since the appearing and disappearing part 127 of the operation tube 126 has descended, the support protrusion 112*d* formed at the pressing piece 112*b* of the operation button 112 in the stopper hole 127*d* formed at the upper side of the appearing and disappearing part 127 is ready to be inserted into the stopper hole 127*d*.

When it is needed to fold the umbrella 101 after using the same, the operation button 112 is pressed.

Namely, when the operation button 112 is pressed, the ascending and descending prevention protrusion 112*c* formed at the operation button 112 is inserted into the upper stopper hole 127*d* of the appearing and disappearing part 127, and the support protrusion 112*d* formed at the pressing piece 112*b* is together inserted into the stopper hole 127*d*. At this time, since the pressing piece 112*b* presses the auxiliary button 119, the engaging protrusion 119*a* inserted in the engaging hole 105*c* of the inner tube 105 escapes.

At this time, the appearing and disappearing part 127 a little moves upwards, and the ascending and descending prevention protrusion 112*c* formed at the operation button 112 is caught by the lower side of the stopper hole 127*d* formed at the appearing and disappearing part 127 and stops, and the engaging protrusion 112*a* formed at the operation button 112 is positioned at an outer side of the operation hole 127*f* formed at the upper side of the appearing and disappearing part 127, and the engaging protrusion 119*a* formed at the auxiliary button 119 is positioned at an outer side of the operation hole 105*d* of the inner tube via the operation tube 127*f*. In this state, when the pressing force is removed from the operation button 112, the operation button 112 and the auxiliary button 119 return to their original positions by means of the tensional force of the spring 111, and the engaging protrusion 112*a* formed at the operation button 112 is inserted into the operation hole 127*f* formed at the appearing and disappearing part 127, and the engaging protrusion 119*a* formed at the auxiliary button 119 is inserted into the operation button 105*d* formed at the inner tube 105 via the operation hole 127*f* formed at the appearing and disappearing part, and the coil spring 118, which is extended and caught between the shoulder 124*a* of the spring support tube 124 integrally formed at the inner tube and the shoulder 127*a* formed at a boundary between the operation tube 126 and the appearing and disappearing part 127, the operation tube 126, and the inner tube 105 become integral, and ascend with the aid of the tensional force of the umbrella cloth and the self-weight of the rib assembly 108 without any interference with the engaging protrusions 112*a* and 119*a* formed at the operation button 112 and the auxiliary button 119, so the umbrella 101 is folded. When the umbrella 1 is folded, no operation occurs at the coil spring 118.

When the inner tube 105 ascends, since the umbrella 101 is not in a fully folded state, the appearing and disappearing part 127 closer to the lower side of the handle 103 in the above state is pushed upwards, and the engaging hole 127*e* formed at the appearing and disappearing part 127 is caught by the engaging protrusion 112*a* of the operation button 112, so the umbrella 101 gets folded.

In the above state, the upper side of the inner tube 105 exposed to the outside via the through hole 107*b* of the main rib fixing member 107 is pushed toward the handle 103 so as to spread the umbrella 101 for thereby compressing the coil spring 118.

The engaging protrusion 119*a* of the auxiliary button 119 is inserted into the engaging hole 105*c* formed at the inner tube 105 for thereby fixing the inner tube 105.

Figure 39:
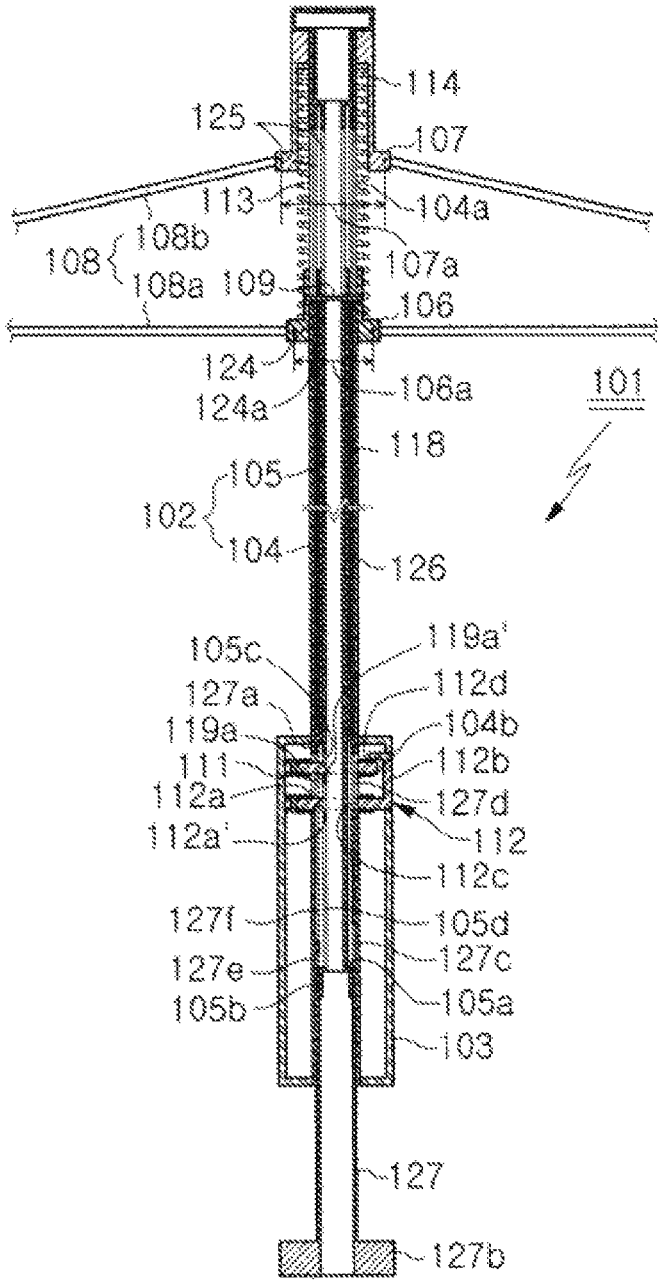
FIG. 39 is a cross sectional view illustrating a state that an umbrella spreads according to a twelfth embodiment of the present invention.
Figure 40:
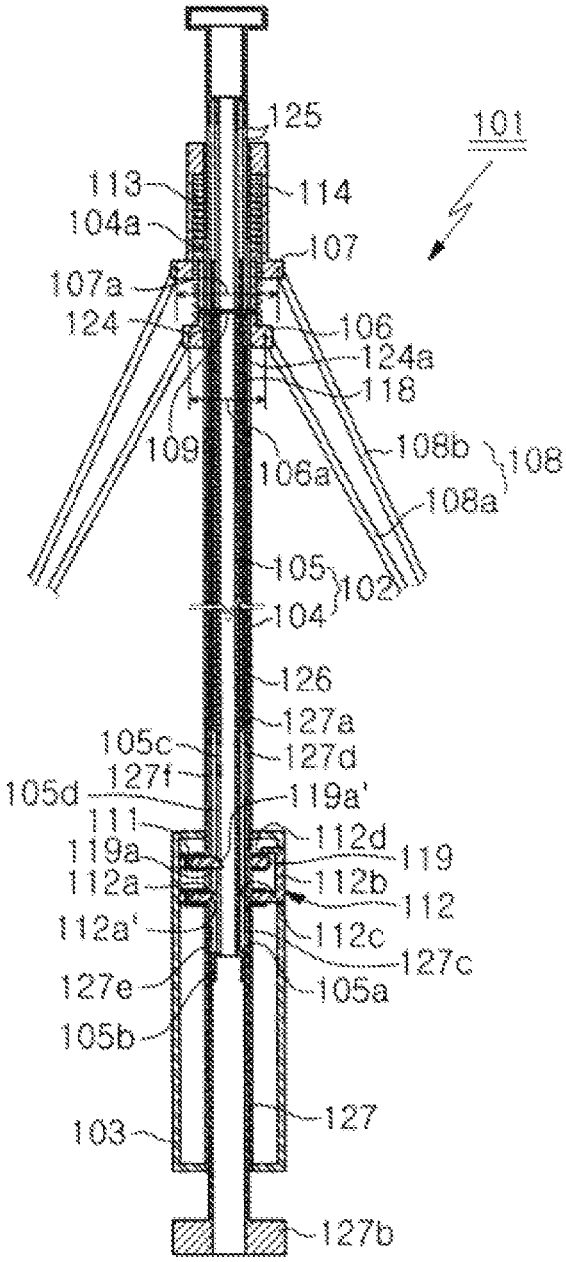
FIG. 40 is a cross sectional view illustrating a state that an umbrella is folded or spreads by ⅓ or ½ according to a twelfth embodiment of the present invention.
Figure 41:
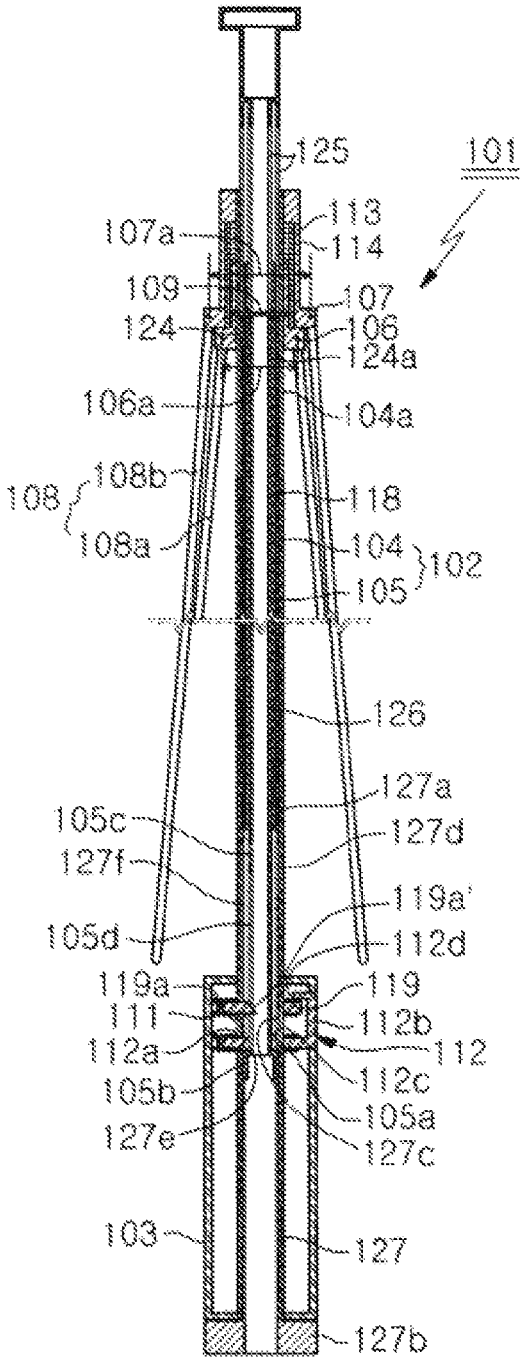
FIG. 41 is a cross sectional view illustrating a state that an umbrella is fully folded according to a twelfth embodiment of the present invention.
Figure 42:
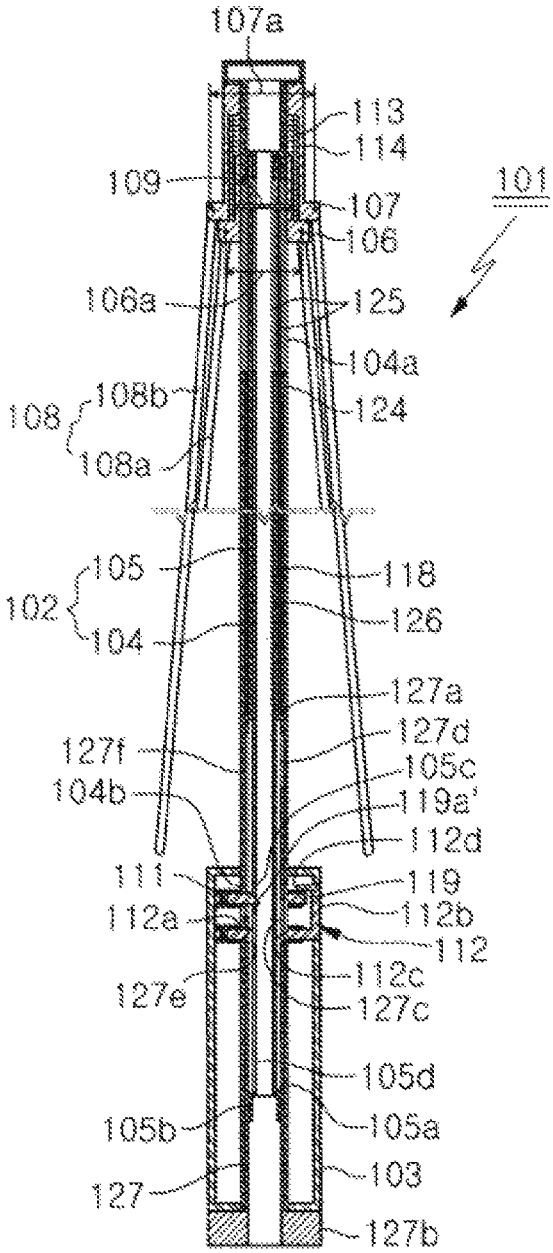
FIG. 42 is a cross sectional view illustrating a state that a coil spring is compressed in a state that an umbrella is fully folded according to a twelfth embodiment of the present invention.

FIG. 39 is a cross sectional view illustrating a state that an umbrella spreads according to a twelfth embodiment of the present invention, and FIG. 40 is a cross sectional view illustrating a state that an umbrella is folded or spreads by ⅓ or ½ according to a twelfth embodiment of the present invention, and FIG. 41 is a cross sectional view illustrating a state that an umbrella is fully folded according to a twelfth embodiment of the present invention, and FIG. 42 is a cross sectional view illustrating a state that a coil spring is compressed in a state that an umbrella is fully folded according to a twelfth embodiment of the present invention.

The twelfth embodiment of the present invention is basically directed to easily spreading the umbrella 101 wherein the umbrella 101 is assembled and constructed like the eleventh embodiment. An auxiliary coil spring 113 is installed between the auxiliary rib fixing member 106 and the main rib fixing member 107, and the coil spring 113 is built in the spring housing 114 integrally formed at the main rib fixing member 107 in a state that the umbrella 101 is folded, and is positioned at an outer side of the outer tube 104.

The auxiliary coil spring 113 reinforces an elastic force of the built-in coil spring 118 for thereby helping easily spread the umbrella 101.

When constructing the umbrella 101 like the twelfth embodiment of the present invention, since the auxiliary coil spring 113 is extended together with the coil spring 118 when spreading the umbrella 101 like in the eleventh embodiment of the present invention, it is possible to easily spread the umbrella 101.

Figure 43:
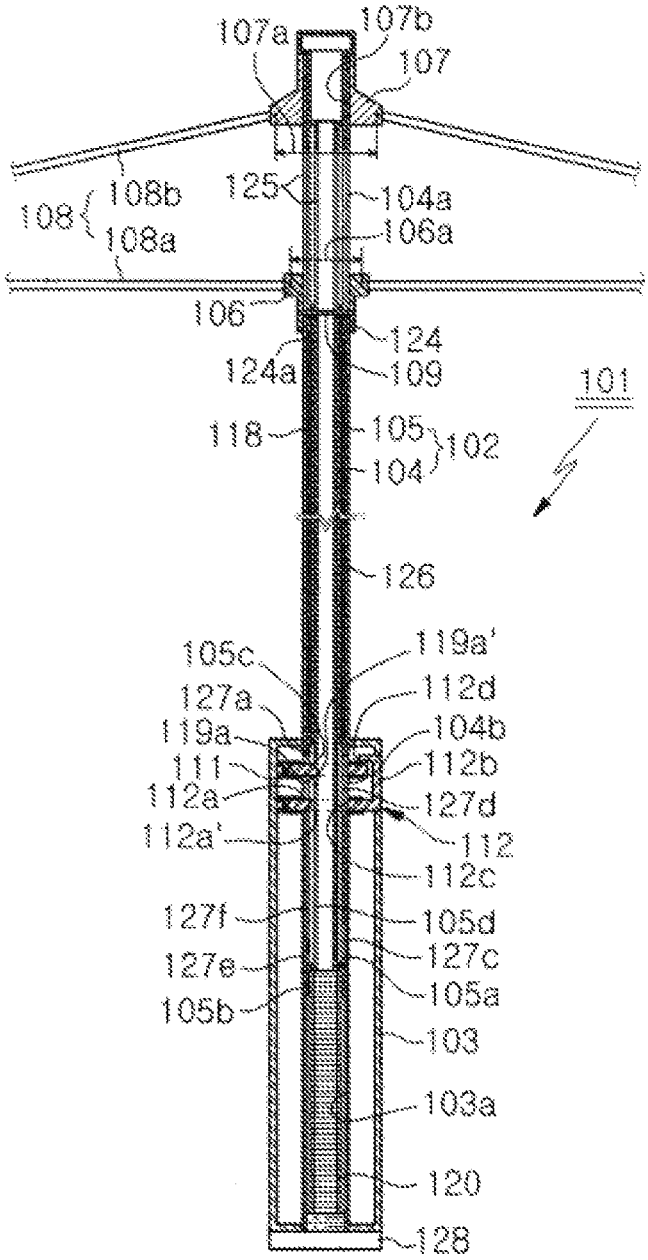
FIG. 43 is a cross sectional view illustrating an umbrella spreads according to a thirteenth embodiment of the present invention.
Figure 44:
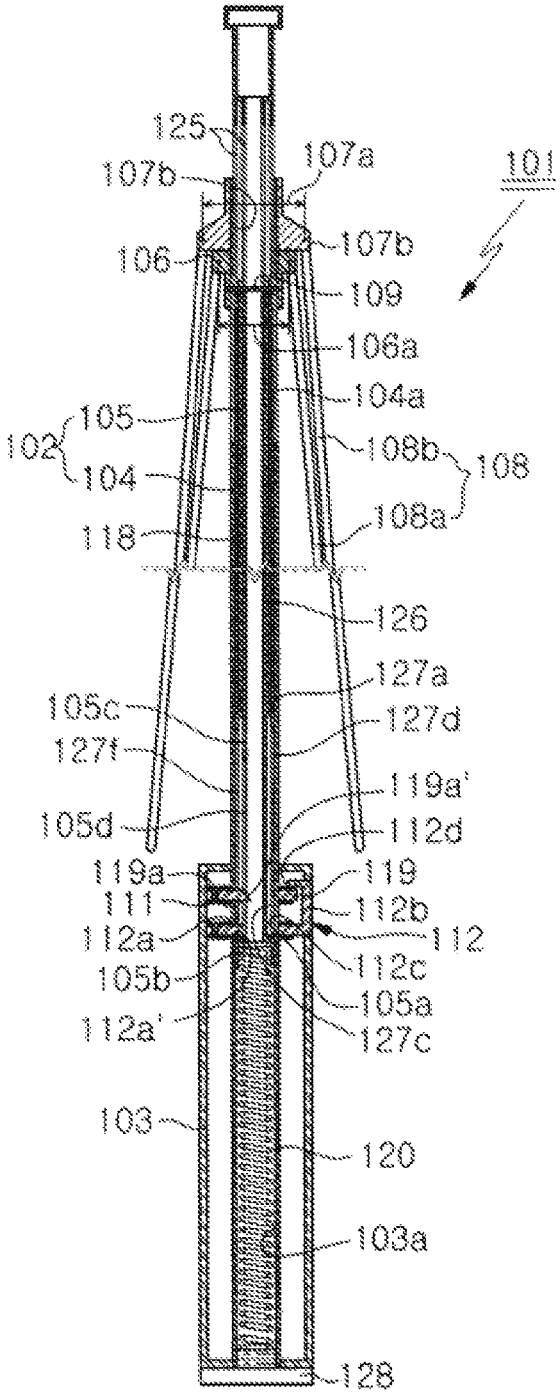
FIG. 44 is a cross sectional view illustrating a state that an umbrella is folded according to a thirteenth embodiment of the present invention.
Figure 45:
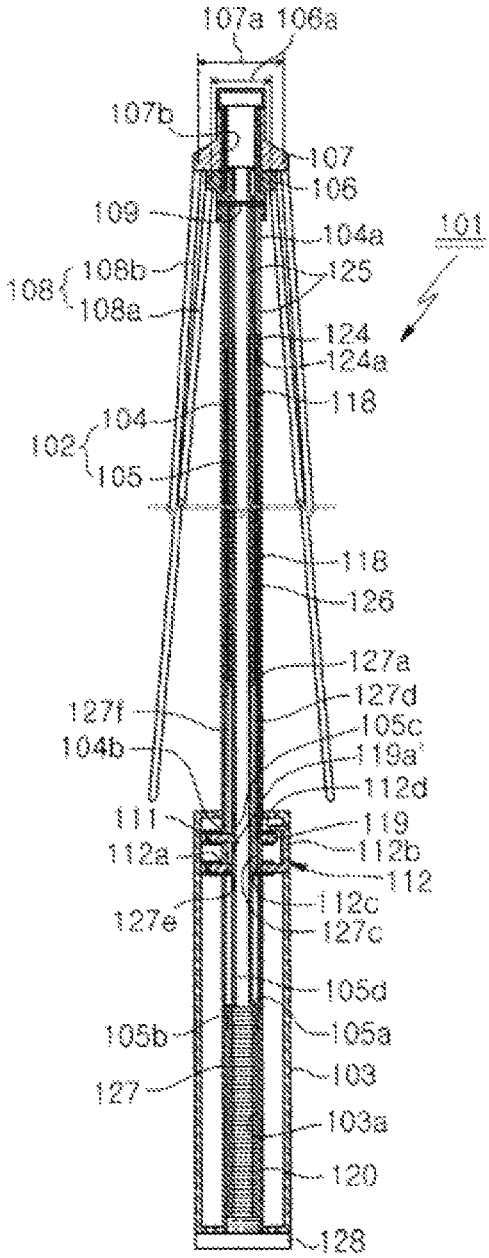
FIG. 45 is a cross sectional view illustrating a state that a coil spring and a second auxiliary coil spring are compressed in a state that an umbrella is fully folded according to a thirteenth embodiment of the present invention.

FIG. 43 is a cross sectional view illustrating an umbrella spreads according to a thirteenth embodiment of the present invention, and FIG. 44 is a cross sectional view illustrating a state that an umbrella is folded according to a thirteenth embodiment of the present invention, and FIG. 45 is a cross sectional view illustrating a state that a coil spring and a second auxiliary coil spring are compressed in a state that an umbrella is fully folded according to a thirteenth embodiment of the present invention.

The thirteenth embodiment of the present invention is basically directed to easily spreading the umbrella 101 wherein the umbrella 101 of the eleventh embodiment is assembled and constructed like the eleventh embodiment.

The lower side of the space 103*a* being open toward the inner side of the handle 103 is sealed by the cover 128, and the second auxiliary coil spring 120 is installed between the cover 128 and the support tube 105*b* of the lower side of the inner tube 105 in the space 103*a*.

The second auxiliary coil spring 120 is provided so as to help easily fold the umbrella 101.

When the operation button 112 is pressed so as to fold the umbrella 101 in a state that the umbrella 101 is in a spread state like the eleventh embodiment of the present invention, the ascending and descending prevention protrusion 112*c* formed at the operation button 112 is inserted into the upper stopper hole 127*d* of the appearing and disappearing part 127, and the support protrusion 112*d* formed at the pressing pieces 112*b* is together inserted into the stopper hole 127*d*. At this time, since the pressing piece 112*b* presses the auxiliary button 119, the engaging protrusion 119*a* inserted in the engaging hole 105*c* of the inner tube 105 escapes.

The appearing and disappearing part 127 a little moves upwards, and the ascending and descending prevention protrusion 112*c* is caught by the lower side of the stopper hole 127*d* formed at the appearing and disappearing part 127 and stops, and the engaging protrusion 112*a* formed at the operation button 112 is positioned at an outer side of the operation hole 127*f* formed at the upper side of the appearing and disappearing part 127, and the engaging protrusion 119*a* formed at the auxiliary button 119 is positioned at an outer side of the operation hole 105*d* formed at the inner tube 105 via the operation hole 127*f* formed at the appearing and disappearing part 127.

In the above state, when the pressing force is removed from the operation button 112, the operation button 112 and the auxiliary button 119 return to their original positions with the aid of the tensional force of the spring 111, and the engaging protrusion 112*a* formed at the operation button 112 is inserted into the operation hole 127*f* formed at the appearing and disappearing part 127, and the engaging protrusion 119*a* formed at the auxiliary button 119 is inserted into the operation hole 105*d* formed at the inner tube 105 via the operation hole 127*f* formed at the appearing and disappearing part 127, and the coil spring 118, which is extended and caught between the shoulder 124*a* of the spring support tube 124 integrally formed at the inner tube 105 and the shoulder 127 formed at a boundary between the operation tube 126 and the appearing and disappearing part 127, the operation tube 126 and the inner tube 105 become integral with each other and ascend with the aid of the tensional force of the umbrella cloth and the self-weight of the rib assembly 108 without any interference with the engaging protrusions 112*a* and 119*a*, and the second auxiliary coil spring 120 positioned between the cover 128 formed at the handle 103 and the support tube 105*b* of the lower side of the inner tube 105 is extended for thereby folding the umbrella, and the engaging protrusion 112*a* of the operation button 112 is caught by the engaging hole 127*e* of the appearing and disappearing part 127, so the umbrella is folded and fixed.

In the above state, when the upper side of the inner tube 105 exposed to the outside via the main rib fixing member 107 is pushed toward the handle 103 so as to spread the umbrella 101, the second auxiliary coil spring 120 between the coil spring 118 between the inner tube 105 and the operation tube 126 and the cover 128 which is built in the handle 103 and is secured to the lower support tube 105*b* of the inner tube 105 and the handle is together compressed, and the engaging protrusion 119*a* of the auxiliary button 119 is inserted into the engaging hole 105*c* formed at the upper side of the inner tube 105 for thereby fixing the inner tube 105.

With the above constructions, it is possible to easily fold and easily the umbrella 101.

Figure 46:
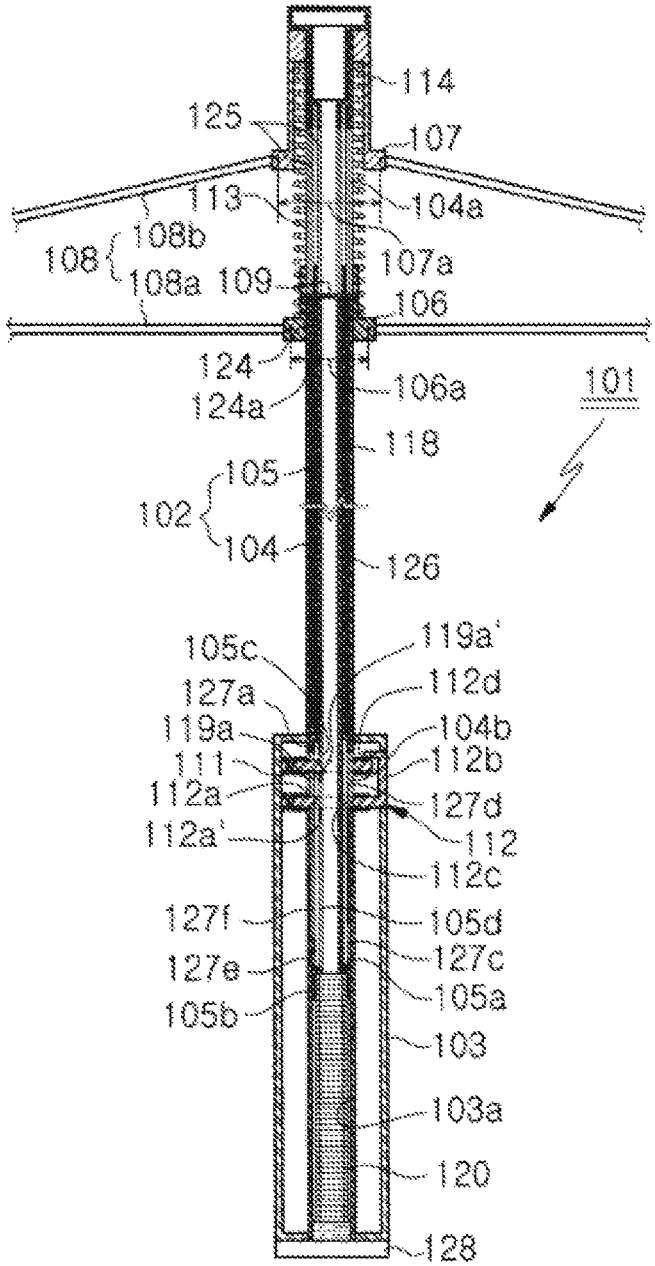
FIG. 46 is a cross sectional view illustrating a state that an umbrella spreads according to a fourteenth embodiment of the present invention.
Figure 47:
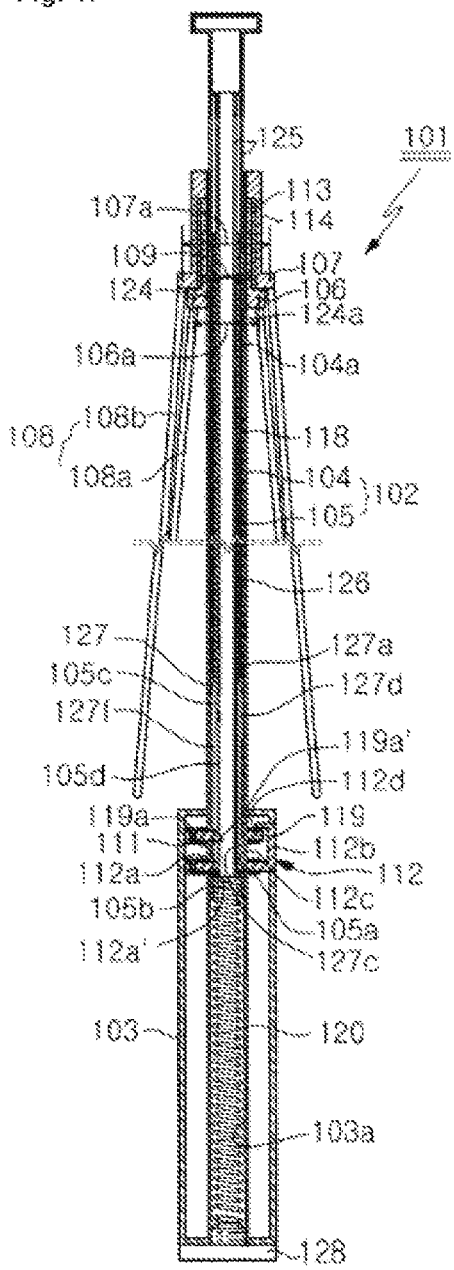
FIG. 47 is a cross sectional view illustrating a state that an umbrella is folded according to a fourteenth embodiment of the present invention.
Figure 48:
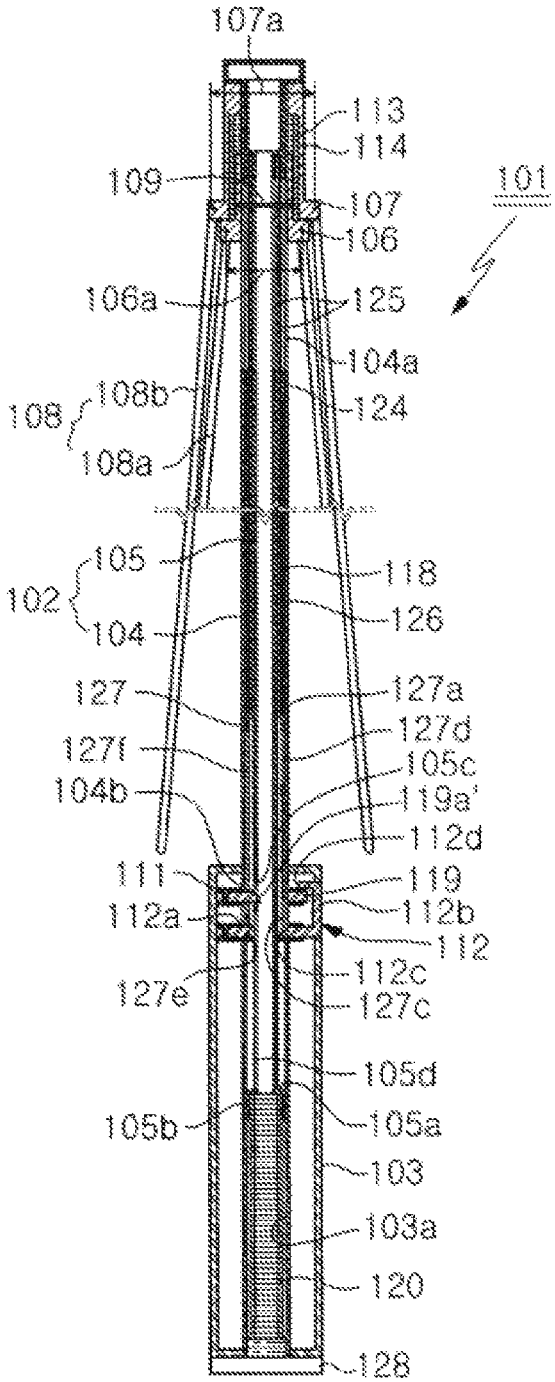
FIG. 48 is a cross sectional view illustrating a coil spring and a second coil spring are compressed in a state that an umbrella is fully folded according to a fourteenth embodiment of the present invention.

FIG. 46 is a cross sectional view illustrating a state that an umbrella spreads according to a fourteenth embodiment of the present invention, and FIG. 47 is a cross sectional view illustrating a state that an umbrella is folded according to a fourteenth embodiment of the present invention, and FIG. 48 is a cross sectional view illustrating a coil spring and a second coil spring are compressed in a state that an umbrella is fully folded according to a fourteenth embodiment of the present invention.

The fourteenth embodiment of the present invention is basically directed to easily spreading and folding the umbrella 101 by combining the auxiliary coil spring 113 of the twelfth embodiment and the second auxiliary coil spring 120 of the thirteenth embodiment to the eleventh embodiment of the present invention.

As shown therein, the auxiliary coil spring 113 is installed between the auxiliary rib fixing member 106 and the main rib fixing member 107, and the auxiliary coil spring 113 is built in the spring housing 114 integrally formed at the main rib fixing member 107 in a state that the umbrella 101 is folded wherein the umbrella 101 is constructed like in the eleventh embodiment.

A space 103*a*, which is downwardly open, is formed at an inner side of the handle 103, and is sealed by the cover 128, and a second auxiliary coil spring 120 is installed between the support tube 105*b* formed at the lower side of the inner tube 105 and the cover 128 in the space 103*a*.

When constructing the umbrella 101 like in the fourteenth embodiment of the present invention, the umbrella 101 can fast spread, and when folding the umbrella 101, it is not fast folded with the aid of the second auxiliary coil spring 120. Namely, the umbrella 101 is slowly folded with the aid of the delaying function of the auxiliary coil spring 113, which provides many conveniences in use.

Figure 49:
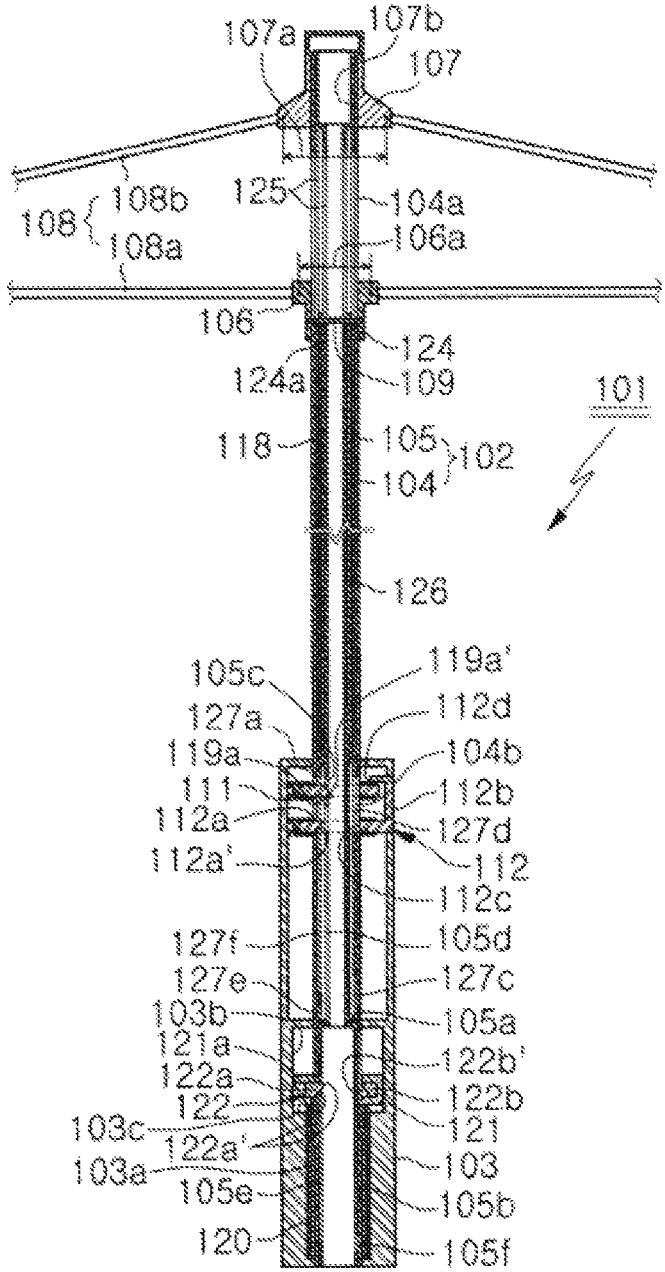
FIG. 49 is a cross sectional view illustrating a state that an umbrella spreads according to a fifteenth embodiment of the present invention.
Figure 50:
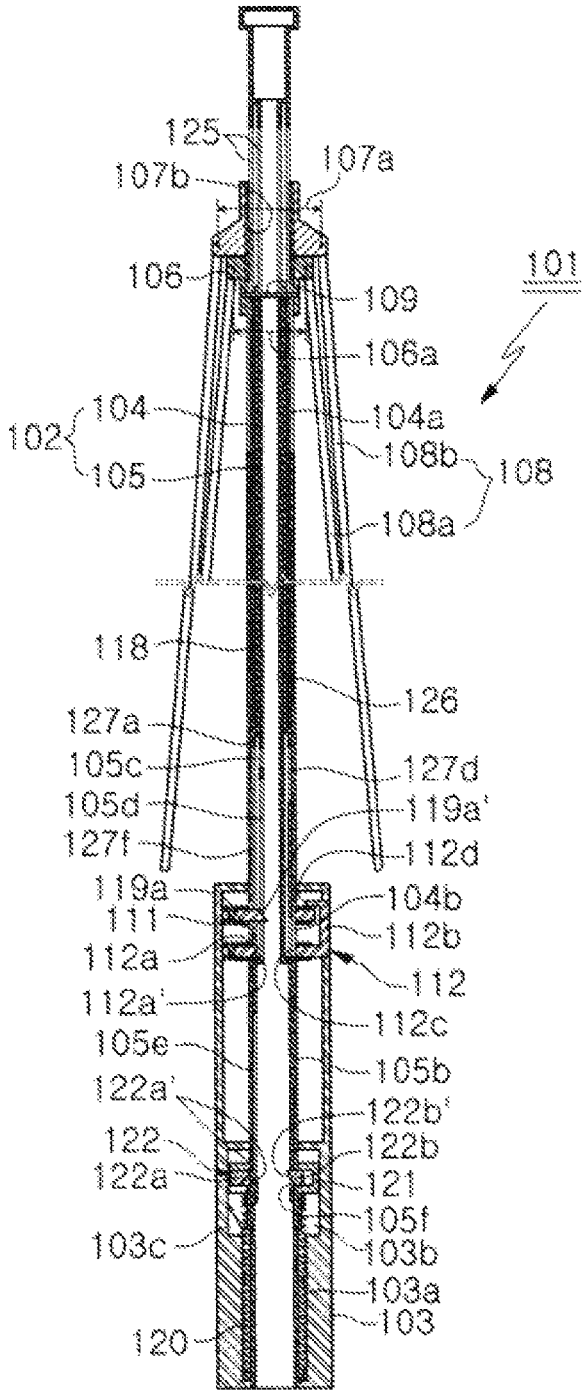
FIG. 50 is a cross sectional view illustrating a state that an umbrella is folded according to a fifteenth embodiment of the present invention.
Figure 51:
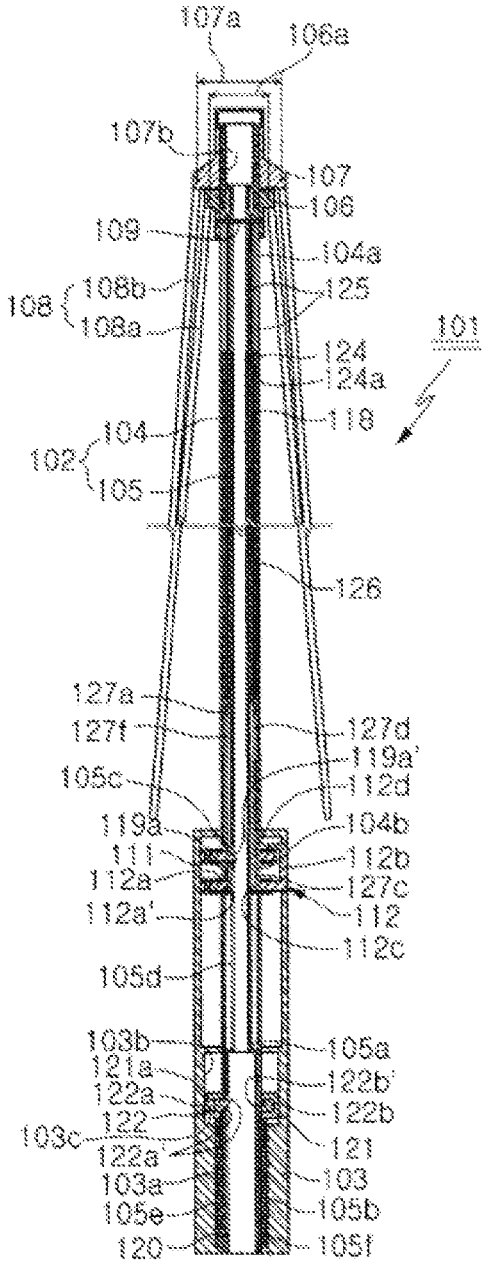
FIG. 51 is a cross sectional view illustrating a state that a coil spring and a second coil spring are compressed in a state that an umbrella is fully folded according to a fifteenth embodiment of the present invention.
Figure 52:
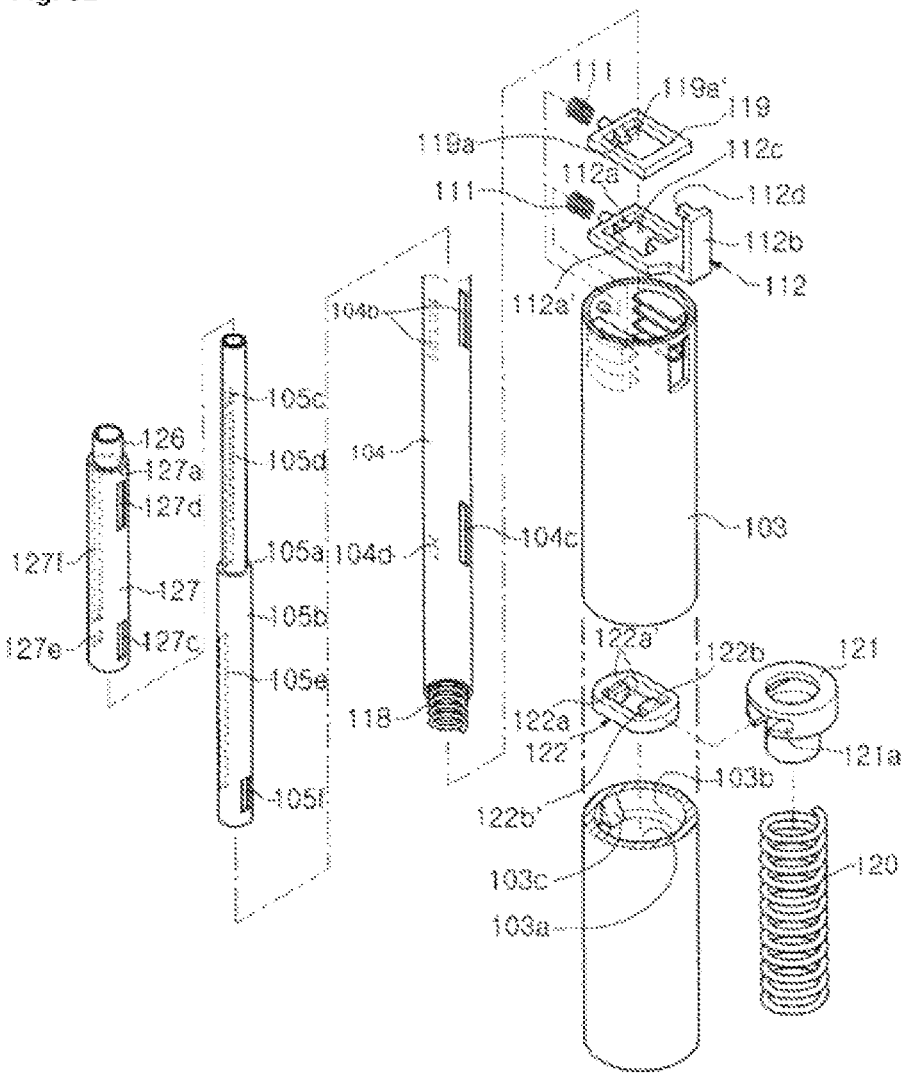
FIG. 52 is an enlarged cross sectional view illustrating the major elements according to a fifteenth embodiment of the present invention.

FIG. 49 is a cross sectional view illustrating a state that an umbrella spreads according to a fifteenth embodiment of the present invention, and FIG. 50 is a cross sectional view illustrating a state that an umbrella is folded according to a fifteenth embodiment of the present invention, and FIG. 51 is a cross sectional view illustrating a state that a coil spring and a second coil spring are compressed in a state that an umbrella is fully folded according to a fifteenth embodiment of the present invention, and FIG. 52 is an enlarged cross sectional view illustrating the major elements according to a fifteenth embodiment of the present invention.

In the fifteenth embodiment of the present invention, it is possible to make the umbrella be automatically folded wherein the umbrella 101 is constructed like in the thirteenth embodiment.

As shown therein, the space 103*a* is formed at an inner side of the handle 103, and the second auxiliary coil spring 120 is secured. So, the pressing function is performed by the inner tube 105. Namely, the second auxiliary coil spring 120 can be effectively pressed in this embodiment.

In order to implement the above embodiment of the present invention, an installation hole 103*b* is formed above the space 103*a* at an inner side of the handle 103 to which the second auxiliary coil spring 120 is secured, and the spring support member 121 is provided at the installation hole 103*b* while being inserted into the outer side of the outer tube 104. The inner insertion hole 121*a* of which sides is open is formed at the spring support member 121, and the stopper 122 having opposite protrusions 122*a* and 122*b* are secured to the inner insertion hole 121*a* while being inserted into the outer side of the outer tube 104, so the spring support member 121 does not escape.

One side of each protrusion 122*a*, 122*b* formed at the stopper 122 is formed in a triangle shape having an inclined surface 122*a*' formed in upward and downward directions, and the other side of the same has an inclined surface 122*b*' formed in an upward direction.

The hole 121*b* is formed at a lower side of the inner insertion hole 121*a*, to which hole 121*b* the inclined guide surface 103*c* formed at the lower side of the installation hole 103*b* of the interior of the handle 103 is inserted. When the support tube 105*b* of the lower side of the inner tube 105 descends, and the spring support member 121 descends, the inclined guide surface 103*c* passes through the hole 121*b* and pushes the stopper 122, and allows the protrusion 122*a* formed at the stopper 122 to insert into the operation hole 105*e* formed at the support tube 105*b* of the lower side of the inner tube 105 via the engaging hole 104*d* formed at the outer tube 4 and allows the protrusion 122*b* to escape from the second engaging hole 105*f* formed at the support tube 105*b* of the lower side of the inner tube 105 and to position at an outer side of the operation hole 104*c* formed at the outer tube 104.

When the support tube 105*b* ascends, the lower side of the second operation hole 105*e* formed at the support tube 105*b* pushes the lower side of the inclined surface 122*a*' of the protrusion 122*a* for thereby pushing the stopper 122, so the protrusion 122*a* escapes from the engaging hole 104*d* of the outer tube, and the protrusions 122*b* is inserted into the second engaging hole 105*f* of the support tube 105*b* of the inner tube via the operation hole 104*c* of the outer tube.

When it is needed to spread the umbrella 101 from a state that the umbrella 101 of the fifteenth embodiment is folded as shown in FIG. 51, the operation button 112 installed at the handle 103 is pressed, and the umbrella 101 spreads in the way described in the descriptions of the eleventh embodiment of the present invention. The detailed descriptions thereof will be referred to the eleventh embodiment of the present invention.

When it is needed to fold the umbrella 101 after using it, the operation button 112 is pressed. Namely, when the operation button 112 is pressed, the ascending and descending prevention protrusion 112*c* formed at the operation button 112 and the support protrusion 112*d* formed at the pressing piece 112*b* press the auxiliary button 119, so the engaging protrusion 119*a* formed at the auxiliary button 119 escapes from the engaging hole 105*c* formed at the inner tube.

At this time, the appearing and disappearing part 127 a little moves upwards, and the ascending and descending prevention protrusion 112*c* formed at the operation button 112 is caught by the stopper hole 127*d* formed at the appearing and disappearing part 127 and stops. The engaging protrusion 112*a* formed at the operation button 112 is positioned at an outer side of the operation hole 127*f* formed at the upper side of the appearing and disappearing part 127. In this state, when the pressing force is removed from the operation button 112, the operation button 112 and the auxiliary button 119 return to their original positions with the aid of the tensional force of the spring 111, and the engaging protrusions 112*a* and 119*a* are inserted into the operation holes 105*d* formed at the inner tube 105 via the operation holes 127*f* formed at the appearing and disappearing part 127. The coil spring 118, which is formed between the shoulder 124*a* of the spring support tube 124 integrally formed at the inner tube and the shoulder 127*a* formed at a boundary between the operation tube 126 and the appearing and disappearing part 127, the operation tube 126 and the inner tube 105 become integral with each other, and ascend with the aid of the elastic force of the umbrella cloth and the self-weight of the rib assembly 108 without any interference with the engaging protrusions 112*a* and 119*a*, for thereby folding the umbrella.

The support tube 105*b* of the lower side of the inner tube 105 ascends, and the lower side of the second operation hole 105*e* of the support tube 105*b* pushes the inclined surface 122*a*' of the protrusion 122*a* formed at the stopper 122 inserted in the second operation hole 105*e* caught by the engaging hole 104*d* formed at the outer tube 104 and formed at the inner tube 105, so the protrusion 122*a* escapes from the engaging hole 104*d*, and at the same time the protrusion 122*b* formed at the stopper 122 is inserted into the second engaging hole 105*f* of the inner tube via the operation hole 104*c* of the outer tube, so the spring pressing tube 121 ascends along with the support tube 105*b* of the inner tube with the aid of the elastic force of the second coil spring 120, whereby the umbrella, which has been almost folded, is fully folded. At this time, the engaging protrusion 112*a* is fixedly inserted into the engaging hole 127*e* of the operation tube 127.

In this state, when spreading or folding the umbrella 101, it is needed to keep the coil spring 118 and the second auxiliary coil spring 120 compressed together. The compression should be enough to push the upper side of the inner tube 105 exposed to the outside via the through hole 107*b* of the main rib fixing member 107 toward the handle 103, but in case of the thirteenth embodiment of the present invention, the second auxiliary coil spring 120 and the coil spring 118 should be concurrently compressed with the same stroke distance, so a lot of force is needed for compression.

According to the fifteenth embodiment of the present invention, when the upper side of the inner tube 105 exposed to the outside via the through hole 107*b* of the main rib fixing member 107 as shown in FIG. 50 is compressed, since the stopper protrusion 122*b* is inserted in the second engaging hole 105*f* of the support tube 105*b* of the inner tube via the operation hole 104*c* of the outer tube, the spring support member 121 descends together with the inner tube 105, and the coil spring 118 and the second auxiliary coil spring 120 are concurrently compressed.

At this time, the inclined guide surface 103*c* formed at the installation hole 103*b* in the handle 103 is inserted via the hole 121*b* formed at the lower side of the inner insertion hole 121*a* of the spring support member 121, and the stopper 122 is pressed and moves toward the protrusion 122*b* and allows the protrusion 122*a* formed at the stopper 122 to be inserted into the second operation hole 105*e* of the support tube 105 via the engaging hole 104*d* of the outer tube, and the protrusion 122*b* escapes from the second engaging hole 105*f* formed at the support tube 105 and is positioned at an outer side of the operation hole 104*c*. So, since there is not contact between the support tube 105*b* of the inner tube 105 and the stopper 122, the inner tube 105 compresses only the coil spring 118.

At this time, the second auxiliary coil spring 120 is fixed at the upper side of the engaging hole 104*d* formed at the outer tube 104 by means of the protrusion 122*a* in the compressed state. In this state, the inner tube 105 compresses only the coil spring 118 and descends. The engaging protrusion 119*a* formed at the auxiliary button 119 is inserted into the engaging hole 105*c* formed at the inner tube 105, and the inner tube 105 is fixed, and the compression of the coil spring is finished.

The inner tube 105 is compressed by a short distance up to the inclined guide surface 103*c* formed at the installation hole 103*b* at the initial stage of operation by compressing the second auxiliary coil spring 120 and is fixed at the engaging hole 104*d* formed at the outer tube 104, and then the coil spring 118 is compressed, so less force is needed to compress the inner tube 105 as compared to the thirteenth embodiment of the present invention.

Figure 53:
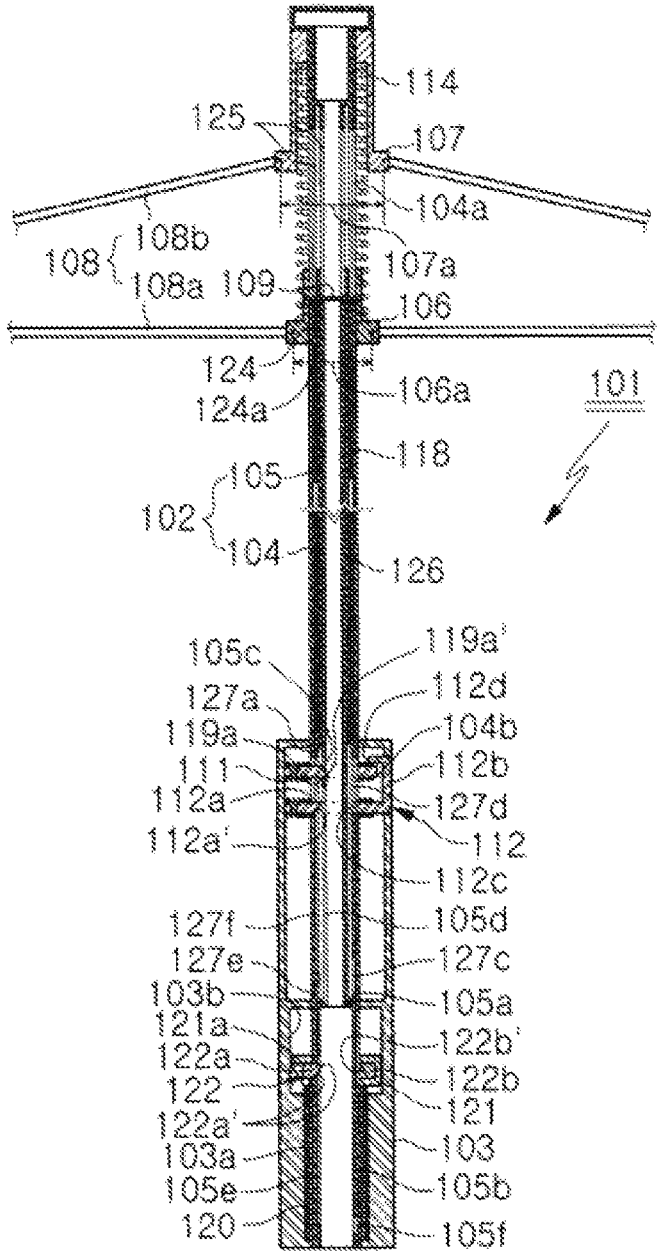
FIG. 53 is a cross sectional view illustrating a state that an umbrella spreads according to a sixteenth embodiment of the present invention.
Figure 54:
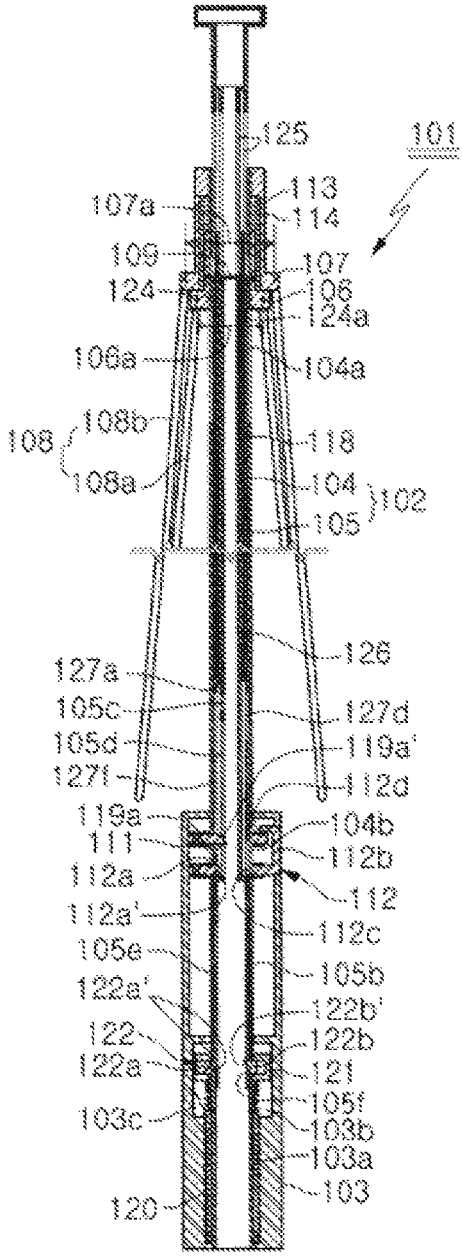
FIG. 54 is a cross sectional view illustrating a state that an umbrella is folded according to a sixteenth embodiment of the present invention.
Figure 55:
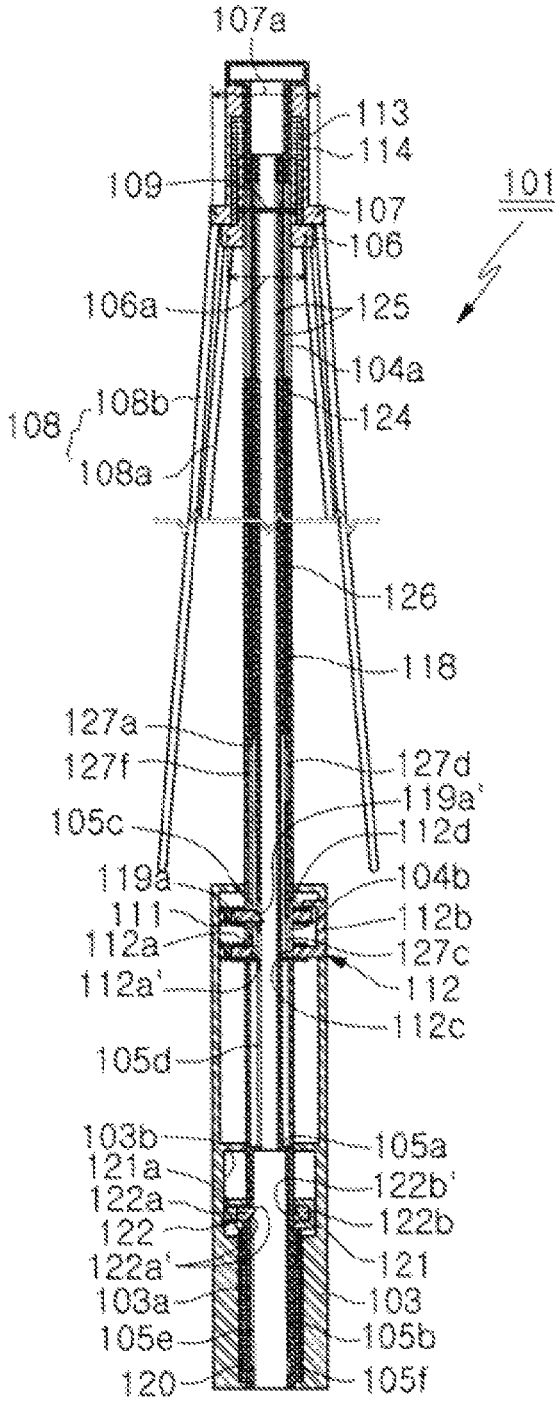
FIG. 55 is a cross sectional view illustrating a state that a coil spring and a second auxiliary coil spring are compressed in a state that an umbrella is fully folded according to a sixteenth embodiment of the present invention.

FIG. 53 is a cross sectional view illustrating a state that an umbrella spreads according to a sixteenth embodiment of the present invention, and FIG. 54 is a cross sectional view illustrating a state that an umbrella is folded according to a sixteenth embodiment of the present invention, and FIG. 55 is a cross sectional view illustrating a state that a coil spring and a second auxiliary coil spring are compressed in a state that an umbrella is fully folded according to a sixteenth embodiment of the present invention.

The sixteenth embodiment of the present invention is basically directed to easily spreading the umbrella 101 wherein the umbrella 101 is constructed like in the fifteenth embodiment of the present invention. An auxiliary coil spring 113 is installed between the auxiliary rib fixing member 106 and the main rib fixing member 107. The auxiliary coil spring 113 is built in the spring housing 114 integrally formed at the main rib fixing member 107 in a state that the umbrella 101 is folded.

With the above construction of the sixteenth embodiment of the present invention, the umbrella 1 can spread fast when it is needed to spread the umbrella, and when it is needed to fold the umbrella 101, the umbrella 101 is not fast folded with the aid of the delay function of the auxiliary coil spring 113 when the umbrella 101 is folded by means of the second auxiliary coil spring 120. Namely, the umbrella 101 can be folded slowly.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

INDUSTRIAL APPLICABILITY

The umbrella according to the present invention has a simple structure, and the manufacture of the same does not cost high, and it is very convenient to spread and fold the umbrella of the present invention while providing excellent durability and fewer breakdowns.

The umbrella according to the present invention is characterized in that the diameter of the engaging part to which the main ribs are secured is larger than the diameter of the engaging part to which the auxiliary ribs are secured, so it is possible to easily spread and fold the umbrella, which results in a very useful application in the industry.

The invention claimed is:

1. An umbrella, comprising:

a shank which includes an outer tube with a handle being secured to a lower side thereof, and an inner tube which is secured to an inner side of the outer tube and has a stopper protrusion at its intermediate upper portion;

an auxiliary rib fixing member and a main rib fixing member which are installed at the upper sides of the outer tube and the inner tube, respectively;

a rib assembly which includes a plurality of auxiliary ribs and a plurality of main ribs which are rotatably assembled to the auxiliary rib fixing member and the main rib fixing member, respectively;

elongated operation holes which are elongated in upward and downward directions at an upper side of the handle and are opposite to each at the outer tube;

an operation handle which ascends and descends along an outer portion of the outer tube and is assembled to the inner tube via the elongated operation holes by a pin;

an operation button which is installed at the handle and are elastically supported by a spring and includes an engaging protrusion which is inserted into a second operation hole formed at a lower side of the outer tube; and engaging holes and which are formed at the portions matching with the upper dead point and the lower dead point between which the inner tube ascends or descends, below the operation handle, with the engaging protrusion formed at the operation button being selectively secured.

2. An umbrella according to claim 1, wherein a diameter of an engaging part of the main rib secured to the main rib fixing member is larger than a diameter of an engaging part of the auxiliary rib secured to the auxiliary rib fixing member.

3. An umbrella according to claim 1, further comprising:

an auxiliary coil spring which is installed between the auxiliary rib fixing member and the main rib fixing member; and a spring housing which is integrally formed at the main rib fixing member for thereby accommodating the auxiliary coil spring in a state that the umbrella is folded.

4. An umbrella, comprising:

a shank which includes an outer tube with a handle being secured to a lower side thereof, and an inner tube which is secured to an inner side of the outer tube;

an auxiliary rib fixing member and a main rib fixing member which are installed at the upper sides of the outer tube and the inner tube, respectively;

a rib assembly which includes a plurality of auxiliary ribs and a plurality of main ribs which are rotatably assembled to the auxiliary rib fixing member and the main rib fixing member, respectively;

an enlarged tube part which is integral with the inner tube at a lower side of the inner tube;

a spring pressing tube which appears below the handle and has a support shoulder formed at its lower side, with an engaging shoulder formed at its upper side being caught by an upper side of the enlarged tube part;

a coil spring which is disclosed between a stopper protrusion formed at an intermediate upper portion of the inner tube, while being positioned below the auxiliary rib fixing member, and an engaging shoulder of the spring pressing tube;

an auxiliary button which performs a pressing operation by an operation button installed at the handle while being elastically supported by the spring and a pressing piece integrally formed at the operation button;

a pair of engaging protrusions which are formed at the operation button and the auxiliary button toward the spring, and an ascending and descending prevention protrusion and a support protrusion which are formed opposite to the engaging protrusion of the operation button and are formed at a lower side of the pressing piece;

a guide surface which is downwardly inclined and formed at the engaging protrusion of the operation button, and a guide surface which is upwardly inclined and formed at the engaging protrusion of the auxiliary button;

a first engaging hole which is short formed at an upper side of the enlarged tube part so that the engaging protrusions are selectively secured to the operation button and the auxiliary button, and an operation hole which is elongated in its lower direction, and an operation hole which is long formed at an upper side of the spring pressing tube while overlapping with the same, and a second engaging hole which is short formed in its lower direction;

an operation hole which is formed at an inner side of the handle of the outer tube through which the engaging protrusions, the ascending and descending prevention protrusion and the support protrusion come in and out; and a stopper hole which is positioned while overlapping with the first engaging hole and the operation hole at the upper side of the enlarged tube part while being selectively secured to the ascending and descending prevention protrusion and the support protrusion formed at the operation button and the pressing piece, respectively, and which is sized to be small so that the support protrusion does not enter when pressing the operation button, and stopper holes which are formed in the same sizes at the lower side of the enlarged tube part and the spring pressing tube while overlapping with the second engaging hole and the operation hole formed at the spring pressing tube and which is long formed so that the support protrusion can enter when pressing the operation button.

5. An umbrella according to claim 4, further comprising:

a space which is downwardly open toward the inner side of the handle; and a second auxiliary coil spring which is installed between the handle and the support shoulder formed at a lower side of the spring pressing tube and is inserted in the space.

6. An umbrella according to claim 5, further comprising:

an auxiliary coil spring which is installed between the auxiliary rib fixing member and the main rib fixing member; and a spring housing which is integrally formed at the main rib fixing member for thereby accommodating the auxiliary coil spring in a state that the umbrella is folded.

7. An umbrella according to claim 4, further comprising:

a space which is formed at an inner side of the handle;

a second auxiliary spring which is inserted into the space; and an installation hole which is formed below the space in the handle, wherein a spring support member is installed at the installation hole for supporting the second auxiliary coil spring, while being inserted into an outer side of the outer tube, and an inner insertion hole, which is open at its side, is formed at the spring support member, and a stopper having opposite protrusions is formed at the inner insertion hole, while being inserted into an outer side of the outer tube, and a hole is formed at an upper side of the inner insertion hole, with the inclined guide surface formed at an upper side of the installation hole being inserted into the hole, and one side of each of the protrusions formed at the stopper forms an inclined surface in an upward and downward direction, with the inclined surface being inserted into the engaging hole formed at the outer tube and a second operation hole formed at the spring pressing tube, and the other side of the same forms a downwardly inclined surface which is inserted into an operation hole formed at the outer tube and a second engaging hole formed at the spring pressing tube.

8. An umbrella according to claim 7, further comprising:

an auxiliary coil spring which is installed between the auxiliary rib fixing member and the main rib fixing member; and a spring housing which is integrally formed at the main rib fixing member for thereby accommodating the auxiliary coil spring in a state that the umbrella is folded.

9. An umbrella according to claim 4, wherein a diameter of an engaging part of the main rib secured to the main rib fixing member is larger than a diameter of an engaging part of the auxiliary rib secured to the auxiliary rib fixing member.

10. An umbrella according to claim 4, further comprising:

an auxiliary coil spring which is installed between the auxiliary rib fixing member and the main rib fixing member; and a spring housing which is integrally formed at the main rib fixing member for thereby accommodating the auxiliary coil spring in a state that the umbrella is folded.

11. An umbrella, comprising:

a shank which includes an outer tube with a handle being secured to a lower side thereof, and an inner tube secured to an inner side of the outer tube;

a main rib fixing member which is secured to an upper side of the outer tube;

an auxiliary rib fixing member which includes a pin secured to an upper side of the inner tube via an operation hole elongated in an upward and downward direction at the outer tube at a lower side of the main rib fixing member and ascends and descends along the outer tube while being secured to the pin;

a rib assembly which is formed of a plurality of auxiliary ribs and a plurality of main ribs which are rotatably secured to the auxiliary rib fixing member and the main rib fixing member;

an operation button which is installed at the handle while being elastically supported by the spring, and includes an engaging protrusion which is inserted into an operation hole formed at a lower side of the outer tube;

an appearing and disappearing part which is formed at a lower of the inner tube in an enlarged tube shape and is secured to the handle and includes an engaging shoulder formed at its lower side, with the appearing and disappearing part appearing when the umbrella spreads and disappearing when the umbrella is folded; and engaging holes which are formed at the appearing and disappearing part while matching with the upper dead point and the lower dead point between which the inner tube ascends and descends, with the engaging protrusion formed at the operation button being selectively secured.

12. An umbrella according to claim 11, further comprising:

an auxiliary coil spring which is installed between the auxiliary rib fixing member and the main rib fixing member; and a spring housing which is integral with the main rib fixing member so that the auxiliary coil spring is built-in in a state that the umbrella is folded.

13. An umbrella according to claim 11, wherein a diameter of an engaging part of the main rib secured to the main rib fixing member is larger than a diameter of an engaging part of the auxiliary rib secured to the auxiliary rib fixing member.

14. An umbrella, comprising:

a shank which includes an outer tube with a handle being secured to a lower side thereof, and a main rib fixing member being secured to its upper side, and an inner tube which is assembled via a through hole formed at the main rib fixing member and is secured to an inner side of the outer tube and includes a support tube which forms an engaging shoulder at its lower side for thereby being positioned at an inner side of the handle;

a spring support tube which is integrally covered at an upper outer portion of the inner tube and includes a shoulder at its lower side;

an operation hole which is elongated in an upward and downward direction at an outer tube of a lower side of the main rib fiving member, and an operation hole which is elongated in an upward and downward direction at the spring support tube secured to the inner tube and the inner tube, while communicating with the operation hole;

an operation tube of which upper side is inserted between the inner tube and the spring support tube;

a pin which is inserted into an upper side of the operation tube via the operation holes, and an auxiliary rib fixing member which is secured to the pin and ascends and descends along the outer tube;

a rib assembly which is formed of a plurality of auxiliary ribs and a plurality of main ribs which are rotatably secured to the auxiliary rib fixing member and the main rib fixing member;

an appearing and disappearing part which is integrally formed at a lower side of the operation tube so that the engaging shoulder positioned at the outer sides of the shoulder and the handle is formed in an upward and downward direction;

a coil spring which is installed between a shoulder of the spring support tube integrally formed at the inner tube and a shoulder formed at a boundary between the operation tube and the appearing and disappearing part;

an operation button which is installed at the handle and is elastically supported by the spring, and an auxiliary button which presses by means of the pressing piece integrally formed at the operation button;

engaging protrusions which are formed at the operation button and the auxiliary button in the direction of the spring, and an ascending and descending prevention protrusion and a support protrusion which are formed opposite to the engaging protrusion of the operation button and at the upper side of the pressing piece;

a guide surface which is upwardly inclined at the engaging protrusion of the operation button and a guide surface which is downwardly inclined at the engaging protrusion of the operation button;

an engaging hole which is short formed at an upper side of the inner tube so that the engaging protrusions formed at the operation button and the auxiliary button are selectively secured, an operation hole which is downwardly long formed at its lower side, an operation hole which is long formed at an upper side of the appearing and disappearing part while overlapping with the same, and an engaging hole which is short formed at its lower side;

an operation hole which is formed at an inner side of the handle of the outer tube, with the engaging protrusions, the ascending and descending prevention protrusions and the support protrusion entering the operation hole; and a stopper hole of an upper side of the appearing and disappearing part elongated so that the support protrusion can be inserted when the operation button is pressed, with the stopper hole being overlapped with the engaging hole and the operation hole of the appearing and disappearing part so that the ascending and descending prevention protrusion and the support protrusion formed at the operation button and the pressing piece can be selectively engaged, with the stopper hole being overlapped with the engaging hole and the operation hole formed at the stopper hole formed at a lower side of the appearing and disappearing part, which is sized small so that the support protrusion is not inserted when the operation button is pressed, and the inner tube.

15. An umbrella according to claim 14, further comprising:

a cover which seals a lower side of the space which is downwardly open toward an inner side of the handle; and a second auxiliary coil spring which is built in the space and is positioned between the cover and the support tube formed at a lower side of the inner tube.

16. An umbrella according to claim 15, further comprising:

an auxiliary coil spring which is installed between the auxiliary rib fixing member and the main rib fixing member; and a spring housing which is integral with the main rib fixing member so that the auxiliary coil spring is built-in in a state that the umbrella is folded.

17. An umbrella according to claim 14, further comprising:

a space which is formed at an inner side of the handle;

a second auxiliary coil spring which is inserted into the space; and an installation hole which is formed above a space at an inner side of the handle, wherein a spring support member is inserted into an outer side of the outer tube, while supporting the second auxiliary coil spring in the installation hole, and an inner insertion hole, of which one side is open, is formed at the spring support member, and a stopper having opposite protrusions is inserted into an outer side of the outer tube in the inner insertion hole, and a hole is formed at a lower side of the inner insertion hole, with the inclined guide surface formed at a lower side of one side of the installation hole being inserted into the hole, and one side of each of the protrusions formed at the stopper forms an inclined surface in an upward and downward direction, with the inclined surface being inserted into an engaging hole formed at the outer tube and a second operation hole formed at the support tube of the inner tube, and the other side of the same forms an upwardly inclined surface, with the upwardly inclined surface being inserted into an operation hole formed at the outer tube and a second engaging hole formed at the support tube of the inner tube.

18. An umbrella according to claim 17, further comprising:

an auxiliary coil spring which is installed between the auxiliary rib fixing member and the main rib fixing member; and a spring housing which is integral with the main rib fixing member so that the auxiliary coil spring is built-in in a state that the umbrella is folded.

19. An umbrella according to claim 14, further comprising:

an auxiliary coil spring which is installed between the auxiliary rib fixing member and the main rib fixing member; and a spring housing which is integral with the main rib fixing member so that the auxiliary coil spring is built-in in a state that the umbrella is folded.

20. An umbrella according to claim 14, wherein a diameter of an engaging part of the main rib secured to the main rib fixing member is larger than a diameter of an engaging part of the auxiliary rib secured to the auxiliary rib fixing member.

* * * * *